US007681513B1

(12) United States Patent
Hundertmark

(10) Patent No.: US 7,681,513 B1
(45) Date of Patent: Mar. 23, 2010

(54) TILLER OPERATED MARINE STEERING SYSTEM

(75) Inventor: James M. Hundertmark, Fond du Lac, WI (US)

(73) Assignee: Mark X Steering Systems LLC, Oshkosh, WI (US)

( * ) Notice: Subject to any disclaimer, the term of this patent is extended or adjusted under 35 U.S.C. 154(b) by 86 days.

(21) Appl. No.: 12/025,323

(22) Filed: Feb. 4, 2008

Related U.S. Application Data

(63) Continuation-in-part of application No. 11/139,795, filed on May 27, 2005, now Pat. No. 7,325,507.

(51) Int. Cl.
*B63H 25/22* (2006.01)
*B63H 25/10* (2006.01)
*B63H 25/34* (2006.01)
*B63H 25/00* (2006.01)

(52) U.S. Cl. ..... 114/150; 114/144 R; 114/171; 114/172

(58) Field of Classification Search ..... 114/150, 114/172, 144 R, 171; 440/61 S, 61 A, 61 B, 440/61 C, 63
See application file for complete search history.

(56) References Cited

U.S. PATENT DOCUMENTS

| | | | | |
|---|---|---|---|---|
| 2,927,551 | A | | 3/1960 | Bevis at al. |
| 2,947,278 | A | | 8/1960 | Magill et al. |
| 3,039,420 | A | | 6/1962 | Bevis et al. |
| 3,148,657 | A | * | 9/1964 | Horning ..... 440/55 |
| 3,631,833 | A | | 1/1972 | Shimanckas |
| 3,658,027 | A | | 4/1972 | Sturges |
| 3,796,292 | A | | 3/1974 | Harrison |
| 4,227,481 | A | | 10/1980 | Cox et al. |
| 4,557,695 | A | | 12/1985 | Nelsen |
| 5,105,924 | A | | 4/1992 | Carlson |
| 5,349,818 | A | * | 9/1994 | McFadyen et al. ..... 60/385 |
| 5,423,277 | A | | 6/1995 | Gai |
| 5,447,456 | A | * | 9/1995 | Nakayasu ..... 440/61 R |
| 6,341,992 | B1 | | 1/2002 | Eglinsdoerfer et al. |
| 6,715,438 | B1 | * | 4/2004 | Hundertmark ..... 114/144 R |
| 7,325,507 | B1 | * | 2/2008 | Hundertmark ..... 114/150 |

* cited by examiner

*Primary Examiner*—Daniel V Venne
(74) *Attorney, Agent, or Firm*—Boyle Fredrickson, S.C.

(57) ABSTRACT

A hydraulic lock of a tiller-based watercraft steering system is responsive to tiller release to lock a watercraft's steered element in the last commanded position upon tiller release. The hydraulic lock can be controlled through an actuator assembly that is provided between a tiller arm and the watercraft's steered element. One or more cables connect the actuator assembly to other components of the hydraulic lock. A thermal compensator regulates pressure within the hydraulic lock by accommodating changes in temperature related characteristics of the fluid within the hydraulic lock Increases in fluid pressure due to thermal expansion can be mitigated within the thermal compensator by automatically or manually directing a volume of fluid from the hydraulic lock, through a compensating valve assembly, and into a reservoir. Decreases in fluid pressure can be mitigated by directing fluid from the reservoir back into the hydraulic lock.

24 Claims, 28 Drawing Sheets

TILLER OPERATED MARINE STEERING SYSTEM

CROSS REFERENCE TO RELATED APPLICATION

This application is a continuation-in-part application of presently co-pending U.S. application Ser. No. 11/139,795, filed May 27, 2005, and entitled "Tiller Operated Marine Steering System," the entirety of which is incorporated herein by reference in its entirety.

BACKGROUND OF THE INVENTION

1. Field of the Invention

The invention relates to marine steering systems and, more particularly, relates to a steering system for a boat or other watercraft that is powered by a motor and steered by a tiller. Specifically, the invention relates to a tiller-operated steering system that is self-locking upon tiller release so as to immunize the tiller from reaction forces that would otherwise be imposed on the tiller by the motor or other steered element. The watercraft's steered element therefore retains the last steering angle commanded upon tiller release.

2. Discussion of the Related Art

In one type of conventional marine steering system, a watercraft such as a boat is steered by pivoting an outboard motor on the stem of the watercraft about a vertical steering axis under control of an operator. The steering forces are typically generated manually using a tiller that is located at the stern of the boat and that is connected to the motor either directly or indirectly via a mechanical steering linkage.

Reaction forces are imposed on and/or by the motor or other steered element during normal operation of the typical boat. These reaction forces may cause the steering angle to change unless the reaction forces are countered by the operator. The operator must therefore retain control of the tiller at all times in order to maintain a desired steering angle. The operator's freedom of movement therefore is sharply curtailed. In addition, the reaction forces increase generally proportionately with motor size. The relatively large reaction forces imposed on and by larger motors require commensurately larger retention forces by the operator, leading to operator fatigue over time.

Several proposals have been made to incorporate features into a marine steering system to prevent reaction or backlash forces imposed on or by the motor or other steered element from being translated back to the tiller. Most of these systems take the form of a wrapped spring brake or similar mechanical lock that acts on a steering shaft assembly or other rotational steering system component. The mechanical lock releases automatically when steering forces are imposed on one end of the rotational component so as to permit rotation of that component for the purpose of changing the steered element's steering angle. The lock engages automatically when backlash or reaction forces are transmitted to the opposite end of the rotational component, thereby locking the component from rotation and maintaining the last commanded steering angle of the steered element. Systems of this type are disclosed, for example, in U.S. Pat. No. 2,927,551 to Bevis; U.S. Pat. No. 2,947,278 to Magill; U.S. Pat. No. 3,039,420 to Bevis; and U.S. Pat. No. 3,796,292 to Harrison.

Others have proposed the coupling of a watercraft's steered mechanism to a hydraulic cylinder whose piston is locked from motion upon release of the steering mechanism so as to lock the rudder or other steered element in position and, thereby prevent backlash forces from being transmitted back to the steering mechanism. Systems of this type are disclosed, for example, in U.S. Pat. No. 3,631,833 to Shimanckas; U.S. Pat. No. 3,658,027 to Sturgis; U.S. Pat. No. 4,227,481 to Cox; and U.S. Pat. No. 4,557,695 to Neissen.

However, all of the self-locking steering systems described above are rather complex and cannot be easily installed without substantial modification to the existing steering system. Most of these systems are configured exclusively for use with a helm-based steering system rather than a tiller-based steering system. None is configured to be easily incorporated into an existing tiller-based steering design or retrofitted onto a pre-manufactured tiller-based steering system.

Perhaps as a result of these deficiencies, the prevailing approach used by engine manufacturers utilizes a friction based system, located between the tilt tube for an outboard engine and a tiller, and operable to resist tiller movement. The degree of resistance can be adjusted by manually adjusting a knob. While such friction-based devices reduce the transfer of forces on the tiller, they also hinder tiller operation. They also are necessarily limited in the capacity to block the tiller against undesired movement. They also tend to wear with time, requiring frequent readjustment to maintain the desired resistance.

The need therefore has arisen to provide a simple, effective, self-locking tiller operated power assist steering system that maintains a steering angle against reaction forces on or by the steered element, thereby negating the need for the operator to constantly man the tiller.

The need has additionally arisen to provide a self-locking system that can be incorporated into an existing tiller-based steering system with minimal or no modification to the existing steering system design.

Furthermore, the need has arisen to provide a self-locking system with a hydraulic lock that automatically regulates its operating pressure, optionally having manual pressure relief functionality.

SUMMARY OF THE INVENTION

In accordance with one aspect of the invention, a mechanical/hydraulic system that is responsive to tiller release to lock a watercraft's steered element in the last commanded position is provided. This is done by way of a hydraulic lock which can include, e.g., a hydraulic cylinder, a valve assembly, and an actuator assembly that is provided between the tiller and the steered element. In some implementations, the actuator assembly and the valve assembly are distinct and separated from each other. In such implementations, the actuator and valve assemblies are preferably connected to each other by one or more cables.

A hydraulic pressure established within the hydraulic lock is regulated by a thermal compensator having a reservoir and a pressure regulating compensating valve assembly. The reservoir is in fluid communication with the hydraulic lock, and the pressure regulating compensating valve assembly influences flow direction and volume of the fluid between the hydraulic lock and the reservoir.

The pressure regulating compensating valve assembly includes a check valve and a relief valve incorporated therein. A volume of fluid flows through the check valve or the relief valve to accommodate fluid temperature decreases or increases, respectively. Relatively more pressure is required to actuate the pressure relief valve than the maximum acceptable operational pressure within the hydraulic lock during use which ensures that the hydraulic lock always maintains enough fluid pressure and volume to adequately function. For example, when the system experiences a use-induced pressure spike(s) corresponding to, e.g., engine torque, reaction forces, and/or other common operating forces, the relief valve will no be breached and the functional integrity of the hydraulic lock is maintained.

The check valve defines a check valve body and the compensating valve assembly can define a first fluid flow path extending axially through the check valve body and a second fluid flow path extending around an outer surface of the check valve body. The flow paths can be in opposing directions so that fluid within the hydraulic lock can flow into the reservoir and fluid within the reservoir can flow into the hydraulic lock in response to temperature and/or pressure characteristics within the hydraulic lock.

In some implementations, the thermal compensator automatically regulates pressure within the hydraulic lock and also enables a user to manually relieve hydraulic pressure from the hydraulic lock to, for example, lessen a seal drag condition within the hydraulic lock, as desired. This can be done by way of a plunger assembly that a user manipulates to relieve excessive hydraulic pressure from the hydraulic lock. The plunger assembly can be provided on a valve unit of the hydraulic lock, whereby it is actuatable by moving the hydraulic lock sufficiently far so that a plunger button of the plunger assembly contacts and is depressed by a mounting bracket of the hydraulic lock or steering system.

A method of operating a tiller fitted with a mechanical/hydraulic locking system having pressure regulating functionality is also provided.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. System Overview

Figure 1:
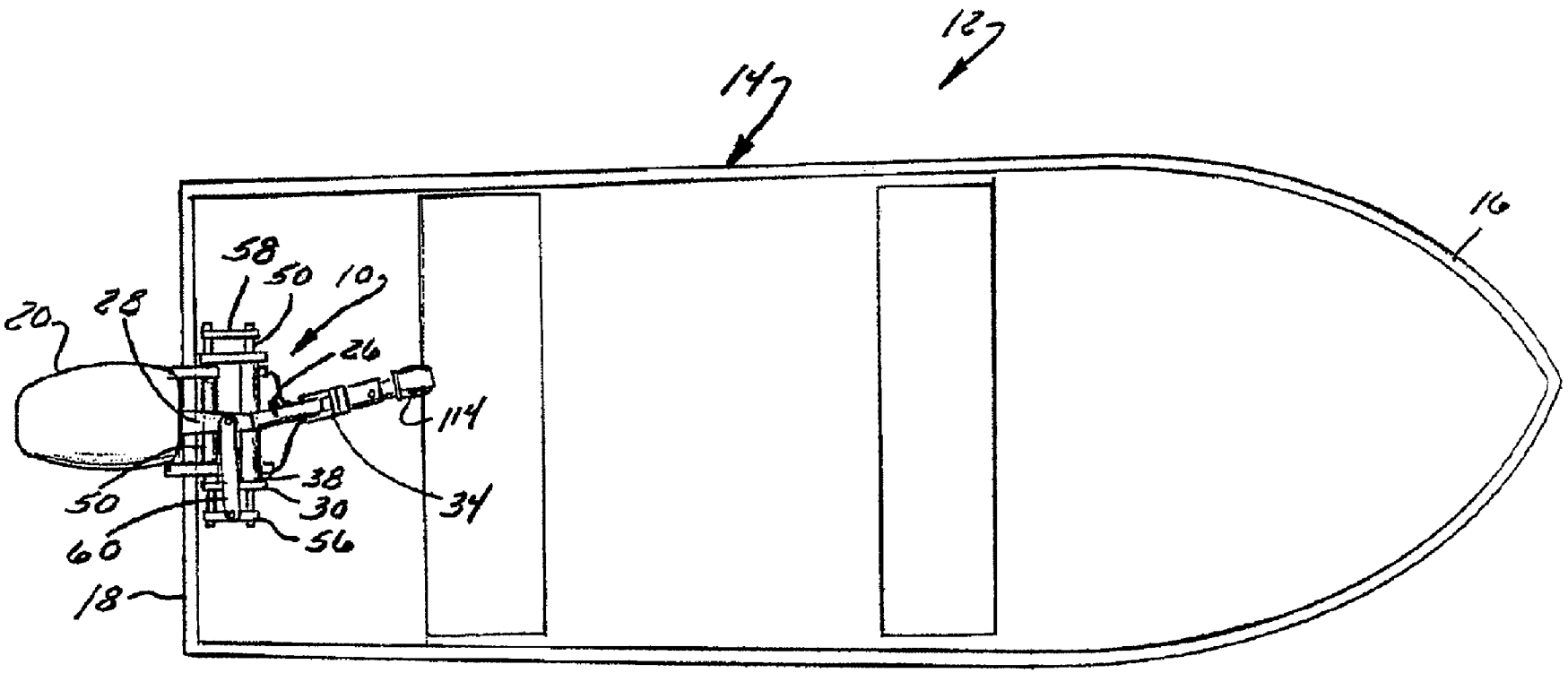
FIG. 1 is a schematic top plan view of a boat incorporating a self-locking tiller-operated steering system constructed in accordance with a first preferred embodiment of the present invention.
Figure 2:
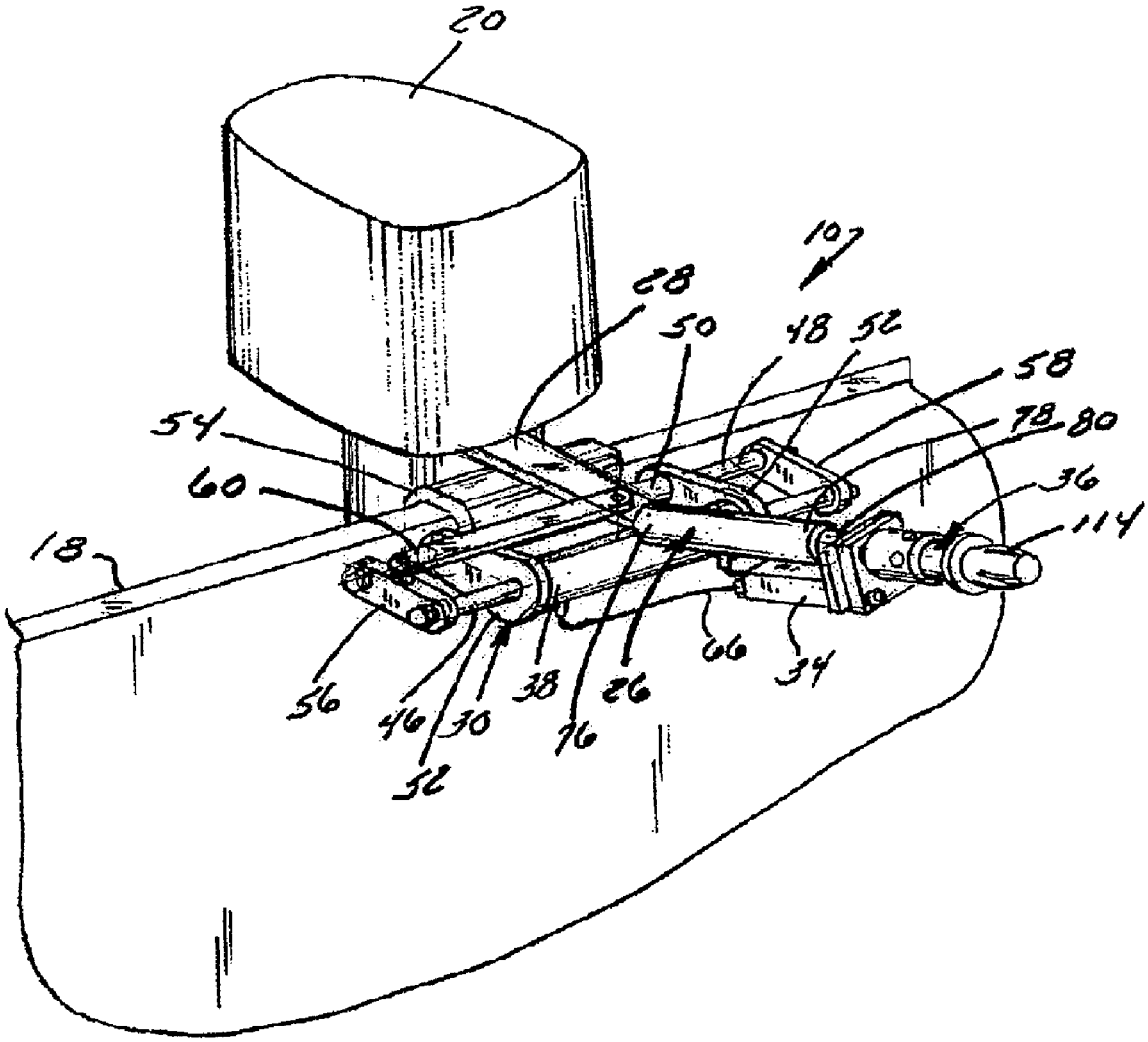
FIG. 2 is a perspective view of the steering system of FIG. 1 and of the surrounding portion of the boat.
Figure 3:
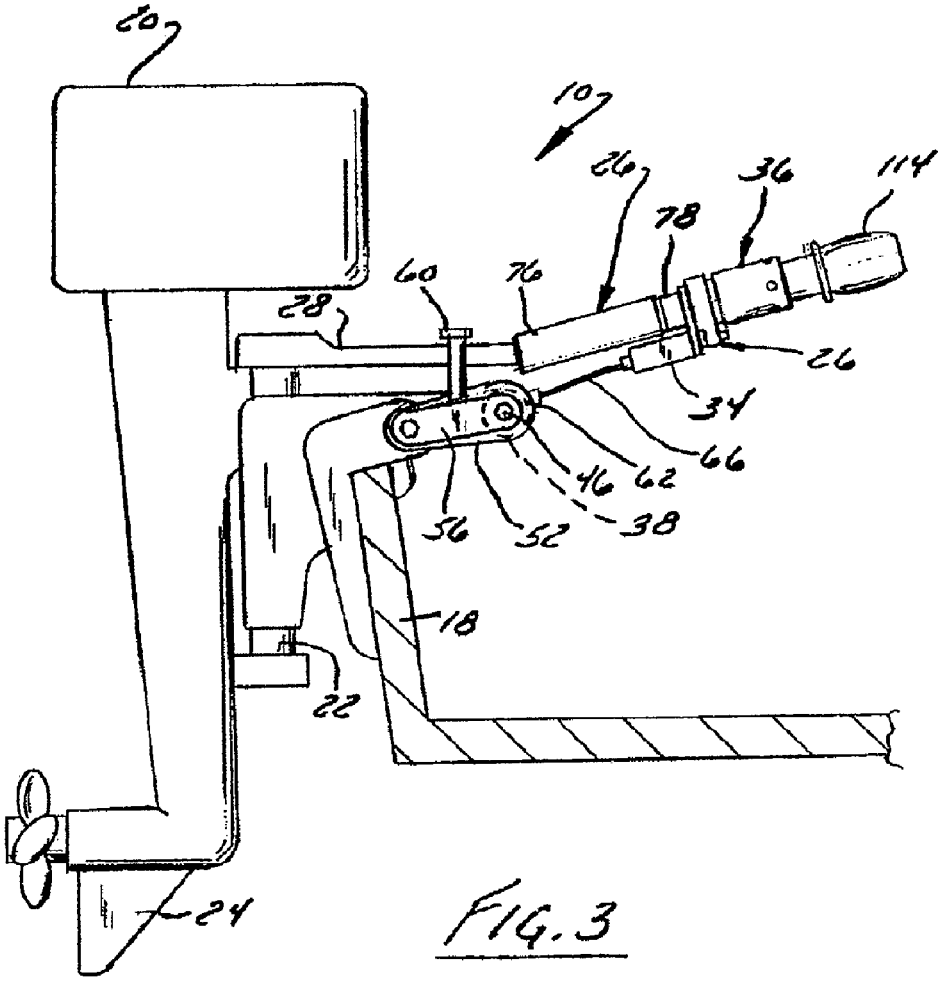
FIG. 3 is a side elevation view of the stern of the boat, showing the engine and steering system mounted on the stem.

Turning now to the drawings and initially to FIGS. 1-3, a boat 12 is illustrated that incorporates a self-locking tiller-operated steering system 10, constructed in accordance with a preferred embodiment of the present invention. The boat 12 includes a hull 14 having a bow 16 and a stern formed by a transom 18, and an outboard motor 20 mounted on the transom 18. As is conventional, the motor 20 is mounted on the boat 12 by a pivoting mount assembly 22 that permits the motor 20 to be pivoted about a generally vertical steering axis to cause a rudder 24 on the motor 20 to steer the boat 12 as best seen in FIG. 3. The motor 20 could alternatively be a non-pivoting inboard or outboard motor, and the boat 12 or other watercraft could be steered by one or more rudders located either on or remote from the motor 20.

Steering forces are transmitted to the motor 20 by a tiller 26. The tiller 26 is coupled to the motor by a steering arm 28 that causes the motor 20 to swing about its pivot axis when steering forces are applied to the tiller 26. The steering arm 28 has a first end fixed to the motor's pivot shaft 22 and a second end that is operatively coupled to the tiller 26. Alternatively, the tiller 26 could be operatively coupled to the motor 20 by a cable arrangement or some other structure permitting the tiller 26 to be located remote from the motor 20. The tiller 26 could also be mounted directly on or formed integrally with the motor 20 or a stand-alone rudder.

The steering system 10 is configured to be self-locking. That is, it incorporates a hydraulic lock that is automatically engaged upon tiller release or a lack of input from the operator to prevent reaction forces imposed on or by the rudder 24 from being transmitted back to the tiller 26 and thereby maintaining the last commanded steering angle. The hydraulic lock automatically disengages upon the imposition of manual steering forces on the tiller 26 to permit manual steering. Hydraulic lock engagement and disengagement is controlled by actuation of a valve assembly 32 that reacts to tiller actuation, preferably by articulation of an actuator portion of the tiller relative to the remainder of the tiller, to prevent fluid flow to and from the hydraulic lock. The hydraulic lock preferably comprises a hydraulic cylinder assembly having a piston that can be locked in position by preventing fluid flow to and from cylinder chambers located on opposite sides of the piston. The system requires minimal, if any, modification to the existing tiller design. In fact, embodiments of the system are available that can be retrofitted onto an existing tiller without substantial modification to the tiller.

Four exemplary self-locking steering systems will now be described by way of non-limiting examples of steering systems constructed in accordance with the invention.

2. Construction and Operation of First Embodiment

Figure 4:
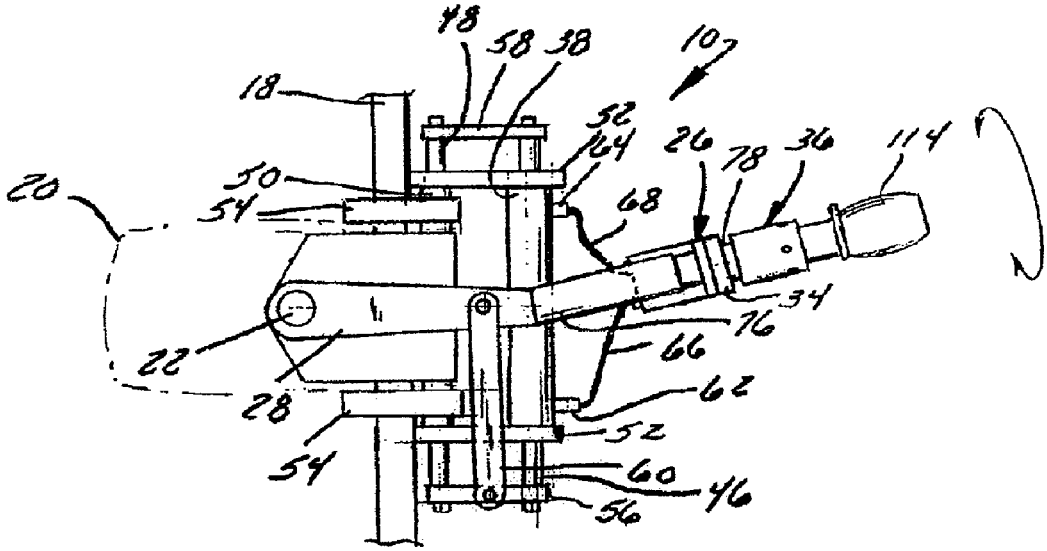
FIG. 4 is top plan view of the steering system of FIG. 2.

Turning now to FIGS. 2-7B and initially to FIGS. 2-4, a self-locking tiller actuated steering system 10 constructed in accordance with the first preferred embodiment of the invention include the above-described tiller, a hydraulic lock in the form of a cylinder assembly 30, and a valve assembly 32 that is housed in a valve unit 34 mounted on the underside of the tiller 26. The valve assembly 32 is responsive to tiller operation to selectively engage and disengage the hydraulic lock by selectively permitting or preventing a movable portion of the cylinder assembly 30 from moving. More specifically, the valve assembly 32 is actuated in response to movement of an actuator portion 36 of the tiller 26 relative to another portion of tiller from a neutral position thereof in order to permit fluid to flow to and from the hydraulic cylinder assembly 30 to disengage the lock and permit movement of the portion of the tiller 26 that is coupled to the systems arm 28. The valve assembly 32 is deactuated in response to release of the tiller 26 or a lack of input from the operator and return of the tiller actuator portion 36 to its neutral position to prevent fluid from flowing to or from the cylinder assembly 30 to engage the lock and prevent tiller movement, thereby preventing reaction forces imposed on or by the motor 20 from being transmitted to the tiller 26 and maintaining the last commanded steering angle of the rudder 24. The hydraulic cylinder assembly 30, tiller 26, and valve assembly 32 will now be described in turn.

Figure 5:
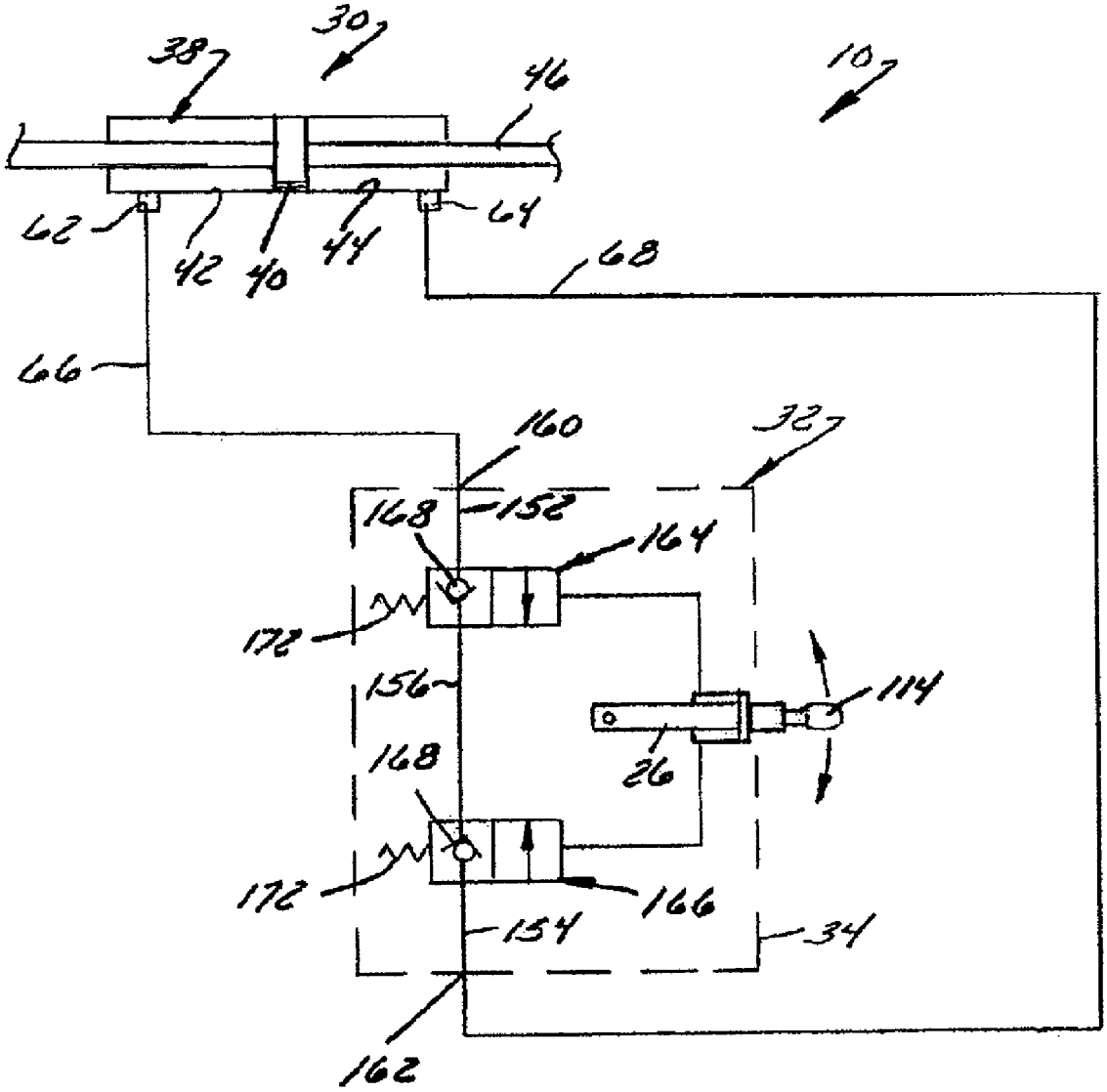
FIG. 5 is a hydraulic circuit schematic illustrating the construction and operation of the hydraulic components of the steering system of FIGS. 2-4.

Referring now to the mechanical drawings of FIGS. 2-4 and to the hydraulic schematic of FIG. 5, the hydraulic cylinder assembly 30 includes a cylinder 38, a balanced piston 40 that is mounted in the cylinder 38 to define first and second chambers 42 and 44 on opposite sides thereof, and a rod 46 that is affixed to the piston 40 and that extends though both ends of the cylinder 38. Pursuant to the invention, one of the rod 46 and the cylinder 38 is movable relative to the other and is connected to the steering arm 28, and the other of the rod 46 of the cylinder 38 is mounted on a fixed support such as the transom 18 or on an intervening mounting assembly. In the illustrated embodiment, the rod 46 is coupled to the steering arm 28, and the cylinder 38 is mounted on the transom 18. Specifically, a guide rod 48 is slidably mounted in a guide and support sleeve 50 so as to extend laterally along the inside surface of the transom 18 in front of the motor 20. The cylinder 38 is located in front of the sleeve 50 and is fixed to the sleeve 50 by a pair of laterally spaced, longitudinally extending links 52. The assembly formed by the sleeve 50 and the cylinder 38 is clamped to the transom 18 by clamp brackets 54 located on opposite sides of the motor 20. The opposed ends of the rod 46 are linked to the guide rod 48 by a pair of laterally spaced, longitudinally extending links 56 and 58. The link 56 is coupled to the steering arm 28 by a pivot arm 60. Specifically, pivot arm 60 has a first end pivotally attached to the first link 56 and a second end pivotally attached to the steering arm 28 between the tiller 26 and the pivot shaft 22.

As best seen in FIGS. 2 and 5, the first and second chambers 42 and 44 in the cylinder 38 have corresponding first and second ports 62 and 64 that are coupled to first and second hydraulic lines 66 and 68. The lines 66 and 68 convey hydraulic fluid between the chambers 42 and 44 and the valve assembly 32. As a result of this arrangement, tiller pivoting motion causes the steering arm 28 to swing in the direction of the arrow in FIG. 4, resulting in corresponding movement of the cylinder rod 46 and guide rod 48 relative to the fixed sleeve 50 and the cylinder 38. When the hydraulic lock is engaged by preventing fluid flow to and from the cylinder 38 to prevent the piston 40 and rod 46 from moving relative to the cylinder 38, the pivot arm 60 is locked in place, thereby locking the steering arm 28 and the tiller 26 in place and maintaining the last commanded steering angle of the rudder 24.

Referring to FIGS. 2-4 and 6, the tiller 26 includes a hollow tiller arm 70 and a throttle shaft 72. The throttle shaft 72 extends though the hollow interior of the tiller arm 70. It has a proximal, inner end borne in the hub of a throttle cable drive pulley (not shown). It also has a distal front end 74 that is splined to the tiller actuator portion 36. The tiller arm 70 extends from a rear, proximal end 76 affixed to the steering arm 28 to a front, distal end 78. The front end 78 has a reduced diameter portion 80 that supports a valve actuator 82 and the valve body 34.

Figure 6:
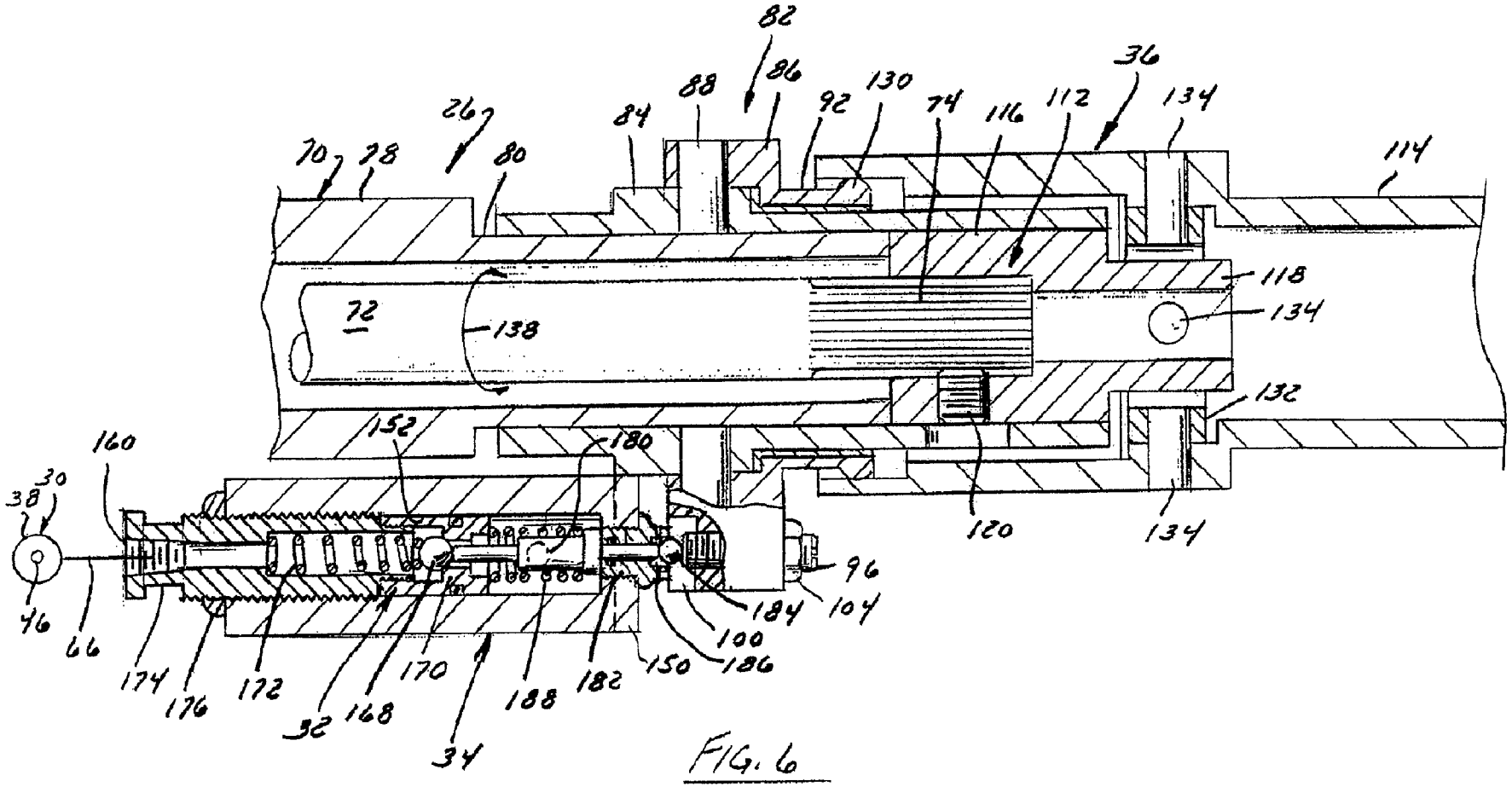
FIG. 6 is a sectional elevation view of a portion of a tiller of the steering system of FIGS. 2-4 that includes a valve actuator and valve assembly of the steering system.
Figure 7A:
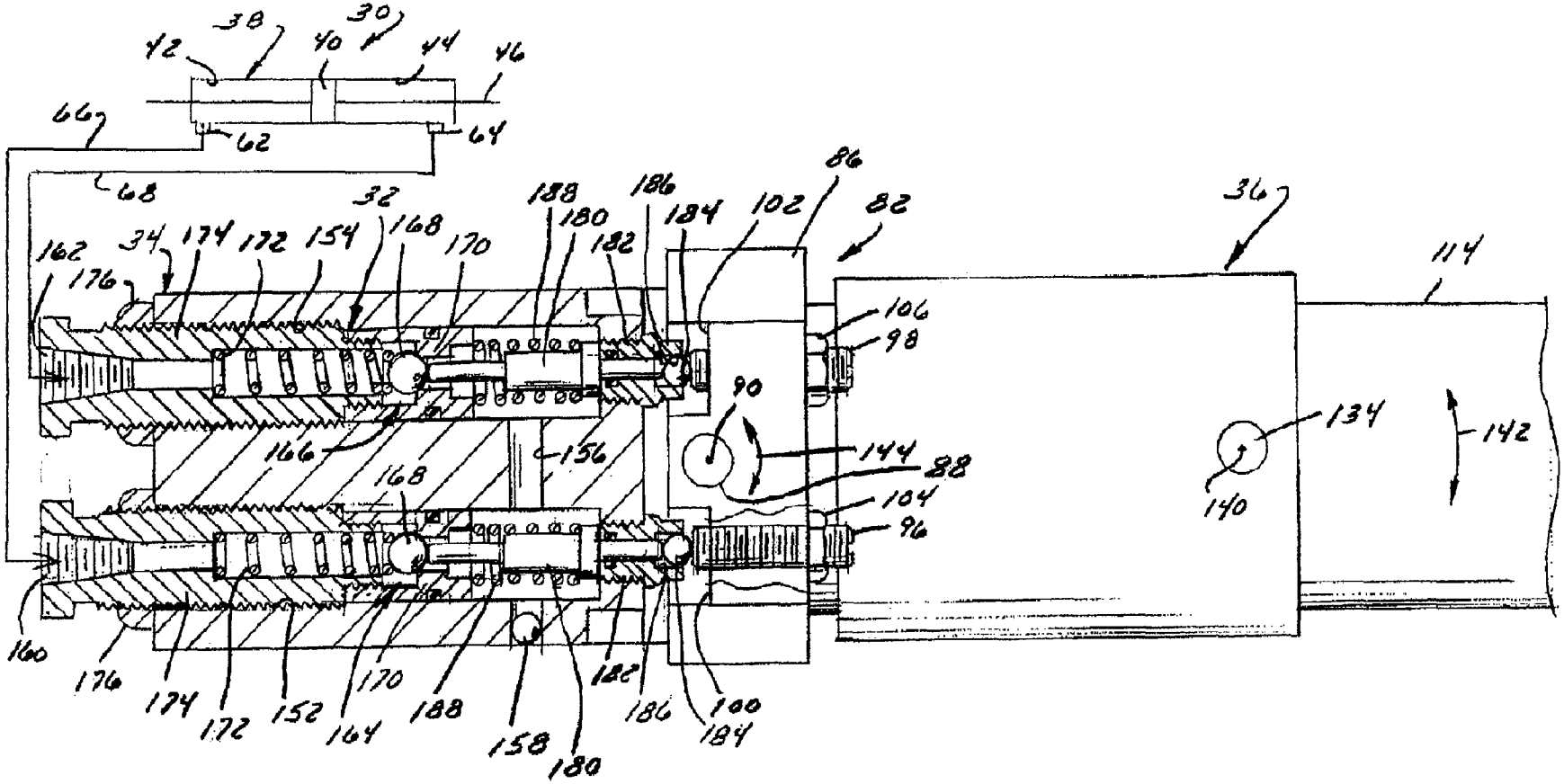
FIG. 7A is a sectional bottom plan view of the steering system portion of FIG. 6, showing the valve actuator in a first operational position thereof.

The valve assembly 32 is actuated by a valve actuator 82 that is responsive to tiller actuator portion movement. Referring now to FIGS. 6 and 7A, the valve actuator 82 is mounted on the first end of the tiller arm 70 so that a portion thereof is pivotable from a neutral position thereof through a limited stroke relative to the tiller arm 70 to actuate the valve assembly 32. The valve actuator 82 includes an actuator support sleeve 84 and an actuator block 86 that is pivotably mounted on the actuator support sleeve 84. The actuator support sleeve 84 has a rear end that surrounds the reduced diameter front portion 80 of the tiller arm 70 and a front end that extends beyond the front end 78 of the tiller arm 70. The actuator block 86 comprises a metal block mounted on the actuator support sleeve 84 by swivel pins 88 so as to be capable of pivoting about a pivot axis 90 in the direction of the arrow in FIG. 7A. A guide collar 92 extends forwardly from the body of the actuator block 86 for guiding the throttle grip 114 as detailed below.

Referring particularly to FIG. 7A, first and second drive pins 96 and 98 are threaded through tapped bores located on opposite sides of the pivot axis 90 of the actuator block 86 and into counterbores 100 and 102 located at the rear surface of the actuator block 86. The position of the rear end of each drive pins 96 and 98 relative to the rear surface of the actuator block 86 can be adjusted by threading the drive pin 96 or 98 into or out of the associated bore and locking the drive pin in place with a lock nut 104 or 106.

Referring to FIG. 6, the tiller actuator portion 36 of this embodiment comprises a throttle grip assembly mounted on the end of the throttle shaft 72. The throttle grip assembly comprises a grip support tube 112 and a throttle grip 114 mounted on the grip support tube 112. The grip support tube 112 has a relatively large diameter rear portion 116 and a relatively small diameter front portion 118. The exterior of the rear portion 116 is guided by the extension of the actuator support sleeve 84, and the interior of the of the rear portion 116 is splined to the front end 74 of the throttle shaft 72 and held against the throttle shaft 72 by a set screw 120. The throttle grip 114 is hollow so as to be mountable over the grip support tube 112, the extension of the actuator support sleeve 84, and the collar 92 of the actuator block 86. The rear end of the throttle grip 114 engages and is guided by an annular rib 130 on the front end of the guide collar 92. The throttle grip 114 is pivotally mounted on the front end portion 118 of the grip support tube 112 by a universal joint 132 and corresponding universal joint pins 134. With this arrangement, the throttle grip 114 can rotate relative to the tiller arm 70 to rotate the throttle shaft 72 in the direction of the arrow 138 in FIG. 6 to actuate the throttle. It can also pivot about a vertical pivot axis formed by the universal joint pins 134 to actuate the valve assembly 32. The relationship between the universal joint 132 and the swivel pins 88 causes the actuator block 86 and throttle shaft 72 to pivot in opposite directions. Hence, clockwise throttle shaft pivoting in the direction of arrow 142 in FIG. 7B results in counterclockwise actuator block pivoting in the direction of arrow 144, and vice versa.

Referring to FIGS. 5, 6, and 7A, the valve body 34 is mounted on the tiller arm 70 proximate the first end of the tiller arm, preferably by being affixed to a lateral plate 150 on the bottom surface of the actuator support sleeve 84. The valve body 34 has first and second longitudinal through bores 152 and 154 that house the valve assembly 132. It also has a cross passage 156 connecting the bores 152 and 154 to one another. The cross passage 156 is drilled into the valve body 34 from its lower surface and closed at the bottom end by a plug 158. The rear ends of the bores 152 and 154 from first and second inlet/outlet ports 160 and 162 are connected to the corresponding ports 62 and 64 in the cylinder 38 by the hydraulic lines 66 and 68.

The valve assembly 32 comprises first and second control valves 164 and 166 that are identical in construction. The control valve 164 will now be described, it being understood that the description applies equally to the valve 166. Control valve 164 includes check ball 168 located adjacent a seat 170 positioned generally centrally of the bore 152 behind the cross passage 156. The check ball 168 is biased against the seat 170 by a relatively weak return spring 172 that seats against the check ball 168 at its forward end and against a spring seat at its rear end. The spring seat is formed by a step in a bore in a fitting 174 threadedly into the rear end of the bore 152. Fitting 174 is internally threaded at its rear end for connection to the hydraulic line 66. It can be rotated to adjust the distance between check ball 168 and actuator pin 180.

The opening force for the check ball 168 can be generated either by pressure in the cross passage 156 or by an actuator pin 180 that is driven by drive pin 96. The actuator pin 180 extends longitudinally forwardly from the check ball 168 and into an actuator guide 182 threaded into the front end of the bore 152. A wear ball 184 is mounted in a recess 186 in the front end of the actuator guide 182 in abutment with the corresponding drive pin 96 of the valve actuator 82. The actuator pin 180 is biased to the position illustrated in FIG. 7A by a relatively strong return spring 188. The return spring 188 also acts through the actuator pin 180, wear ball 184, and drive pin 96 to bias the valve actuator 82 and throttle grip 114 to their neutral, centered positions.

In use, the steering system 10 assumes the position illustrated in FIGS. 5, 6, and 7A in the absence of the imposition of steering forces on the throttle grip 114. At this time, the throttle grip 114 assumes its center or neutral position, and both control valves 164 and 166 assume their illustrated closed position. Fluid flow between the chambers 42 and 44 in the cylinder 38 is blocked by the closed control valves 164 and 166, hence locking the piston 40 from moving. This locking prevents steering arm motion and assures that the tiller 76 and motor 20 retain their position despite the imposition of reaction or backlash forces on or by the motor 20.

Figure 7B:
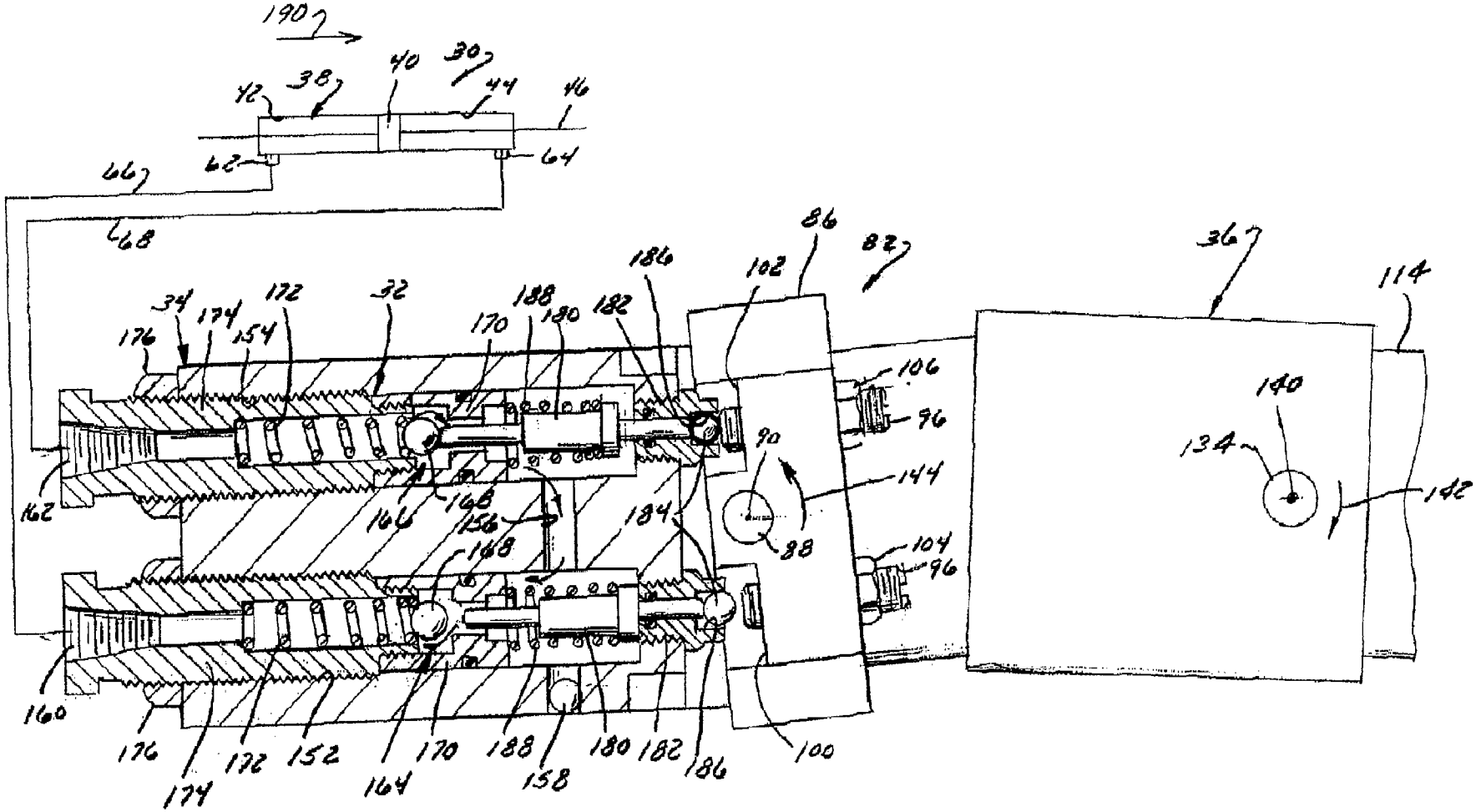
FIG. 7B corresponds to FIG. 7A and shows the valve actuator in a second operational position thereof.

Assuming now that the operator wishes to turn the boat 12 to the right, he or she pivots the throttle grip 114 clockwise as seen in FIG. 7B, thereby moving the actuator block 86 counterclockwise and causing it to open the control valve 166. Additional throttle grip pivoting drives the tiller arm 70 and steering arm 28, hence pivoting the motor 20 about its support 22 and altering the steering angle of the rudder 24. Steering arm movement and resulting cylinder rod movement drives the piston 40 to the right as represented by the arrow 190 in FIG. 7B, forcing fluid from the chamber 44 of the cylinder 38. Fluid then flows through the line 68 and into the port 162, through the valve 166, through the cross passage 156, and into the bore 152. The resulting fluid pressure in the front section of the bore 154 opens the check ball 168 of the valve 164 and permits fluid to flow out of the port 160, through the line 66, and into the opposite chamber 42 of the cylinder 38 via the port 62.

If the operator releases the throttle grip 114, the throttle grip 114 and tiller actuator portion 36 will return to their neutral, center position of FIG. 7A under the force of the actuator pin return spring 188. The check ball 168 of valve 166 will then close under the force of the return spring 172 and any residual fluid pressure across the check ball 168. The check ball 168 of valve 164 will likewise close as soon as the forces imposed on it by the pressure in the cross passage 156 drop below the closing force imposed by the return spring 172. Fluid flow through the valve assembly 32 is now blocked, preventing the piston 40 from moving and locking the motor 20 and its rudder 24 in its last-commanded steering angle. It should be noted that the operator does not need to release the throttle grip to stop the engine movement. If there is a lack of input from the engine, the engine will stop moving when the input from the operator stops. If the tiller 26 is moved in the direction of the torque when the operator input stops, the torque will move the tiller 26 to close the valves.

When steering is required for a left turn, the above operation occurs in the same way but in the opposite direction. Hence, the operator pivots the throttle grip 114 counterclockwise to pivot the actuator block 86 clockwise to open the valve 164 through the line 66. Fluid then flows from the port 62 in the chamber 42 in the cylinder 38, into the port 160, through the open control valve 164, through the cross passage 156, and opens the control valve 166. The fluid then flows out of the port 162 of the valve body 34, through the line 68, and into the opposite chamber 44 of the cylinder 38 via the port 64.

Hence, regardless of the direction of throttle grip movement, one of the control valves 164 or 166 is opened mechanically by an associated drive pin 96 or 98 of the actuator block 86, and the other control valve 166 or 164 is opened by forces arising from the flow of pressurized fluid through the valve body 34.

Valve actuation may be resisted or assisted by reaction forces imposed on or by the motor 20. For instance, if motor torque creates a pressure in the chamber 44 of the cylinder 38 and the operator wants to steer against that torque, he or she will have to impose sufficient force on the tiller 26 to cause the piston 40 to generate sufficient pressure in the opposite chamber 42 to overcome the pressure in the chamber 44 and permit fluid to flow from the chamber 42 to the chamber 44. Conversely, if the engine torque creates a pressure in chamber 44, and the operator wants to steer with the engine torque, he or she moves the throttle grip clockwise with only enough force to pivot the actuator block 186 sufficiently to cause the drive pin 96 to open the control valve 166, at which time the engine torque will drive the piston to the right and cause fluid to flow from the chamber 44, through the valve assembly 32 via the lines 68 and 66, into the opposite chamber 42. Again, as before, once the operator stops the input to the throttle grip 114 the engine torque will return it to its center position, the control valves 164 and 166 close, and all fluid flow and piston movement stops.

3. Construction and Operation of the Second Embodiment

Another embodiment of a self-locking steering system 210 constructed in accordance with the invention is illustrated in FIGS. 8-14. It is usable with the same boat 12 as shown in FIG. 1. It differs from the first embodiment primarily in that a more versatile valve assembly is used that is more easily incorporated into a standard tiller design and, in fact, can be retrofitted onto an existing tiller with little or no tiller modification. It is also illustrated as being used with a different cylinder assembly and steering linkage, but only for the purposes of illustrating the diversity of the invention. Components of the steering system of this embodiment corresponding to components of the first embodiment are designated by the same reference numerals in the drawings, incremented by 200. Hence, the steering system 210 includes a tiller 226, a steering arm 228, a steering cylinder assembly 230, and a valve assembly 232. The valve assembly 232 is housed in a valve body 234 mounted on the tiller 226 actuated by a tiller actuator portion 236.

Figure 8:
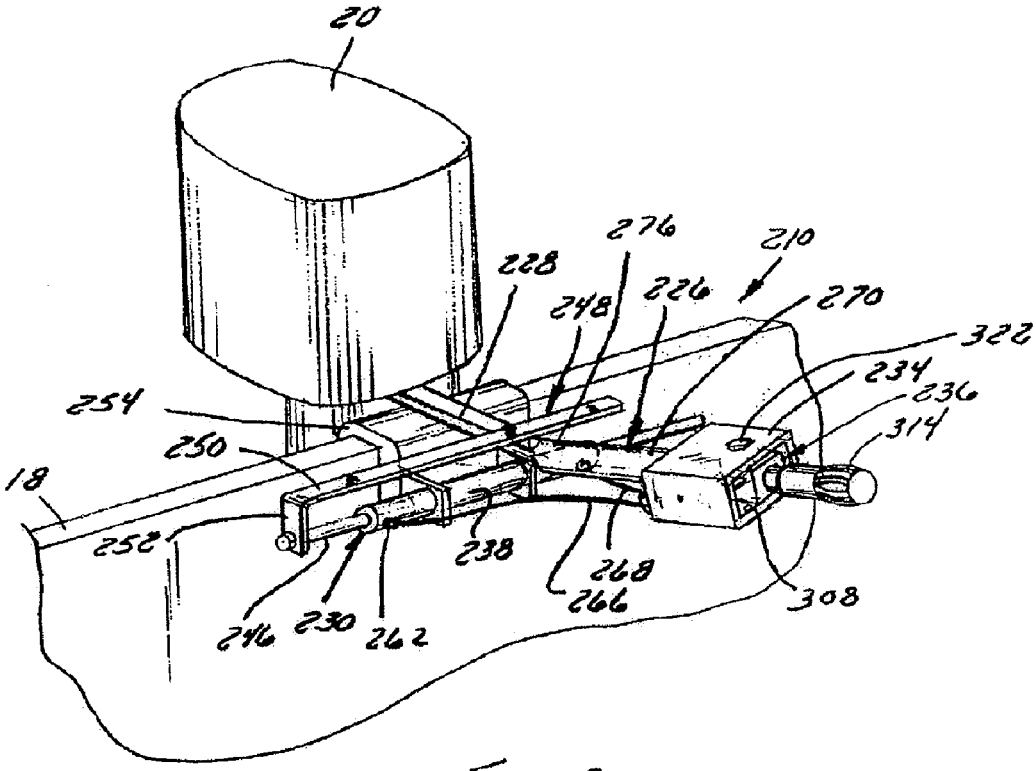
FIG. 8 is perspective view of a steering system constructed in accordance with a second embodiment of the invention and of the surrounding portion of a boat.
Figure 9:
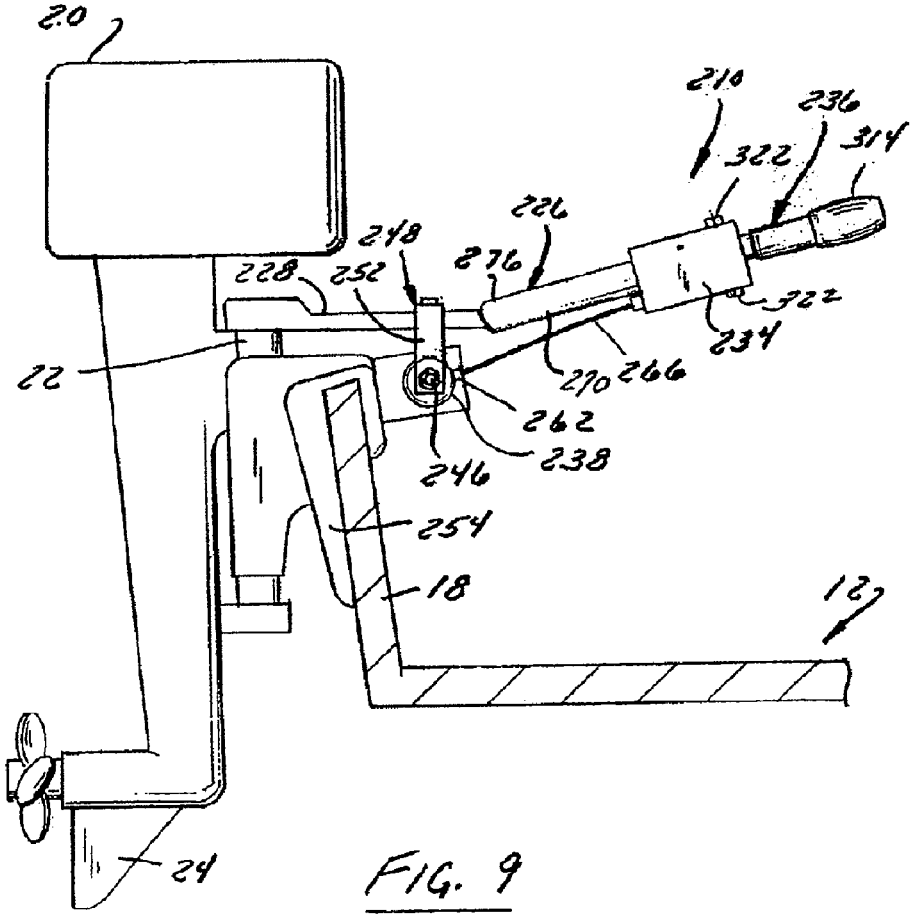
FIG. 9 is a side elevation view of the portion of the boat illustrated in FIG. 8.

The cylinder assembly 230 of this embodiment is functionally identical to the cylinder assembly 30 of the first embodiment. It therefore includes a cylinder 238, a balanced piston 240 disposed in the cylinder 238, and a rod 246 that is attached to the piston 240 to separate the cylinder 238 into first and second chambers 242 and 244. Ports 262 and 264 in the cylinder and connected to the valve body 234 by lines 266 and 268. As best seen in FIGS. 8 and 9, the rod 246 extends completely through the cylinder 238 to terminate at opposed ends extending beyond opposite ends of the cylinder 238. It is coupled to the steering arm 228 by a bracket 248 extending over the steering cylinder. The bracket 248 includes a horizontal portion 250 affixed to the tiller arm 228 at its center, and downwardly angled end 252 affixed to pivot at the end of the rod 246. The cylinder 238 is affixed to the transom 18 of the boat 12 clamp brackets 254 as described above.

Figure 10:
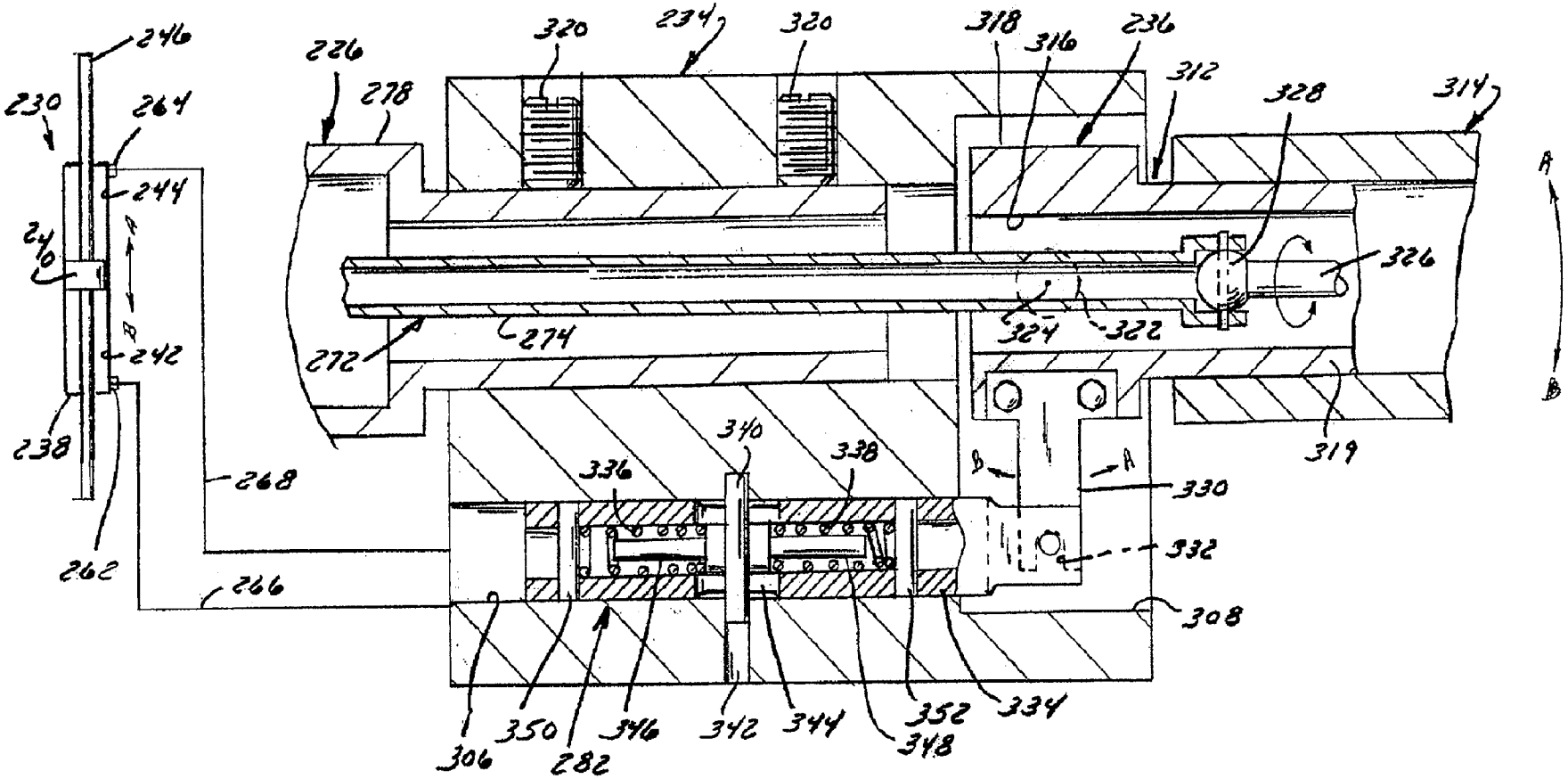
FIG. 10 is a sectional elevation view of a portion of a tiller of the steering system of FIGS. 8 and 9 that includes an actuator portion of the tiller and a valve actuator.

Referring to FIG. 10, the tiller 226 includes a tiller arm 270 and a throttle shaft 272. Throttle shaft 272 extends longitudinally through a hollow interior of the tiller arm 270 to terminate in a front end 274. The tiller arm 270 has rear and front ends 276 and 278. The rear end 276 is affixed to the steering arm 228. The front end 278 supports the valve body 234. The front end 274 of the throttle shaft 272 extends beyond the front end 278 of the tiller arm 270.

The valve body 234 of this embodiment is configured to be mounted on the tiller 226 with little or no tiller arm modification. That is, the front end 278 of the typical tiller arm 270 has a stepped portion 280 for receiving a throttle grip 314, with the throttle grip being affixed to an extension of the tiller shaft that extends beyond the forward distal end of the tiller arm 270. The valve actuator 282 of this embodiment is formed integrally with the valve body 234, which is mounted on the forward distal portion 280 of the tiller arm 270 using suitable set screws 320 as seen in FIG. 10.

The valve actuator 282 of this embodiment is configured to react to throttle grip pivoting in generally the same manner as the valve actuator of the first embodiment. However, it is configured to react progressively and, if desired, nonlinearly to throttle grip pivoting movement as opposed to necessarily reacting linearly to throttle grip pivoting. The valve actuator 282 comprises a cam assembly that is driven to reciprocate linearly relative to the tiller arm 270 upon pivoting movement of a tiller actuator portion 236 relative to the remainder of the tiller 226. The tiller actuator portion 236 and valve actuator (hereafter "cam assembly" 282) will now be described in turn. The cam assembly 282 acts on first and second cam followers 302 and 304, each of which is configured to actuate a control respective valve of the valve assembly 232 under power of the cam assembly 282.

Referring to FIG. 10, the cam assembly 282 is mounted on a relatively large upper throughbore 306 of the valve body 234. The front end of the valve body 234 has a counterbore 308 formed therethrough for receiving the actuator portion 236 of the tiller arm 270. The actuator portion 236 includes a throttle grip adapter 312 and the throttle grip 314. The adapter 312 has a central throughbore 316, a relatively large diameter rear portion 318, and a relatively small diameter front portion 319. The rear portion 318 is located in the counterbore 308 in the valve body 234 and mounted on the valve body 234 by a swivel pin 322. Swivel pin 322 permits the adaptor 312 to pivot about a vertical axis 324 relative to the valve body 234. The throttle grip 314 is mounted on the front portion 319. A gap, formed between the rear end of the counterbore 308 in the valve body 234 and the rear end of the adaptor 312, defines the pivot limit of the tiller actuator portion 236 as it pivots about the pin 322. The front end 274 throttle shaft 272 extends into the bore 316 of the grip adaptor 312, where it is joined to a throttle shaft extension 326 via a swivel joint 328 that permits the shaft extension 326 to swivel relative to the remainder of the throttle shaft 272. An L-shaped actuator aim 330 extends downwardly from the rear end 318 of adaptor 312 and is coupled to the front end of the cam assembly 282 by a yoke 332. Hence, pivoting motion of the tiller actuator portion 236, results in linear movement of the cam assembly 282.

Figure 11:
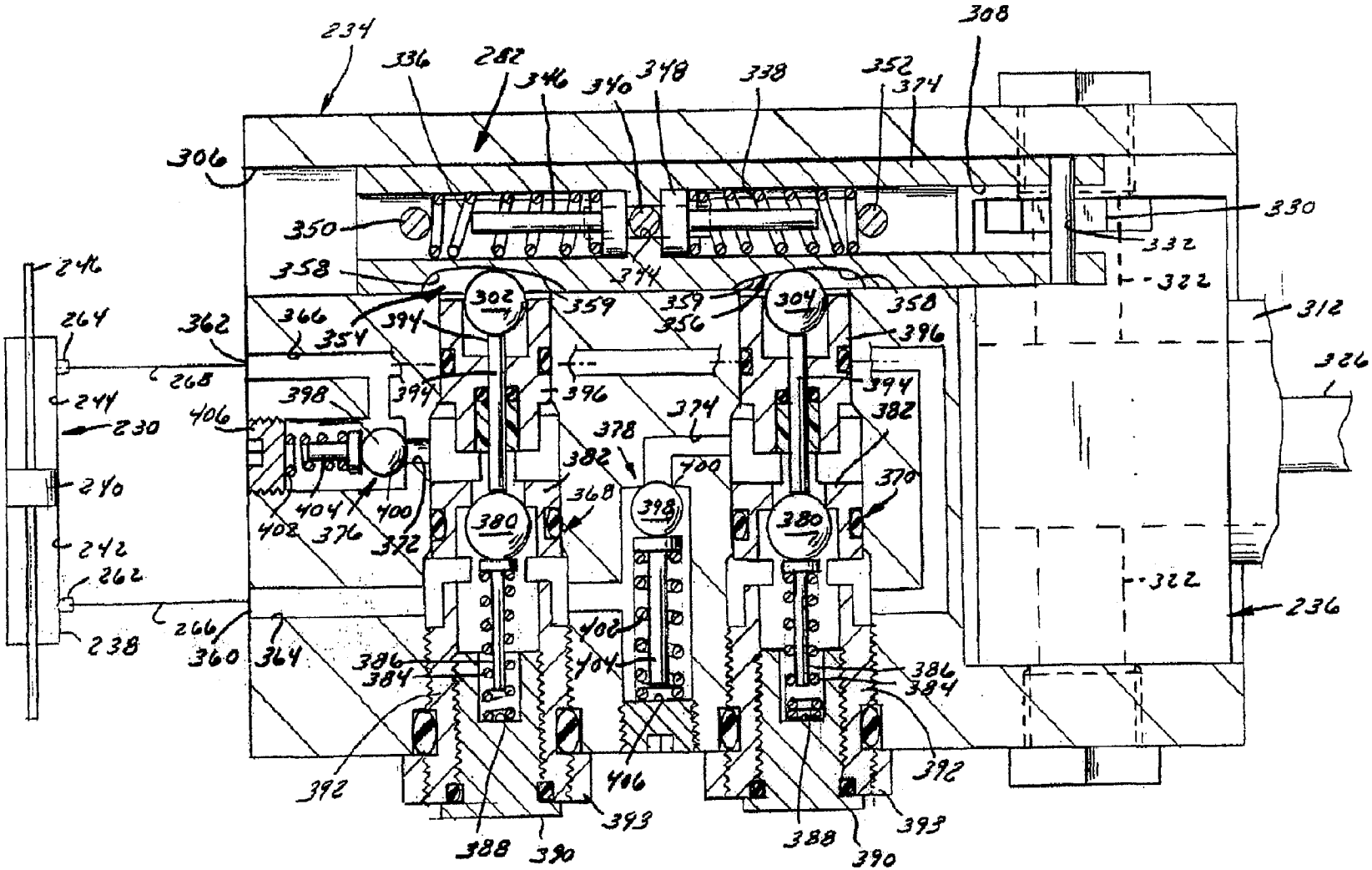
FIG. 11 is a sectional plan view of the portion of the tiller of FIG. 8.

Referring now to FIGS. 10 and 11, the cam assembly 282 includes the cam body 334 that is reciprocatably slidable within the bore 306 to selectively actuate first and second cam followers 302 and 304, each of which actuates a respective control valve of the valve assembly 232. The cam followers 302 and 304 of the illustrated embodiment take the form of cam balls. The front end of the cam body 334 is connected to the actuator arm 330 via the yoke 332. The cam body 334 is hollow so as to receive first and second centering springs 336 and 338. The centering springs 336 and 338 are symmetrical about a stationary centering pin 340 extends laterally through the cam body 334 and is retained in a lateral bore 342 that intersects the bore 306 in the valve body 234. The centering pin 340 extends through an elongated slot 344 in the cam body 334 so as to permit the cam body 334 to move longitudinally within the bore 306. The centering springs 336 and 338 are seated against opposite sides of the centering pin 344 via first and second spring guides 346 and 348. The opposite end of each centering spring 336, 338 rests on a retaining pin 350, 352 extending transversely through the cam body 334. Each spring 336, 338 is sufficiently strong to not only bias the cam body 334 to the center position illustrated in FIG. 10, but also to bias the tiller actuator portion 236 to the neutral position illustrated in FIG. 10. The springs 336 and 338 preferably each have a spring constant of 10-15 lbs.

As best seen in FIG. 11, cam grooves 354 and 356 are formed in the lower surface of the cam body 334 in alignment with cam followers 302 and 304. The cam grooves 352 and 354 are symmetrical about the lateral centerline of the cam body 334, each having a relatively deep portion 358 located relatively far apart from the centering pin 340 and a relatively shallow portion 359 located relatively close to the centering pin 340. The cam grooves 354 and 356 and cam followers 302 or 304 are located and dimensioned relative to one another such that one of the cam followers 302 and 304 rides along the surface of the associated cam groove 354 and 356 into an actuated position as the cam body 334 moves in one direction relative to the centering pin 340, whereas the opposite cam follower 304 and 302 remains stationary or at least is not driven downwardly far enough to actuate the associated control valve. Both cam followers 302 and 304 remain in a deactuated position when the cam body 334 assumes its centered, neutral position. The extent of cam follower stroke for a given cam body stroke is dependent upon the profile of the associated cam groove 354 or 356, hence permitting a progressive, nonlinear cam follower stroke. Moreover, because the operative portion of the cam body 334 could be located anywhere along the length of the tiller arm 370, the cam followers 302 and 304 and associated control valves could be located virtually anywhere along the length of the tiller 226, permitting versatility of valve body positioning.

Figure 12:
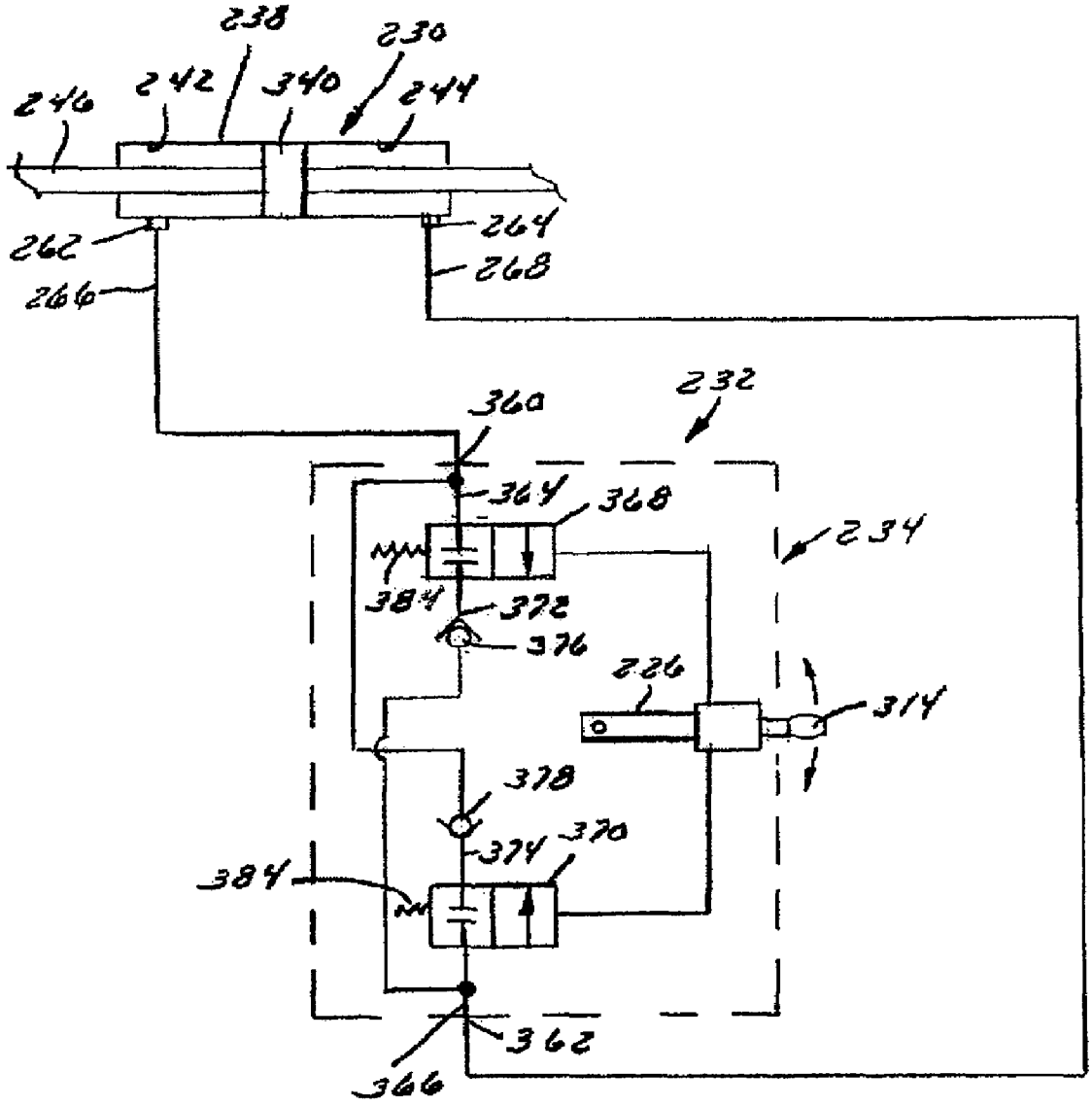
FIG. 12 is a hydraulic circuit schematic illustrating the construction and operation of the hydraulic components of the steering system of FIGS. 8-11.

Referring to FIGS. 11 and 12, the valve assembly 232 of this embodiment, like the corresponding assembly of the first embodiment, has first and second ports 360, 362 that communicate with the corresponding first ands second chambers 242, 244 in the cylinder 238 via the associated hydraulic lines 266, 268. The valve assembly 232 of this embodiment, though somewhat more complicated than the corresponding valve assembly of the first embodiment, performs the same function. That is, when the tiller actuator portion 236 is in its neutral position, the valve assembly 232 remains deactuated to prevent fluid flow through the valve body 234 and lock the steering cylinder piston 240 in its then-existing position, hence retaining the last commanded steering angle. It is also actuated when the tiller actuator portion 236 pivots in either direction about its pivot axis, thereby permitting fluid flow therethrough and permitting steering.

Still referring to FIGS. 11 and 12, the valve assembly 332 of this embodiment includes first and second inlet/outlet passages 364 and 366 opening into the first and second ports 360 and 362, respectively. Each passage 364 and 366 is also connected to respective cam operated control valve 368, 370. The opposite side of each control valve 368, 370 is connected to the opposite passage 366, 364 by a bypass passage 372, 374 that bypasses the other control valve 370, 368 and that contains a check valve 376, 378.

The first and second control valves 368 and 370 are essentially identical to the corresponding check control valves of the first embodiment. Hence, each valve 368, 370 includes a ball 380 located adjacent a seat 382. Each ball 380 is biased against its seat 382 by a return spring 384 seating against a spring guide 386 at one end and against a spring seat 388 at its opposite end. Each return spring 384 is of intermediate strength (e.g., 3-4 lbs.) to provide a secondary seal should the relatively low pressure check valves 376, 378 leak. Each spring seat 388 is formed by a step in a bore in a plug 390 threadedly mounted in a sleeve 392 screwed into the bottom of the valve body 234. The valve 368 or 370 can be moved in or out to adjust the distance between the ball 302 and 304 or the cam 354 or 356. A nut 393 locks the valve 368 or 370 in place.

During control valve actuation, the ball 380 of the actuated valve 368 or 370 is pushed downwardly away from the seat 382 by an actuator pin 394. The actuator pin 394 of each control valve 368 or 370 extends upwardly from the associated ball 380, through a pin guide 396, and into contact with an associated cam follower 302 or 304. Hence, when a cam follower 302 or 304 is driven downwardly by the associated cam groove 354 or 356, the actuator pin 394 of the associated control valve 368 or 370 drives the ball 380 from its seat 382 against the force of the return spring 384 to open the control valve and permit fluid flow into the associated bypass passage 372 or 374.

The check valves 376 and 378 permit the fluid circuit in the valve assembly 232 to be completed in either direction of fluid flow while preventing any backflow when the associated control valve 368 or 370 open. Each of the check valves 376, 378 comprises a ball 398 that is biased against a seat 400 in the corresponding bypass passage 372 or 374 by a relatively weak return spring 402 having spring constant of, e.g., ¼ to ½ lb. Each return spring 402 is guided by a spring guide 404 and seats on plug 406 threaded into the valve body 234 to seal the end of the associated bypass passage 372 or 374.

As a result of this arrangement, fluid flow through the valve assembly 232 is blocked when the cam body 334 and tiller actuator portion 236 are in their neutral position, and fluid is free to flow between the ports 360 and 362 whenever the tiller actuator portion 236 is pivoted to one side or the other from its neutral position to drive one of the associated cam followers 302, 304 downwardly to the open the associated control valve 368 or 370.

In use, whenever the operator does not apply steering forces to the throttle grip 314, the tiller actuator portion 236 and cam assembly 282 retain their neutral positions illustrated in FIGS. 10 and 11 in which the cam body 334 is centered relative to the centering pin 340. Both cam followers 302, 304 contact a relatively deep portion of the corresponding cam groove at this time and to permit the balls 380 of the control valves 368, 370 to remain seated, hence 20, preventing fluid flow through either of the control valves 368, 370. Chambers 242 and 244 of cylinder 238 therefore remain isolated from one another, and the piston 240 and rod 246 are locked from movement, thereby preventing reaction forces imposed on or by the motor 20 from changing the steering angle of the boat 12.

Figure 13:
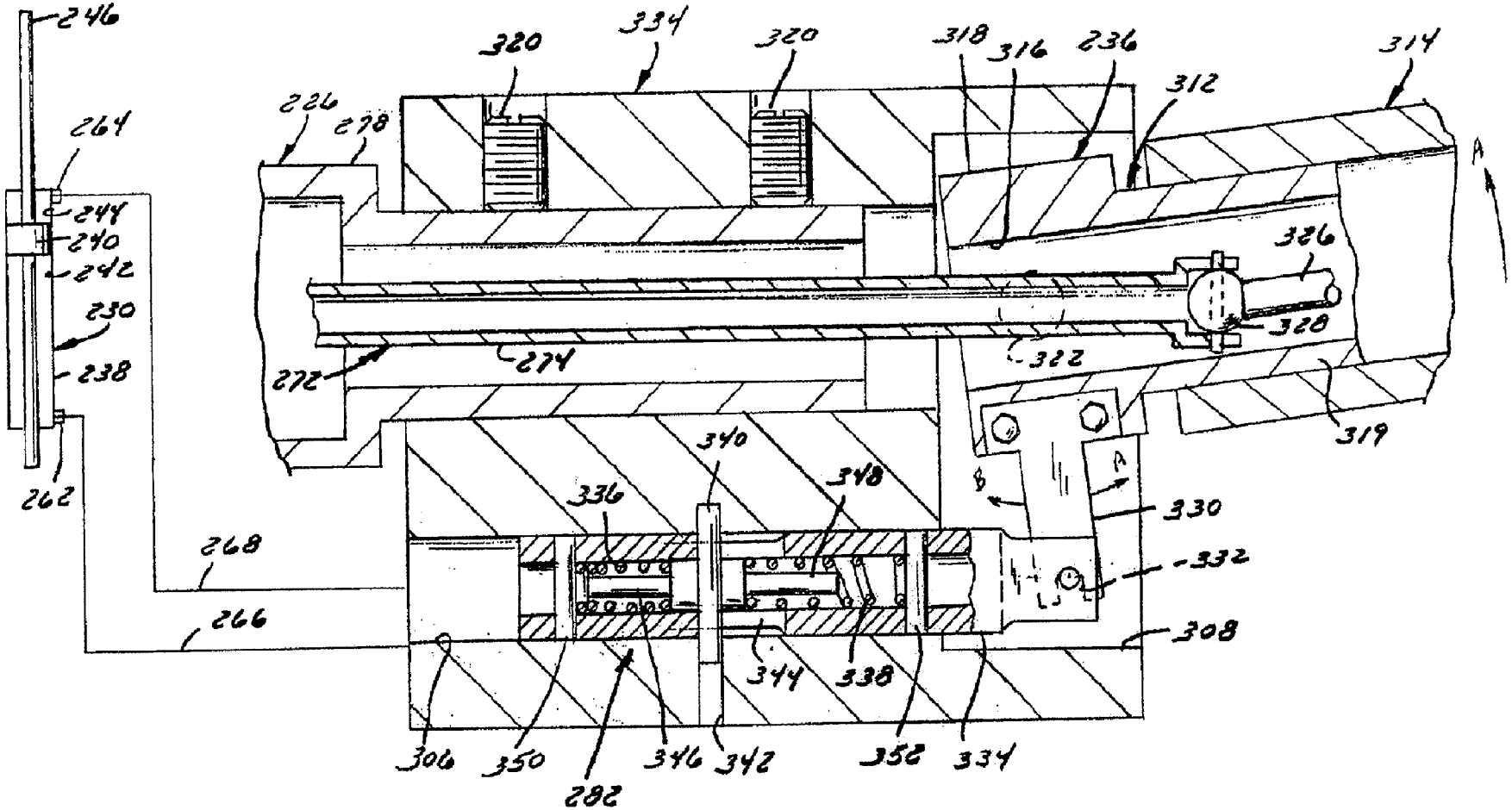
FIG. 13 corresponds to FIG. 10 but illustrates the steering system in an actuated position thereof.
Figure 14:
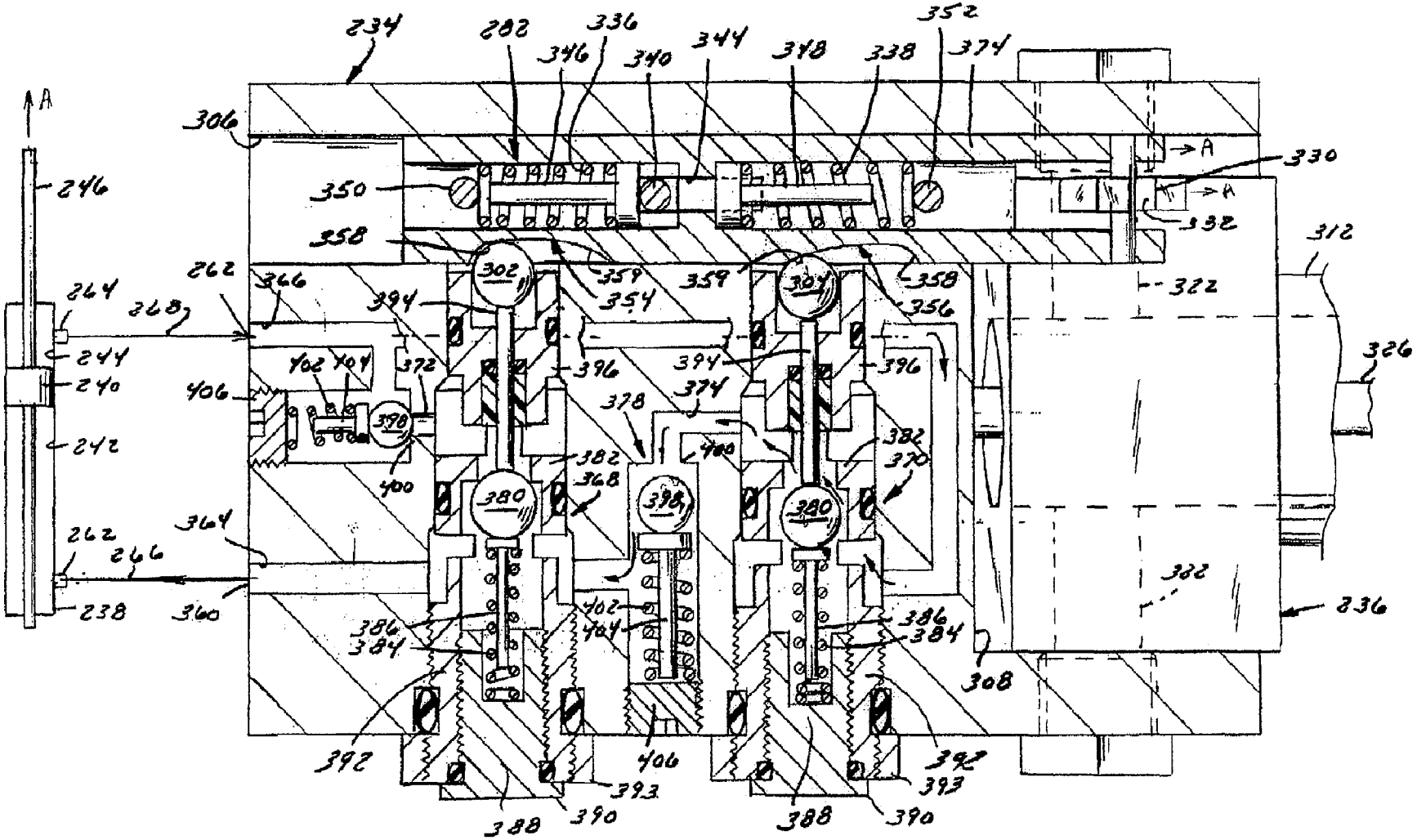
FIG. 14 corresponds to FIG. 11 but illustrates the steering system in an actuated position thereof.

Referring now to FIGS. 13 and 14, when the tiller actuator portion 236 is pivoted in a counterclockwise by pushing on the throttle grip 314, the cam body 334 moves to the right as viewed in the drawings so that the cam groove 356 forces the cam follower 304 downward to open control valve 370. Additional manual tiller actuation will move the engine 20 and cylinder piston 344 to direction A. Fluid in the chamber 244 of the cylinder 238 is then forced out of the port 264, through the line 268, past the control valve 370, into the bypass passage 374, past the low-pressure check valve 378, into line 266, and into the chamber 242 of the cylinder 238 through the port 262. If the operator wishes to steer the boat in the opposite direction, he or she pivots the throttle grip 314 in the opposite direction, hence driving the cam body 334 in the opposite direction, opening the control valve 368, and permitting fluid to flow from the chamber 242, through the control valve 368, the bypass passage 372, out of the port 362, and into the opposite chamber 244 via port 264. Here again, the operator does not have to release the grip. If the engine does not have an input to the system, the movement will stop when the operator input is stopped. If the engine has a torque input, this input will move the tiller arm to close the valves. In either case, if the operator releases the throttle grip 314, the relatively strong springs 336 and 338 will return the cam body 334 to its neutral position, closing all valves, recentering the tiller actuation portion 236, and locking the piston 240 from further motion to retain the last commanded steering angle.

Figure 15:
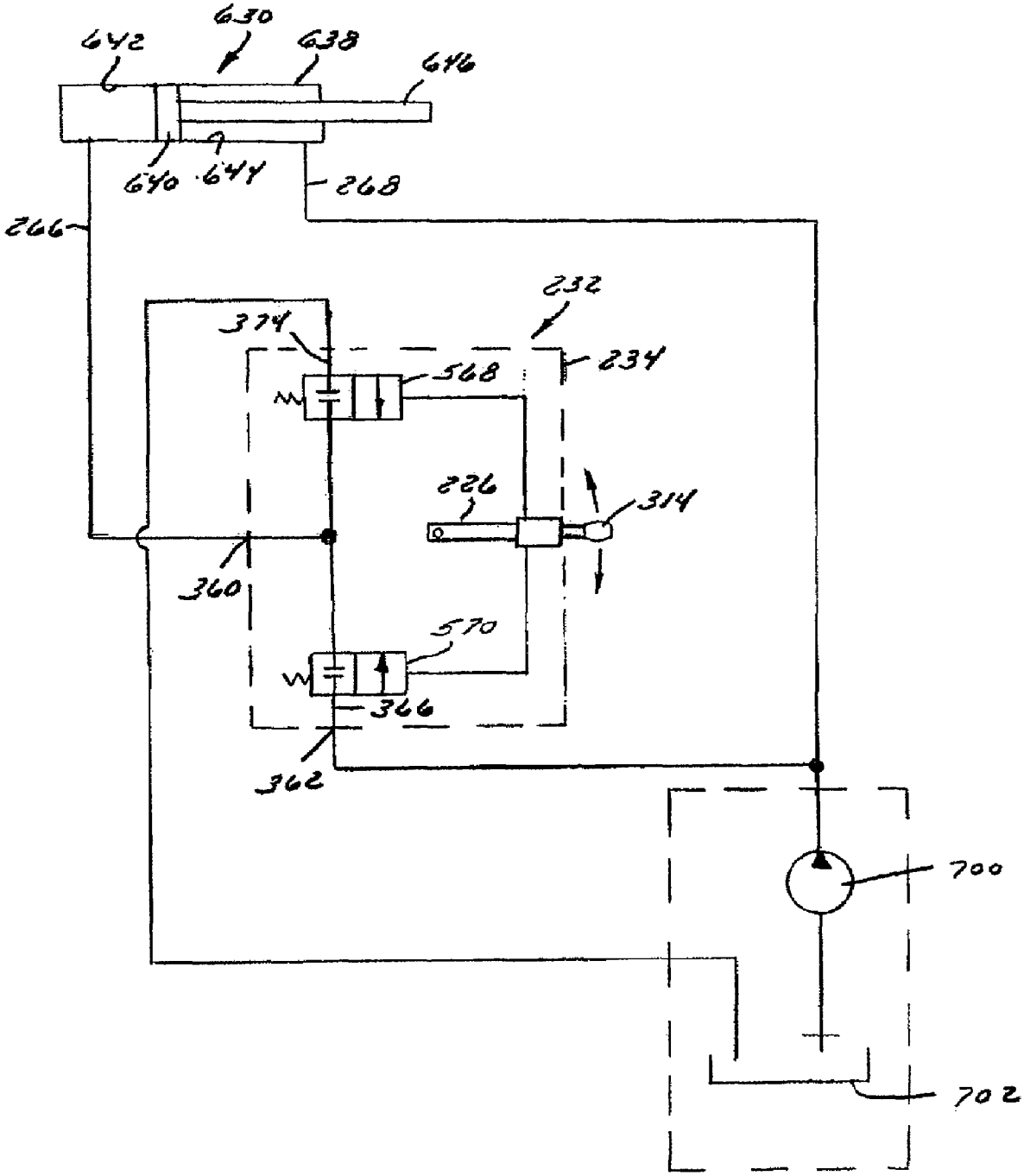
FIG. 15 is hydraulic circuit schematic illustrating the construction and operation of the hydraulic components of the steering system of FIGS. 8-11.

In addition to being easily incorporated into an existing tiller design or even mounted onto an existing tiller handle in a retrofit fashion, the steering assembly 210 of this embodiment provides the additional advantage of being easily reconfigured as a power assist steering system. Referring to FIG. 11, all that needs to be done is for the operator to open both plugs 406 in the valve body 234 and remove the check valves 376 and 378. Then, referring to FIG. 15, the line 268 that previously was connected to only the chamber 242 in the cylinder 238 will now be connected to the corresponding chamber 642 of an unbalanced cylinder 630 and to a power supply such as the outlet of a pump 700. Passage 374, which previously contained the check valve 378, would also be connected to a reservoir 702 at this time. The resulting power assist steering system would operate in the same manner as that disclosed in U.S. Pat. No. 6,715,438, issued Apr. 6, 2004, the subject matter of which is incorporated by reference.

4. Construction and Operation of Third Embodiment

Turning now to FIGS. 16-22B, a self-locking tiller actuated steering system 410 constructed in accordance with a third preferred embodiment of the invention is illustrated. The steering system 410 differs from those of the prior embodiments in that it is considerably simpler and less expensive to manufacture and assemble. It is also potentially more reliable. The most notable difference from a functional standpoint is that the control valves are actuated remotely by cables 490 and 492 rather than directly by the actuator on the tiller, hence permitting the valve assembly to be mounted on the cylinder assembly and providing a much simpler tiller extension.

Figure 16:
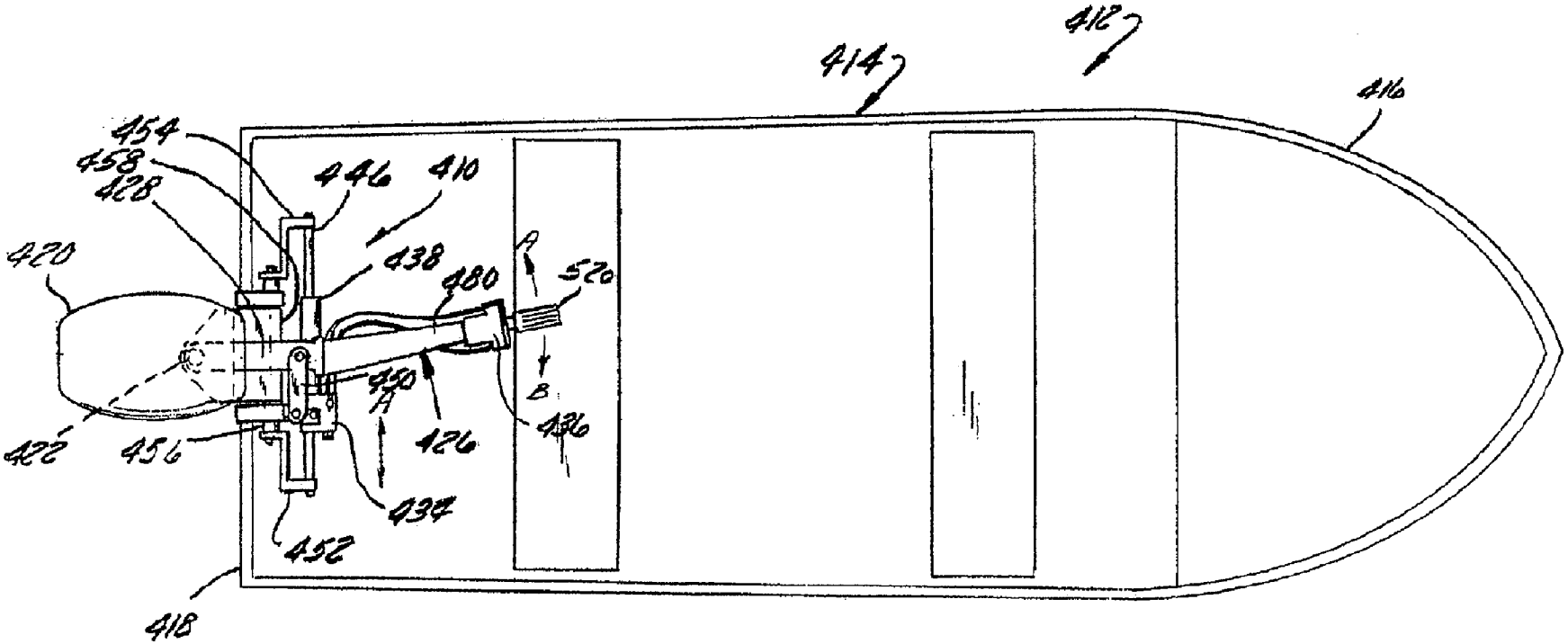
FIG. 16 is a schematic top plan view of a boat incorporating a self-locking tiller-operated steering system constructed in accordance with another preferred embodiment of the present invention.
Figure 18:
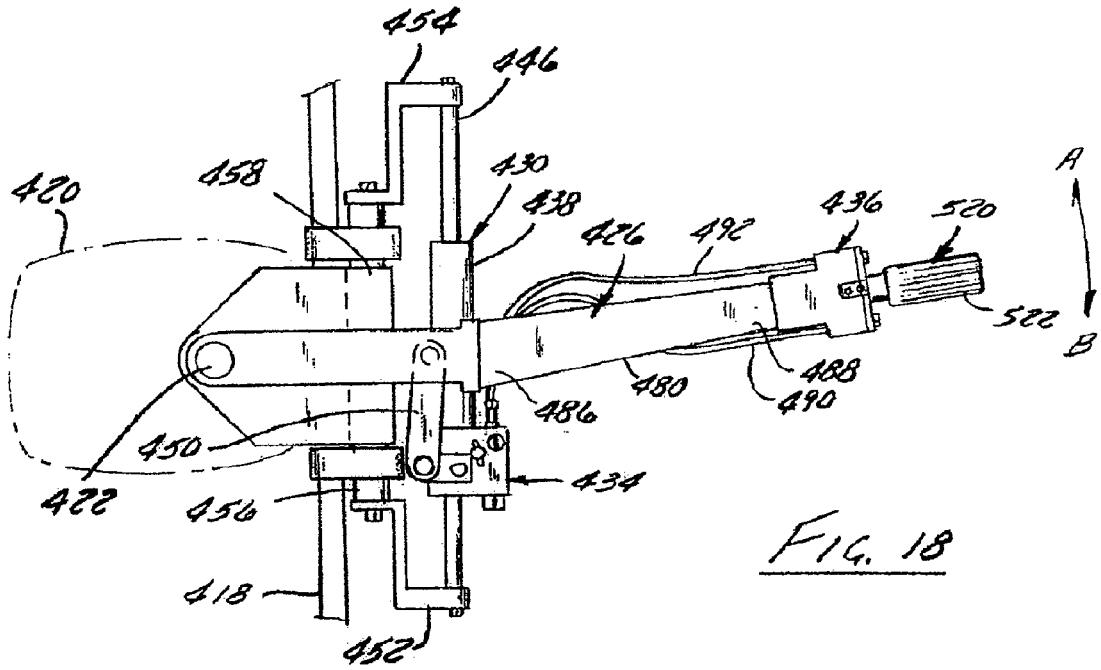
FIG. 18 is top plan view of the steering system of FIG. 17.
Figure 17:
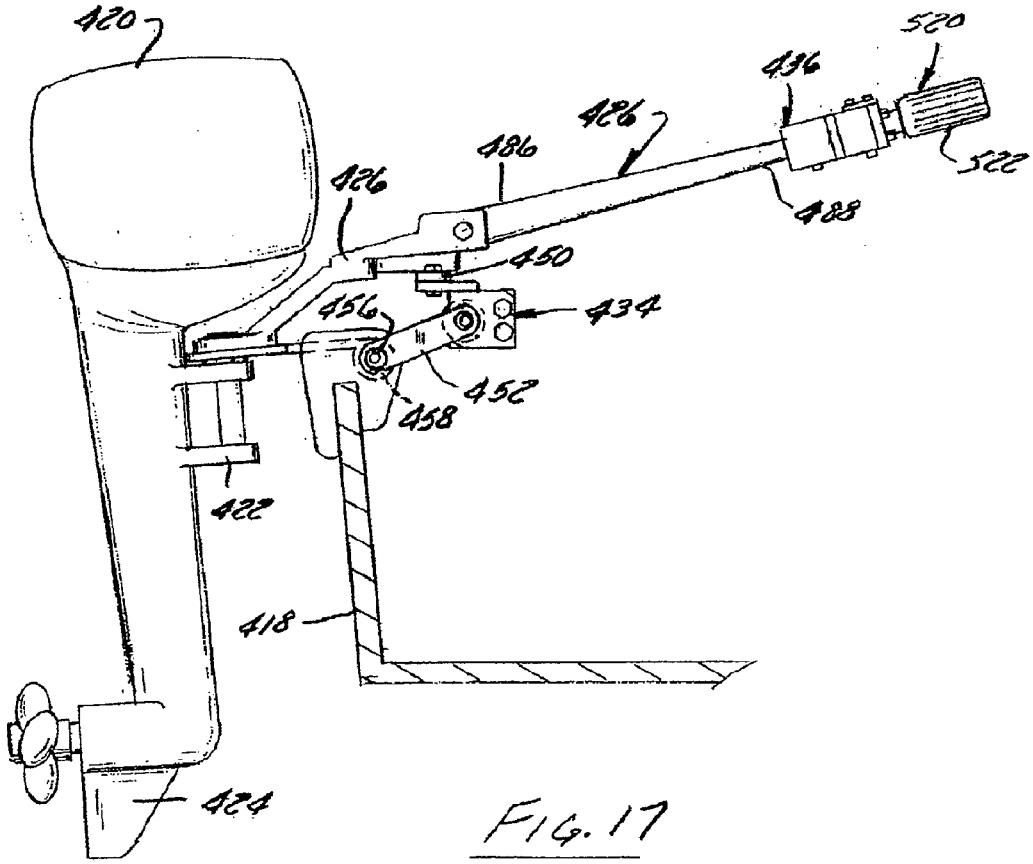
FIG. 17 is a side elevation view of the stern of the boat, showing the engine and steering system mounted on the stern.

Referring initially to FIGS. 16-18, the steering system 410 of this embodiment includes a tiller 426, a hydraulic lock in the form of a hydraulic cylinder assembly 430, and a valve assembly 432 that is housed in a valve unit 434 mounted on or even formed integrally with the cylinder assembly 430 to produce a module 435. The valve assembly 432 acts as an "engager" that is responsive to tiller operation to selectively engage and disengage the hydraulic lock by selectively permitting or preventing a movable portion of the cylinder assembly 430 from moving. More specifically, the valve assembly 432 is actuated in response to movement of an actuator portion 436 of the tiller 426 relative to another portion of tiller 426 from a neutral position thereof in order to permit fluid to flow within and to and from the cylinder assembly 430 to disengage the lock and permit movement of the portion of the tiller 426 that is coupled to the system's steering arm 428. The valve assembly 432 is deactuated when the input to the actuator portion 436 is stopped and the actuator portion 436 returns to its neutral position to prevent fluid from flowing to or from the cylinder assembly 430, hence engaging the hydraulic lock and preventing tiller movement. This prevents reaction forces imposed on or by the engine 420 from being transmitted to the tiller 426 and maintains the last commanded steering angle of the rudder 424. The hydraulic cylinder assembly 430, tiller 426, and valve assembly 432 will now be described in turn.

Figure 19:
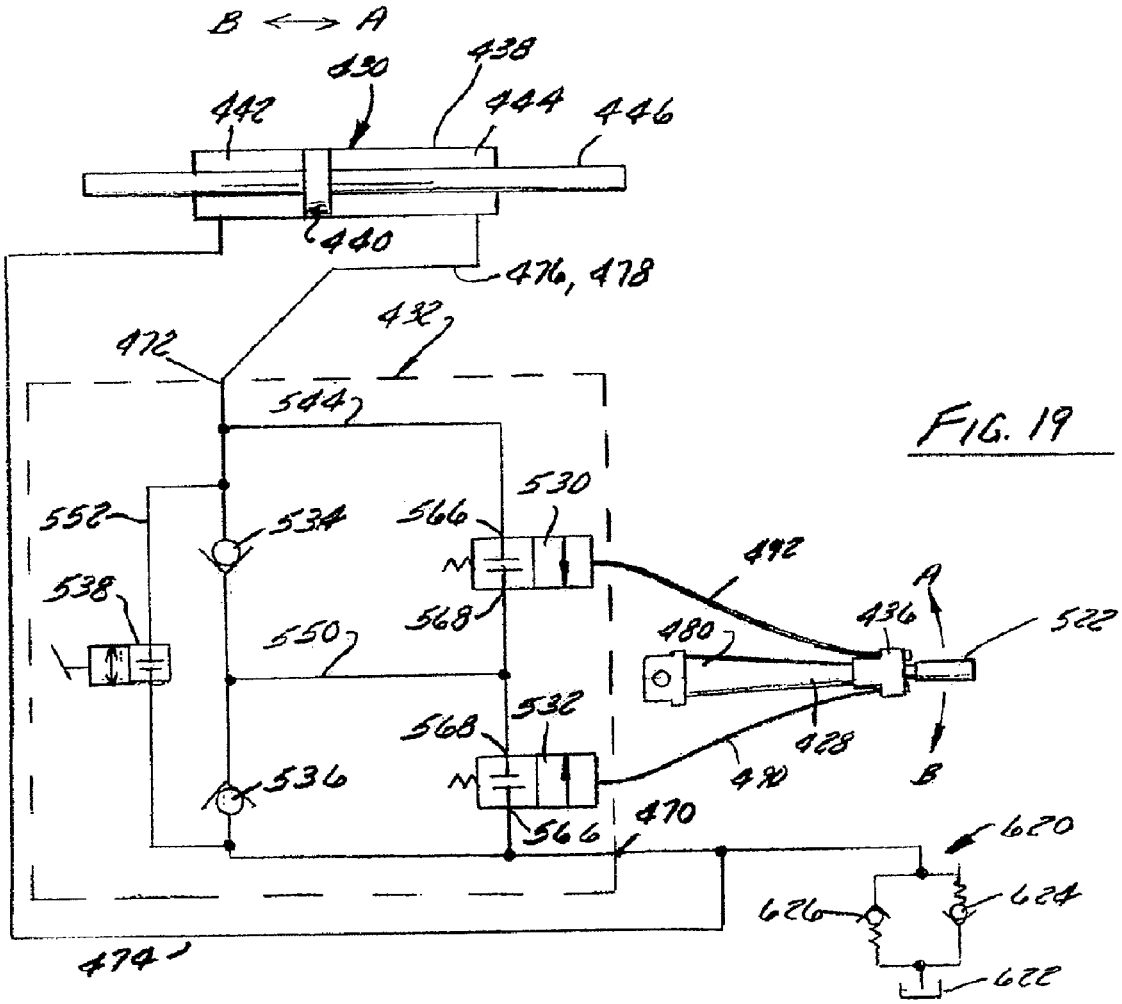
FIG. 19 is a circuit schematic illustrating the construction and operation of the operative components of the steering system of FIGS. 16-18.
Figure 20:
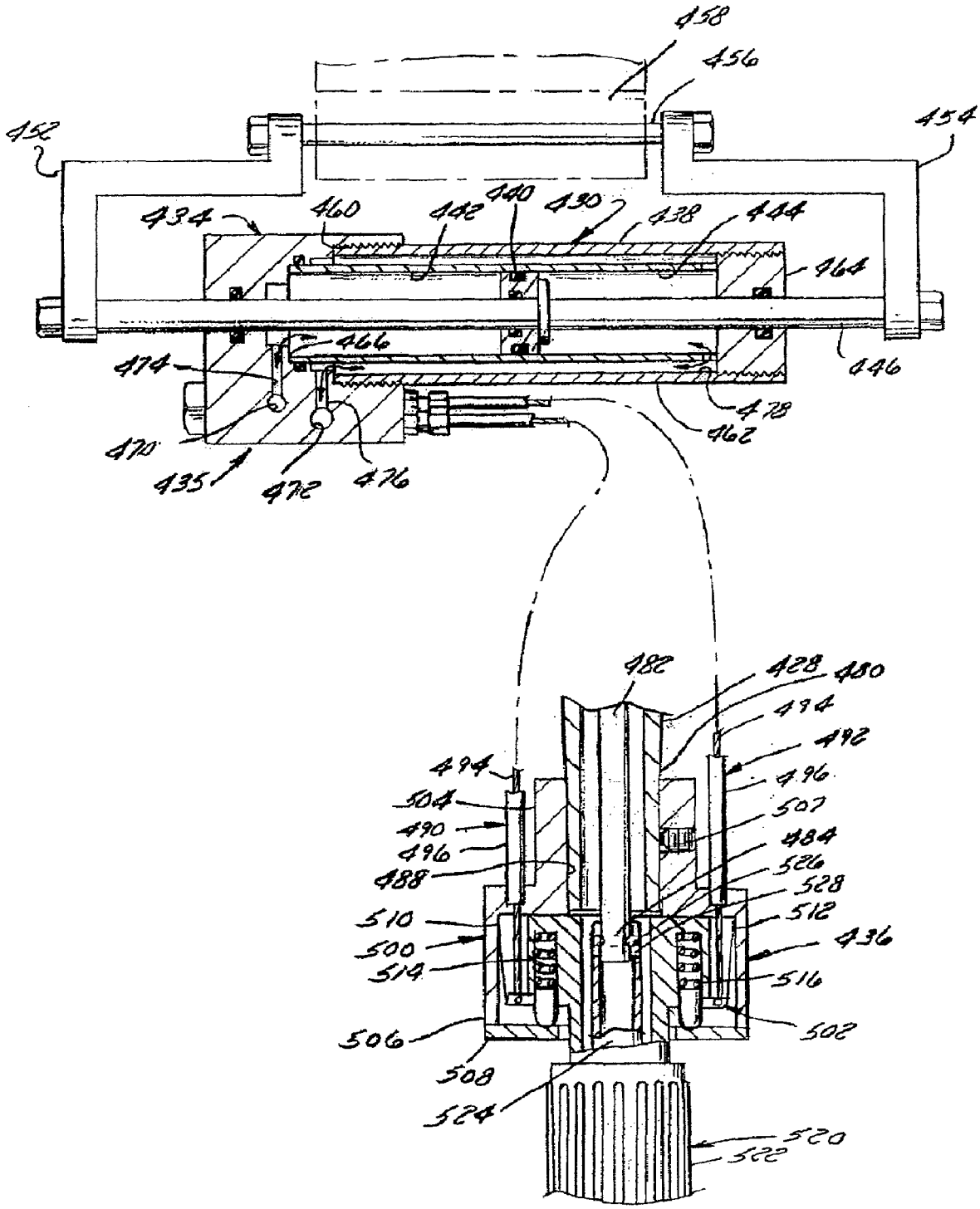
FIG. 20 is a sectional plan view of a portion of the steering system of FIGS. 2-4 that includes an actuator and cylinder of the steering system.

Referring now to the mechanical drawings of FIGS. 17-18 and 20 and to the hydraulic schematic of FIG. 19, the hydraulic cylinder assembly 430 includes a cylinder 438, a balanced piston 440 that is mounted in the cylinder 438 to define first and second chambers 442 and 444 on opposite sides thereof, and a rod 446 that is affixed to the piston 440 and that extends through both ends of the cylinder 438. Pursuant to this embodiment of the invention, one of the rod 446 and the cylinder 438 is movable relative to the other and is connected to the steering aim 428, and the other of the rod 446 of the cylinder 438 is mounted on a fixed support such as the transom 418 or on an intervening mounting assembly.

Referring to FIGS. 16-18, the cylinder 438 of this embodiment is coupled to the steering arm 428, and the rod 446 is mounted on the transom 418. Specifically, the cylinder 438 is coupled to the steering arm 428 by a link 450 so that the cylinder 438 moves back and forth with pivoting movement of steering arm 428. The rod 446 extends through opposite ends of the cylinder 438, where each end is supported on a first end of a respective mounting bracket 452, 454. The opposite end of each mounting bracket 452, 454 is connected to a respective end of a rod 456 that extends through a tilt tube 458 of the engine 420 as best seen in FIG. 20A. The rod 456 locks the brackets 452, 454 and the rod 446 to the engine mount so that they cannot move side to side relative to the engine mount or the transom 418.

As indicated above, the valve assembly 432 can be located remote from the tiller actuator portion 436. For instance, the valve unit 434 that houses the valve assembly 432 may be mounted on or even form part of the cylinder 438, hence forming a combined module 435. That is the case in the illustrated embodiment. As best seen in FIG. 20A, the valve unit 434 has a stepped internal bore 460 that is located beside the valve assembly 432 and that is internally threaded at one end. The majority of the cylinder 438 is formed from a cylinder body 462 that is closed at one end by a cap 464 and that is open at the other end 466. The threaded bore 460 in the valve unit 434 is screwed over the end 466 of the cylinder body 462 to form the end of the chamber 442.

The chambers 442 and 444 are fluidically coupled to respective ports 470 and 472 in the valve assembly 432 (FIGS. 22A and 22B) by internal passages in the module 435 (FIG. 20A), hence negating the need for hydraulic hoses. This, in turn, further reduces manufacturing costs and system complexity, and increases reliability by eliminating hoses and fittings that might rupture or leak. Specifically referring to FIGS. 20A and 22A, the port 470 in the valve assembly 432 opens into a passage 474 that extends perpendicularly to the end of the chamber 442. The port 472 opens into a passage 476 that extend perpendicular to another passage 478. The passage 478 extends axially along the cylinder body 462 in parallel with the chambers 442 and 444 and opens into the end of the chamber 444.

Tiller pivoting motion causes the steering arm 428 to swing in the direction of the arrow in FIG. 16, resulting in a corresponding axial movement of the cylinder 438 along the rod 446 in the same direction. This movement drives the cylinder 438 to move relative to the piston 440, forcing hydraulic fluid out of one of the chambers 442 or 444, through the open valve assembly 432, and into the other chamber 444 or 442. When the hydraulic lock is engaged to block fluid flow to and from the cylinder 438, the cylinder 438 cannot move relative to the piston 440 and rod 446, hence locking the cylinder 438 in place and thereby locking the steering arm 428 and the tiller 426 in place. The last commanded steering angle of the rudder 424 is thus maintained.

Referring to FIGS. 17, 18, 20, and 21, the front end of the tiller 426 includes a hollow arm 480 and a throttle shaft 482. The throttle shaft 482 extends through the hollow interior of the arm 480. It has a proximal, rear end (not shown) borne in the hub of a throttle cable drive pulley (not shown). It also has a distal front end 484 that is attached to the tiller actuator portion 436 as described below. The tiller arm 480 extends from a rear, proximal end 486 affixed to the steering arm 428 to a front end 488. The front end 488 supports the tiller actuator portion 436.

The actuator portion 436 of the tiller 426 comprises an articulating front end portion of the tiller 426 that is mounted on the front end of the tiller arm 480 so that a portion thereof is pivotable through a limited stroke relative to the tiller arm 480. In this embodiment, the pivoting motion of the actuator portion 436 from a neutral position extends or retracts cables 490, 492 to actuate the valve assembly. As is conventional, each cable 490, 492 includes an inner core 494 covered by an outer sleeve 496 as seen in FIG. 20A.

Figure 21:
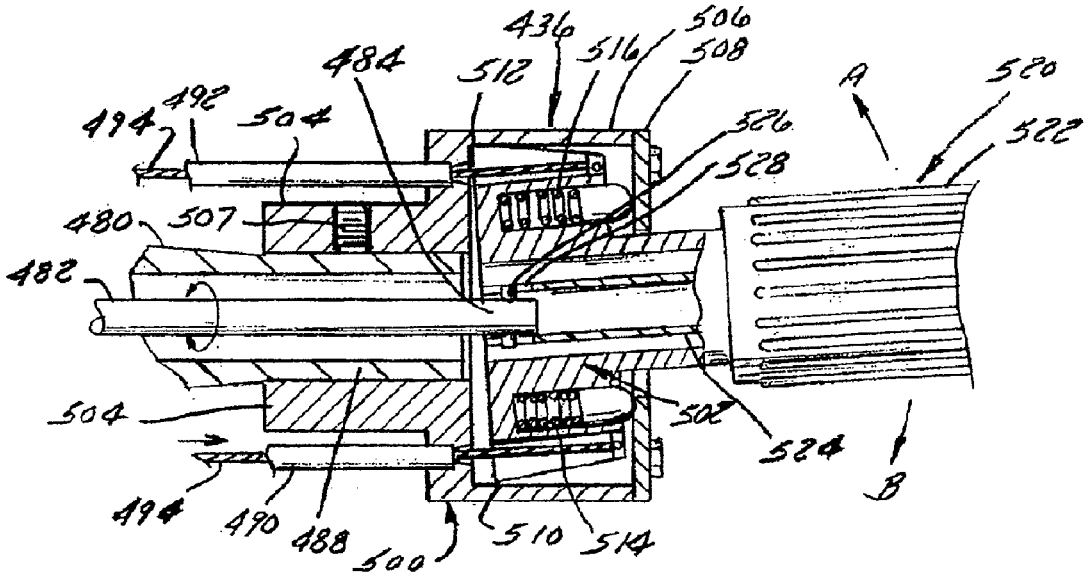
FIG. 21A is a side elevation view showing a thermal compensator incorporated into a hydraulic cylinder assembly.
FIG. 21B is an end elevation view showing a variant of the thermal compensator of FIG. 21A.
FIG. 21C is a sectional plan view of the thermal compensator of FIG. 21A, taken at lines 21C-21C.
FIG. 21D is a sectional plan view of a variant of the thermal compensator of FIG. 21C.

Referring now to FIGS. 20A and 21, the tiller actuator portion 436 includes an actuator housing 500 and an actuator block 502 that is pivotally mounted in the actuator housing 500. The actuator housing 500 has a reduced diameter rear end 504 that surrounds the front end 488 of the tiller arm 480 and an enlarged diameter front end 506 that extends beyond the front end 488 of the tiller arm 480. The actuator housing 500 is mounted on the front end 488 of the tiller arm 480 by a set screw 507. A cover plate 508 is mounted on the front end 506 of the actuator housing 500. The actuator block 502 comprises a metal block supported in the actuator housing 500 so as to rock about points 510, 512 located at the outer lateral edges of the actuator block 502. The ability to rock about points 510, 512 as opposed to pivoting about the center of the actuator block 502 provides a greater range of motion before the front end of the block 502 abuts against the cover plate 508. Pivoting the handle at points 512 and 510 provides maximum movement of the cables 490 and 492 for a given throttle grip stroke and a given actuator block width. If the handle would pivot along its center like the system in the second embodiment, the grip 522 would have to be moved twice as far to obtain the same cable extension. The actuator block 502 is biased to its central or neutral position by first and second return springs 514, 516 that acts against the cover plate 508. One end of the movable inner core 494 of each cable 490, 492 is affixed to the actuator block 502 outboard of the return springs 514, 516. The opposite end of each inner core is connected to the valve actuator rod for the associated control valve as detailed below.

Referring to FIGS. 20A and 21, the actuator portion 436 of tiller 426 further includes a throttle grip assembly 520. The throttle grip assembly 520 comprises a throttle grip 522 mounted on an extension of the actuator block 502 extending forwardly through an aperture in the cover plate 508. A throttle shaft mounting tube 524 extends rearwardly through an enlarged bore in the actuator block 502 and is mounted over the front end of the throttle shaft 482. The throttle shaft mounting tube 524 is coupled to the throttle shaft 482 by a pin 526 that extends radially through the throttle shaft and through opposed slots 528 in the mounting tube 524, thereby permitting the mounting tube 524 and the actuator block 502 to rock relative to the throttle shaft 482 while causing the throttle shaft 482 to rotate when the throttle grip 522 is twisted.

Figure 22A:
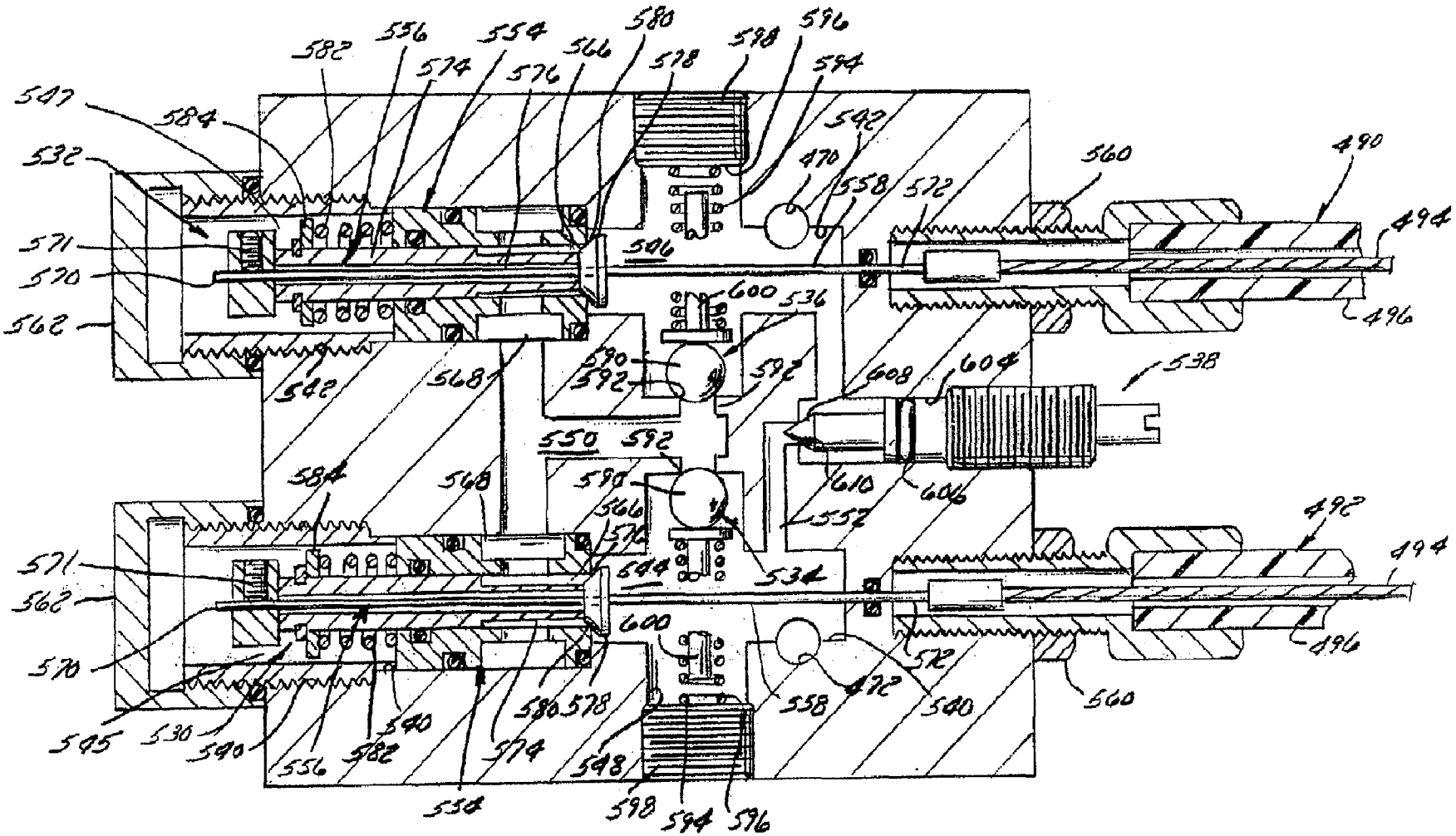
FIG. 22A is a sectional plan view of the valve assembly of the steering system of FIGS. 16-18 in a closed or system locked position thereof.

Referring now to FIGS. 19 and 22A, the valve assembly 432 comprises first and second cable operated control valves 530, 532, first and second normally closed pressure operated check valves 534, 536, and a manual bypass valve 538, all located in the valve unit 434. First and second longitudinal through bores 540, 542 are formed in the valve unit 434 to house the control valves 530 and 532 and their cable actuators. Intermediate sections of the bores 540, 542 form chambers 544, 546 connecting the ports 472, 470 to the valves 530, 534 and 532, 536. A lateral through bore 548 in the valve unit 434 contains the check valves 534, 536. Also formed in the valve unit 434 are 1) a T-shaped internal passage 550 connecting the outlets of the control valves 530 and 532 to the lateral through bore 548 and the inlets of the spring biased check valves 534, 536 and 2) a bypass passage 552 containing the manual bypass valve 538.

The first and second control valves 530, 532 and their actuators are identical in construction. The control valve 532 will now be described, it being understood that the description applies equally to the control valve 530. Control valve 532 includes a stationary valve body 554, a movable valve element 556, and a movable actuating rod 558. The actuating rod 558 is driven by the aforementioned cable 490, the end of the inner core 494 of which is located in a fitting 560 threaded into the proximal end of the bore 542. The valve body 554 is captured in the bore 540 by a threaded cap 562 that also seals the distal end of the bore 540. The valve body 554 has an axial through bore 564, the proximal end of which is enlarged to present a chamber having an axial inlet port 566 and a radial outlet port 568.

The actuating rod 558 extends longitudinally from a distal end 570 located behind the valve body 554, through the valve body 554, and the chamber 544, and to a proximal end 572 located in front of the chamber 544, where it is connected to the end of the inner core 494 of the associated cable 490. The valve element 556 is mounted on the distal end 570 of the actuating rod 558 by a set screw 571. Valve element 556 comprises a cylinder 574 that is slidably guided by the valve body 554 and that has a through bore 576 receiving the actuating rod 558. A conical check 578 is formed on the proximal end of the valve element 556 and is sealingly mounted on the actuating rod 558 so as to move therewith.

The check 578 is biased against a seat 580 on the valve body 554 by a spring 582. The spring 582 is seated against the valve body 554 at its proximal end and against a fixed keeper 584 on the cylinder 574 at its distal end.

Figure 22B:
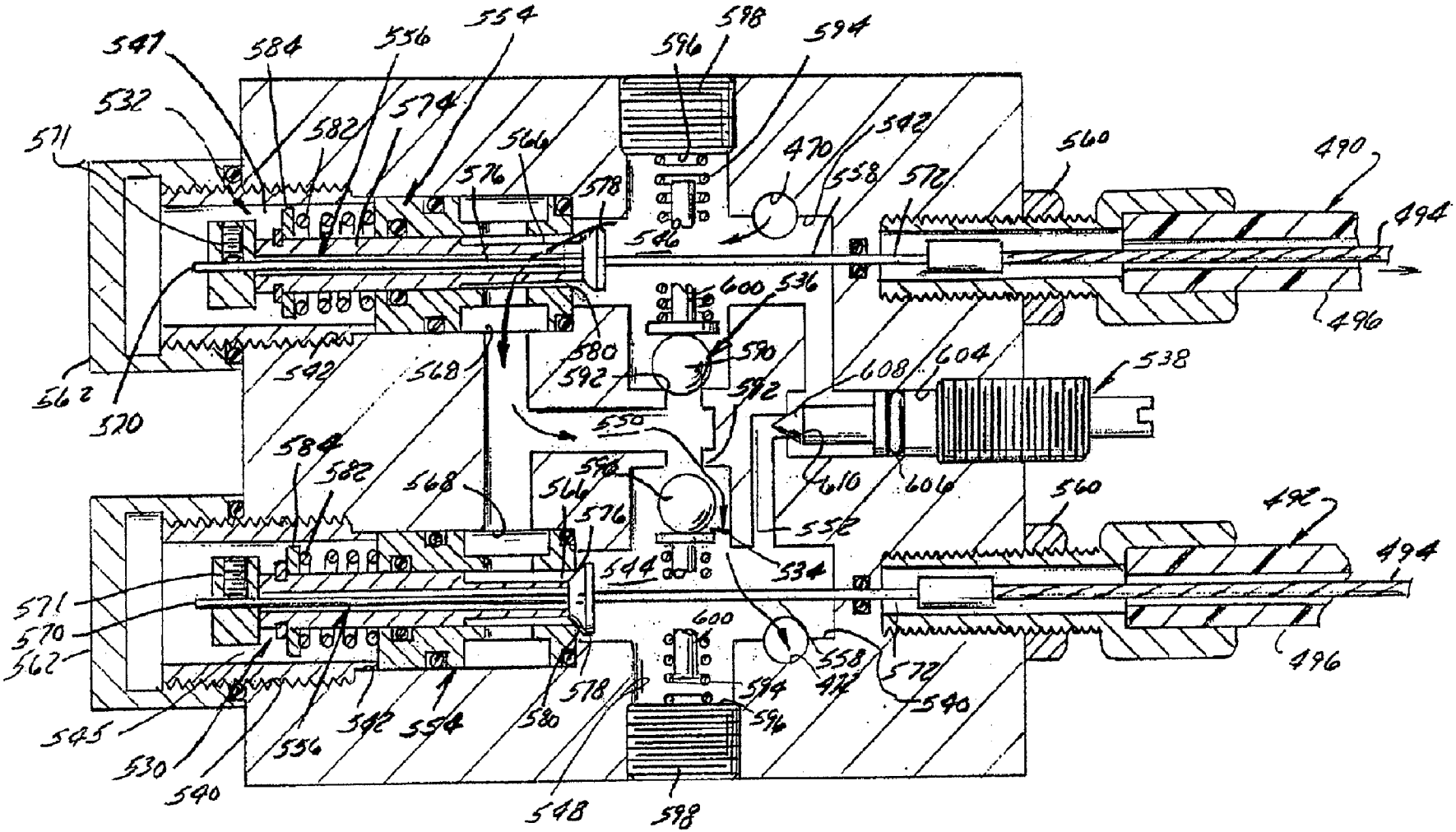
FIG. 22B corresponds to FIG. 22A and shows the valve actuator in an open or system unlocked position thereof.

The control valves 530 and 532 each normally assumes the position illustrated in FIG. 22A in which the check 578 seats against the seat 580 to seal the ports 566 and 568 of the relevant control valve 530 or 532 from one another in the absence of a tiller actuation. When the operator pivots the tiller 426 in a manner to pull the cable inner core 494 proximally away from the valve unit 434, the appropriate actuating rod 558 is pulled to the right as seen in FIG. 22B to connect the inlet port 566 to the outlet port 568.

The check valves 534 and 536 are also identical to one another in construction. The valve 534 will now be described, it being understood that the description applies equally to the valve 536. The valve 534 includes a check ball 590 located adjacent a seat 592 in bore 548. The check ball 590 is biased against the seat 592 by a relatively weak return spring 594 that seats against the check ball 590 at one end and against a spring seat 596 at its rear end. The spring seat 596 is formed from a cap 598 that is threaded into the bore 548 to seal the bore. The spring 594 is also guided by a guide rod 600 extending from the check ball 590 toward the seat 596.

The bypass valve 538 comprises a threaded rod screwed into an externally threaded bore 604 in the valve unit 434. The rod is sealed in the bore 604 by an O-ring 606. It includes a conical tip 608 acting as a poppit that that engages a seat 610 formed in the bypass passage 552 when the rod is threaded all the way into the bore 604. The bypass valve 538 can be opened, using a screwdriver or the like, by unscrewing the rod from the valve unit 434 until the tip 608 separates from the seat 610 to open the bypass passage 552, hence bypassing the control valves 530 and 532 and permitting free flow through the valve assembly 532 at all times.

The system as thus far described is sensitive to fluid expansion and retraction resulting from temperature changes. If the cylinder 438 is filled with fluid at 70° F. with no air in the system, the pressure in the cylinder 438 becomes higher than the working pressure of the seals at 120° F. At 20° F., the fluid contracts to the point that the pressure in the cylinder 438 is below 0 psi. This contraction forms a void in the cylinder 438 and allows the cylinder to move back and forth without fluid flow. The cylinder 438 thus becomes loose and acts as if there is air in the system.

Figure 21B:
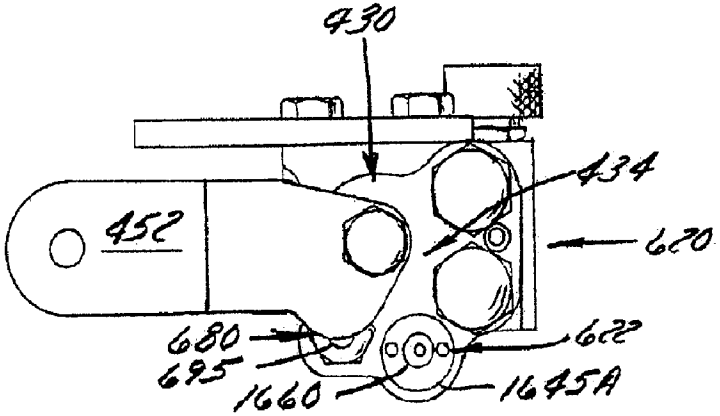
Figure 21A:
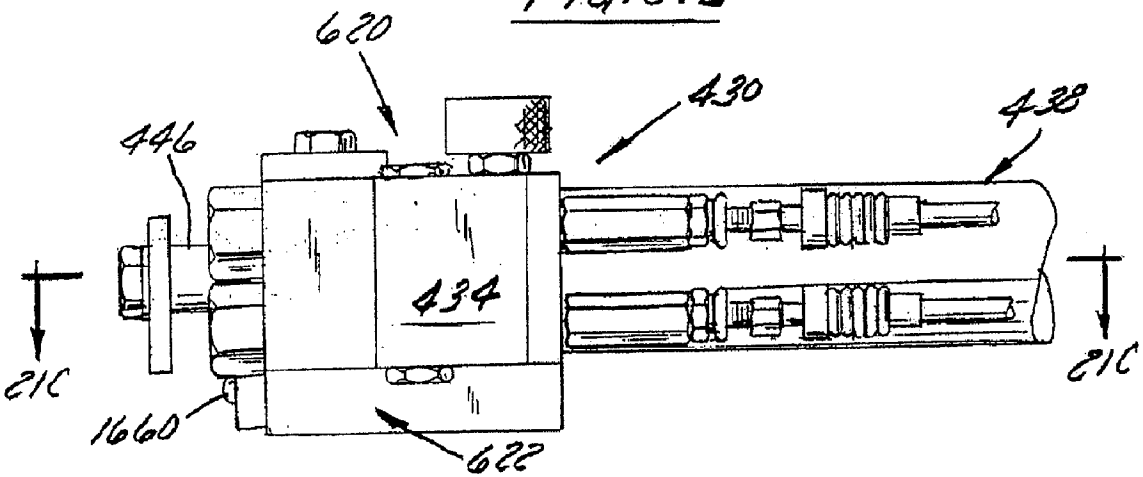

Referring now to FIGS. 19, 21A, and 21B, this problem can be avoided by providing a thermal compensator 620, preferably within or proximate module 435 or hydraulic cylinder assembly 430. Referring again specifically to FIG. 19, as one example, the thermal compensator 620 can be provided in, e.g., passage 474 to accommodate thermal expansion and contraction of the fluid. Optionally, the thermal compensator 620 could be provided in the passage 476 with the same results. Furthermore, thermal compensator 620 cooperates with the valve assembly 432 (FIGS. 19 and 21C) to provide thermal compensating capability to the hydraulic lock. In other words, valve assembly 432 and thermal compensator 620 can be provided in the same hydraulic circuit such that the integrity of the hydraulic lock functionality provided by, e.g., valve assembly 432 and/or other components is maintained while accommodating thermal expansion and contraction of the fluid. Accordingly, the thermal compensator 620 suitably maintains and ensures consistent operating characteristics and user feel despite variations in fluid temperature.

Figure 21C:
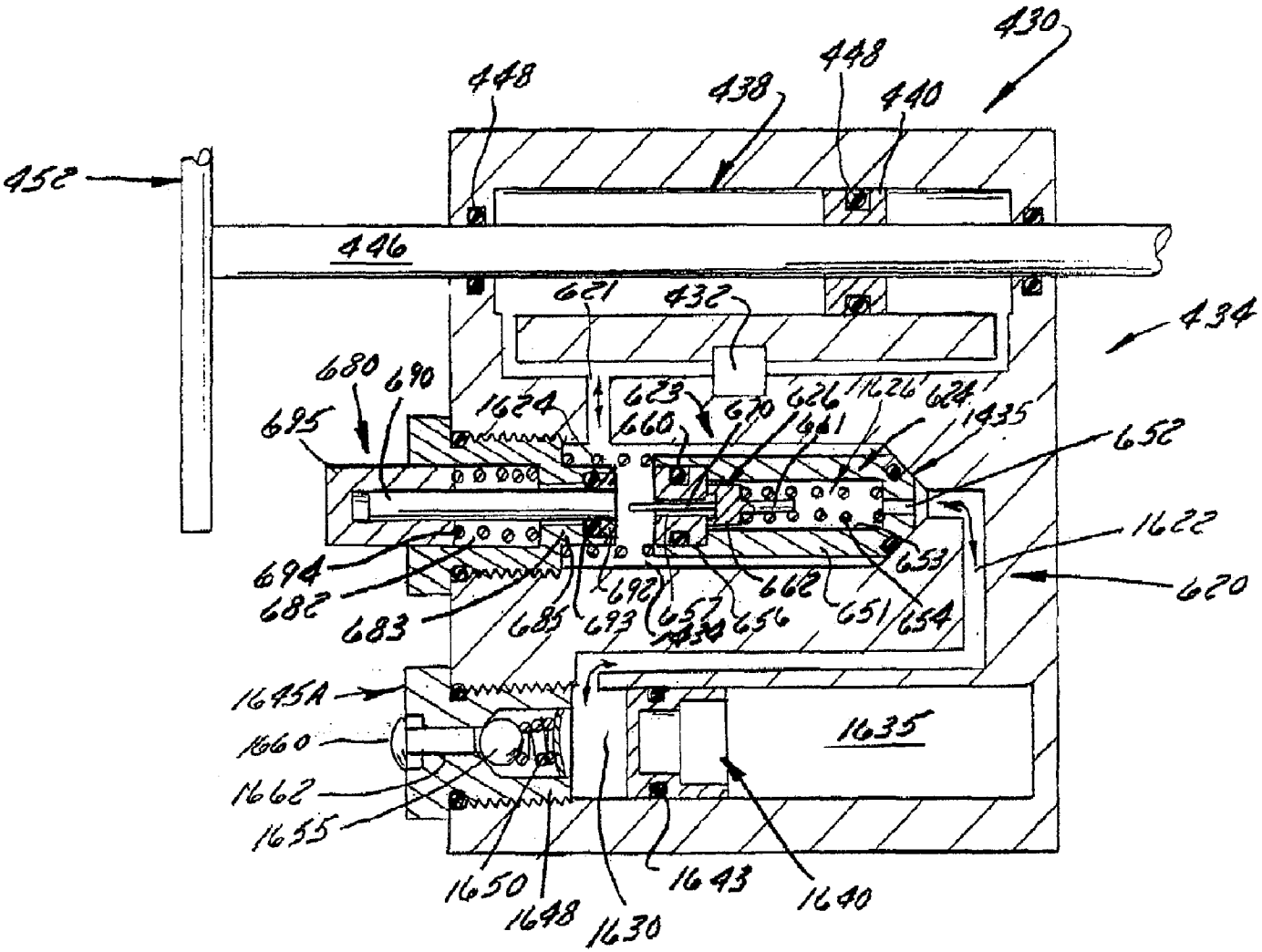
Figure 27D:
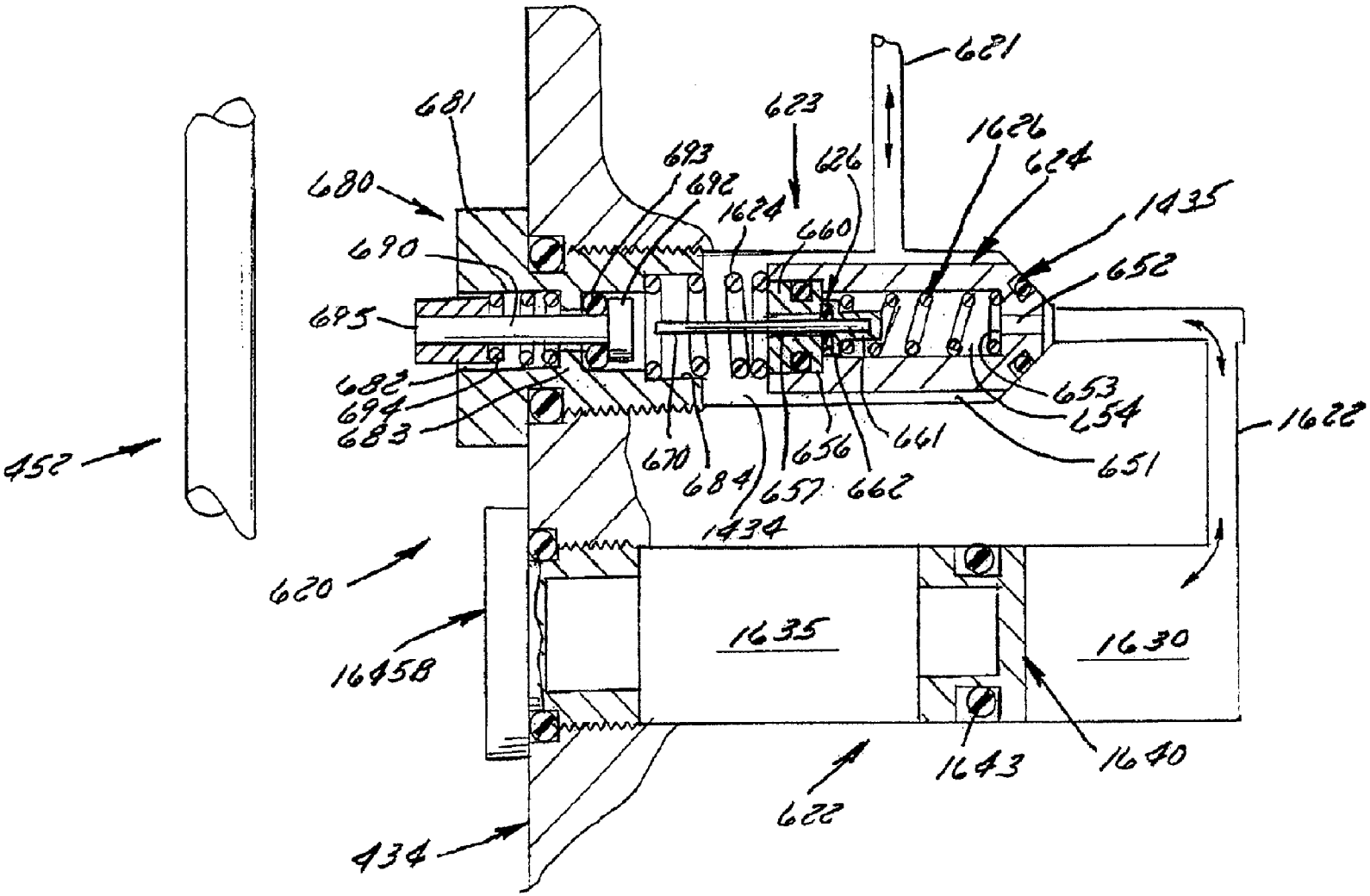
FIG. 27 is a sectional plan view through the center of the actuation system of FIGS. 24-26.

Referring now to FIGS. 19, 21C, and 21D, the thermal compensator 620 is formed from a reservoir 622, a low pressure check valve 624, and a high pressure relief valve 626. The check valve 624 operates at less than 5 psi to permit make-up fluid to flow into the cylinder 438 from the reservoir 622. The relief valve is 626 is set at a pressure just above the maximum operating pressure of the system. Accordingly, if the fluid temperature increases to an extend that causes the fluid pressure to rise above the opening pressure of relief valve 626, the relief valve 626 opens and fluid flows from the cylinder 438 into the reservoir 622. If the fluid temperature and pressure sufficiently decreases, fluid is drawn back into the system, into cylinder 438, through the check valve 624. The cylinder 438 therefore remains suitably full of fluid at all times and has no free movement, and without exhibiting non-desired characteristics associated with an over pressurized hydraulic system.

Referring now specifically to FIGS. 21C and 21D the check valve 624 and relief valve 626 may be combined into a single unitized structure which has manual pressure release functionality, namely, compensating valve assembly 623. Such embodiments can also include passage 621 that fluidly connects the compensating valve assembly 623 to cylinder 438. For example, passage 621 can be connected to or within passage 474, passage 476, optionally at other suitable locations or otherwise connected to cylinder 438.

Still referring to FIGS. 21C and 21D, reservoir 622 includes a fluid compartment 1630 and a gas compartment 1635 that are separated from each other by a movable reservoir piston 1640. Fluid compartment 1630 and gas compartment 1635 are longitudinally aligned with each other to collectively define the reservoir 622 within a void space of the valve unit 434. The relative volumes of the fluid and gas compartments 1630 and 1635 are generally inversely proportional to each other, and change dynamically in response to operating conditions such as fluid temperature, fluid pressure, and fluid volume of the steering system 10. The gas contained within gas compartment 1635 is a compressible and expandable fluid, such as air, whereby the volume of gas compartment 1635 increases or decreases as a function of the volume of fluid compartment 1630. In this regard, volume variability of gas compartment 1635 accommodates the changing volume of the fluid within fluid compartment 1630 that occurs as a result of heating or cooling the fluid.

Reservoir piston 1640 is adapted and configured to axially advance and regress within the reservoir 622, namely, between the fluid and gas compartments 1630, 1635, respectively. The reservoir piston 1640 has a sidewall with a circumferential groove that houses a seal 1643 which facilitates maintaining the fluid and gas compartments 1630, 1635 as fluidly distinct bodies. In other words, seal 1643 prevents air leakage from the gas compartment 1635 into the fluid compartment 1630, and vice versa. This maintains the integrity of a generally non-compressible fluid in the fluid compartment 1630 and a generally compressible fluid in the gas compartment 1635.

The reservoir 622 can be sealed at an end with a reservoir endcap 1645A (FIG. 21C), 1645B (FIG. 21D). Preferably, the reservoir endcap 1645A, 1645B is readily accessible in the complete assemblage of steering system 10. Accessibility of reservoir endcap 1645A, 1645B facilitates filling, recharging, or replenishing the fluid and gas compartments 1630, 1635 or otherwise servicing or maintaining the reservoir 622.

If, as seen in FIG. 21C, the endcap 1645A provides access to the fluid compartment 1630, it is configured to enable a user to fill or replenish lost fluid into the fluid compartment 1630 without introducing air into the sealed assembly. For example, the endcap 1645 can include an end 1648 that inserts into to the fluid compartment 1630 and holds an end of a spring 1650. Spring 1650 pushes against the end 1648 and biases a check ball 1655 into a seat, whereby the spring 1650 and check ball 1655 in combination seal the reservoir 622 contents from the ambient. Plug 1660 is installed in a bore 1662 that opens toward the outwardly facing surface of the check ball 1655. In this configuration, plug 1660 can be removed and fluid can be introduced through the bore 1662 with a pressure that is sufficiently great to overcome the biasing force provided by spring 1650. Correspondingly, when using endcap 1654A, at no time during filling or replenishing activities are the contents of fluid compartment 1630 exposed to anything other than the volume of replenishing fluid.

Referring now to an alternative configuration shown in FIG. 21D, endcap 1645B can provide access to the gas compartment 1635, instead of the fluid compartment 1630 as with endcap 1645A (FIG.C21C). In other words, in such implementations, endcap 1645B extends into and seals the end of gas compartment 1635. Endcap 1645 can be installed to provide the gas compartment 1635 with a resting state, default pressure of 0 psi, or optionally, other pressures, as desired.

Referring again to FIGS. 21C and 21D, compensating valve assembly 623 controls fluid flow between passage 621 and reservoir 622. Under some operating conditions, the compensating valve assembly 623 permits a volume of fluid to flow from cylinder 438 through passage 621 and into reservoir 622. Furthermore, under other operation conditions, explained in greater detail elsewhere herein, the compensating valve assembly 623 permits a volume of fluid to flow from reservoir 622 through passage 621 and into cylinder 438.

Still referring to FIGS. 21C and 21D, a bore, namely, valve housing 1434, extends into valve unit 434 and houses compensating valve assembly 623. Compensating valve assembly 623 includes check valve 624, relief valve 626, and plunger assembly 680. Check valve 624 seats against a tapered seat 1435 on the valve housing 1434. The valve seat 1435 is connected, at its end, to a passage 1622 that fluidly connects it to reservoir 622.

Check valve 624 includes a generally cylindrical check valve body 651 that has a conically tapering end. The conically tapering end of check valve body 651 sealingly seats against the check valve seat 1435, and further includes a circumferential groove for housing a seal. Check valve spring 1624 is a compression spring that pushes against an end surface of the check valve body 651, opposite the conically tapering end. In this configuration, check valve spring 1624 biases check valve body 651 against the check valve seat 1435 such that the check valve 624 is fully seated when in a default, resting condition.

Continuing to refer to FIGS. 21C and 21D, check valve body 651 is generally hollow so that it defines two distinct fluid flow paths during use, the first fluid flow path extends around the outer surfaces of the check valve body 651 and the second fluid flow path extends axially through the check valve body 651. The hollow portion of check valve body 651 includes multiple distinct bore segments, namely, leading end bore 652, medial bore 654, and trailing end bore 656.

Leading end bore 652 extends axially through the end of check valve body 651. In this configuration, when check valve body 651 is fully seated into check valve seat 1435, leading end bore 652 is aligned and registered with passage 1622 that is connected to reservoir 622. Medial bore 654 is a counter bore having a greater diameter than leading end bore 652, and extending axially away from it, such that a shoulder 653 is defined between the leading end and medial bores 652, 654. Trailing end bore 656 is a counterbore having a greater diameter than that of the medial bore 654, and extending axially away from it, such that a shoulder 655 is defined between the medial and trailing end bores 654, 656.

Still referring to FIGS. 21C and 21D, relief valve 626 can be at least partially incorporated into check valve 624, and includes relief valve plug 660, relief valve body 661, relief valve pin 670, and relief valve spring 1626. The relief valve plug 660 is housed within the trailing end bore 656 of check valve body 651 abutting shoulder 655. An outer circumferential surface of plug 660 includes a groove or channel for housing a seal. A throughbore or plug bore 657 extends axially through the plug 660. Plug bore 657 defines a fluid passageway between the void space within valve housing 1434 and the void space within check valve body 651.

Relief valve body 661 is generally cylindrical with a radially extending flange 662 at one end. It is housed concentrically and entirely in the void space within check valve body 651, namely, in medial bore 654. A first end surface of flange 662 interfaces with, and seats against a corresponding end surface of relief valve plug 660. As desired, this first end surface of flange 662 can further include, e.g., a polymeric, elastomeric, or other suitable seal. A second, opposing end surface of flange 662 provides a shoulder against which a relief valve spring 1626 pushes. Relief valve spring 1626 is a compression spring that is housed within medial bore 654, whereby it is retained between shoulder 653 of check valve body 651 and flange 662 of relief valve body 661. Accordingly, in a default resting state, relief valve spring 1626 biases the relief valve body 661 against relief valve plug 660, hence urging the relief valve 626 closed.

Referring still to FIGS. 21C and 21D, relief valve pin 670 extends axially from the first end surface of flange 662, through the flange 662, and is concentrically anchored within the relief valve body 661. The relief valve pin 670 extends axially through the middle and along a major portion of the length of check valve spring 1624, whereby the end portion of relief valve pin 670 can communicate with plunger assembly 680.

Plunger assembly 680 provides a user interface for manually releasing or relieving non-desired accumulated fluid pressure from steering system 10. It includes plunger housing 681, plunger body 690, plunger spring 694, and plunger button 695.

Plunger housing 681 is a generally cylindrical plug that inserts into and seals the valve housing 1434. A bore 682 extends through the length of the plunger housing and defines an inner circumferential surface thereof. Bore 682 opens into a counterbore 684 which extends through the remainder of the length of the plunger housing 681. Shoulder 685 is defined between the bore 682 and counterbore 684. It functions as a retaining structure that holds the end of check valve spring 1624 opposite the check valve 624.

An annular rib or plunger guide 683 extends radially inward from the inner circumferential surface of plunger housing 681 to separate the bore 682 into two axially spaced segments. Plunger body 690 has an elongate cylindrical portion that extends through and is slidingly housed within the plunger guide 683. A plunger head 692 extends radially from the end of plunger body 690 that is adjacent relief valve pin 670. A seal 693 is provided between plunger guide and head 683, 692 and around the plunger body 690. Seal 693 maintains a fluid separation between the segments of bore 682 that are on opposing sides of the plunger guide 683. An outside diameter of plunger head 692 is smaller than an inside diameter of check valve spring 1624, and they are coaxially aligned so that plunger head 692 can freely axially advance into and regress out from the check valve spring 1624. Furthermore, an outside diameter of plunger body 690 is smaller than an inside diameter of a plunger spring 694 which is concentrically housed around it.

Plunger button 695 is fixed to an end of the plunger body 690 so that they travel together in unison. There is a narrow clearance between the plunger button 695 and the inner circumferential surface of plunger housing 681, whereby the plunger slides freely within the housing whilst also mechanically retaining an end of the plunger spring 694. The other end of plunger spring 694 is held against fixed plunger guide 683. Hence, if the plunger button 695 is depressed and then released the plunger spring 694 biases plunger button 695 back to its neutral, resting position as seen in FIG. 21C.

During use, referring still to FIGS. 21C and 21D, the compensating valve assembly 623, in combination with reservoir 622 and plunger assembly 680, is able to accommodate accessibly high or low pressure and/or temperature conditions within hydraulic cylinder assembly 430. In so doing, the thermal compensator 620 has both self-regulating and at least some manual override functionality. The thermal compensator 620 maintains consistent operating characteristics and user feel despite variations in fluid temperature and corresponding variations in fluid pressure by (i) accumulating excess fluid from, or (ii) providing supplemental fluid to, hydraulic cylinder 438 during excessively high and low temperature or pressure conditions, respectively. Namely, the reservoir 622 functions as a sump so that, when the hydraulic cylinder 438 requires additional fluid, the reservoir piston 1640 moves to the left (FIG. 22C), displacing supplemental fluid into the hydraulic cylinder 438. Conversely, when the hydraulic cylinder 438 has excess fluid, the reservoir piston 1640 moves to the right (FIG. 22C), receiving and accommodating the excess fluid from the hydraulic cylinder 438 into the reservoir 622. Reservoir 622 can accommodate dynamic fluctuations in temperature and pressure because, for example, it is sized to hold a volume of fluid that is at least as large as the volumetric difference between the system maximum and minimum fluid levels, whereby it can receive or dispense the required volume of fluid regardless of temperature or pressure.

As desired in some implementations, the system can be sealed and pressurized, whereby at a resting default state, it has an internal pressure of about 30 psi at 70° F. One suitable way to achieve this effect is to fill the cylinder 438 at 70° F. so that the reservoir 622 obtains atmospheric pressure, or about 15 psi, just prior to any fluid entering it. Then, not taking temperature into account, since the sealed system will behave according to the formula $P_1V_1=P_2V_2$, adding enough fluid to fill half of the reservoir 622, or halving the volume that the gas occupies, doubles the pressure therein from 15 to 30 psi. In other words, adding enough fluid to cut the volume of gas compartment 1635 in half will double the pressure to 30 psi. At this point, the pressure within the cylinder 438 will be 30 psi minus the pressure needed to unseat the check valve 624.

Accordingly, when the fluid temperature increases above 70° F., its volume correspondingly increases. As its volume increases, some of the fluid flows into the reservoir 622, increasing the gas pressure therein by reducing the volume of the gas compartment 1635. The opposite is true when fluid temperature decreases. That is, when the fluid temperature decreases below 70° F., the volume of the fluid correspondingly decreases. At this point, the pressure within the cylinder 438 is less than the pressure within the reservoir 622, whereby gas pressure from gas compartment 1635 will force fluid from the reservoir past the check valve 624 and into the cylinder 438. The reservoir 622 is sized so that, at the minimum operating temperature, the gas pressure in the reservoir 622 is always higher than the fluid pressure in the cylinder 438. Hence, the entire system holds enough fluid so that the reservoir 622 will never be depleted of fluid, even while operating at minimum temperature(s).

Besides the size of reservoir 622 and total system fluid volume, the setting of the relief valve 626, i.e., the pressure required to unseat it, is greater than the maximum acceptable operational pressure within the hydraulic lock during use. This ensures that the hydraulic lock always maintains enough fluid pressure and volume to adequately function. Accordingly, when the system experiences typical pressure spike(s) or increases corresponding to, e.g., engine torque, reaction forces, and/or other common operating forces, the relief valve 626 will not unseat, no fluid will flow therethrough, and the functional integrity of the hydraulic lock will be maintained.

As another example, referring to the exemplary thermal compensator 620 seen in FIGS. 21C and 21D, when starting at a neutral or resting state in which the pressure of gas compartment 1635 is 30 psi, upon an increase in temperature, the fluid in hydraulic cylinder 438 can expand. This increases the fluid volume and pressure within passage 621 and correspondingly within valve housing 1434. If the pressure sufficiently increases to a predetermined amount, the pressure within valve housing 1434 becomes greater than the biasing force or pressure provided by relief valve spring 1626. Accordingly, a volume of fluid within valve housing 1434 flows through the clearance within plug bore 657, between the outer circumferential surface of relieve valve pin 670 and the inner circumferential surface of relief plug 660, and forces the relieve valve 626 open.

In other words, still referring to FIGS. 21C and 21D, the pressure differential between the valve housing 1434 and the plug bore 657 is great enough to compress relief valve spring 1626 and direct fluid from the valve housing 1434, through the plug bore 657, and into the medial bore 654 of the check valve body 651. Correspondingly, fluid is displaced from the medial bore 654, through leading end bore 652, through passage 1622, and into fluid chamber 1630 of reservoir 622. This increases the relative volume of fluid compartment 1630, whereby the accumulating fluid in fluid chamber 1630 pushes the reservoir piston 1640 axially into the gas compartment 1635 which increases its pressure, and decreases its relative volume, by compressing the compressible gas therein.

As another example, again starting at a neutral or resting state in which the pressure within gas compartment 1635 is about 30 psi. Upon a decrease in temperature, the fluid in hydraulic cylinder 438 can contract. This decreases the fluid volume and pressure within passage 621 and correspondingly within valve housing 1434. If the pressure sufficiently decreases, the gas pressure within valve housing 1434 becomes great enough to overwhelm the opposing biasing force provided by check valve spring 1624. Accordingly, the check valve 624 opens a fluid within reservoir 622 flows through the check valve 624 through the clearance within valve housing 1434, between the outer circumferential surface of check valve body 651 and the inner circumferential surface of valve unit 434.

In other words, still referring to FIGS. 21C and 21D, if the pressure differential across the check valve 624 is great enough to compress the check valve spring 1624, fluid flow from the reservoir 622, through the passage 1622, around and past the check valve body 651 and into the valve housing 1434. Correspondingly, fluid is displaced from the valve housing 1434, through passage 621, and into the hydraulic cylinder 438. This decreases the relative volume of fluid compartment 1630. The reservoir piston 1640 withdraws axially from the gas compartment 1635 by the pressurized gas in compartment 163.

Referring now to FIGS. 20 and 21A-21D, besides the above-described auto-pressure regulation functions of thermal compensator 620, plunger assembly 680 can be used to manually relieve pressure from the hydraulic cylinder 438 or otherwise set the system pressure back to a state of hydraulic equilibrium. Accordingly, if the fluid temperature and pressure increase and the user feels or otherwise detects the manifestation of seal drag within the hydraulic cylinder 438, then the user can manually alleviate at least some of the excess pressure from within the cylinder 438 to mitigate the seal drag condition. To manually alleviate excess pressure within the cylinder 438 and mitigate such seal drag, the user merely slides the cylinder assembly 430 its full stroke to the left (FIG. 22B) and to depress the plunger button 695 against bracket 452.

Referring again to FIGS. 21C and 21D, when plunger button 695 is depressed, it and plunger body 690 slide through bore 682, and the plunger head 692 passes concentrically through check valve spring 1624. As plunger head 692 contacts, then pushes, the end of relief valve pin 670, relief valve spring 1626 compresses and flange 662 of relief valve body 661 lifts away from its seat against the end of relief valve plug 660. This allows fluid to flow from cylinder 438, through passage 621 and valve housing 1434, through the bore 657, medial bore 654, leading end bore 652, passage 1622, and into fluid compartment 1630. The increased volume of fluid in compartment 1630 slides the reservoir piston 1640 to the right (FIG. 21C) or left (FIG. 21D), depending on the particular configuration of reservoir 622, compressing the gas within gas compartment 1635. In other words, the excessive pressure that caused the seal drag can be relieved by manually manipulating the valving within thermal compensator 620, and correspondingly decreasing the volume and pressure of fluid in cylinder 438 and absorbing the same by way of reservoir 622.

Referring again to FIGS. 19 and 22A one potential drawback of a cable actuated system is the fact that cables act as springs. That is, as the inner core of a cable is loaded, the outer housing flexes, imposing a biasing force on the inner core. If the control valve opening forces and the resultant resistance to cable actuation decreases significantly upon valve opening or at any time after the control valve opens, the outer sleeve releases the stored potential energy, tending to open the control valve further. Fluid then flows through the control valve at higher rate, potentially causing the cylinder to surge or "chatter". As a result, instead of moving smoothly at a steady rate, the cylinder may move in series of starts and stops, providing a noticeably "jerky" feel to the operator.

This problem is eliminated or at least greatly alleviated in this embodiment of the invention because the control valve opening force and resultant resistance to cable actuation remain relatively constant during the steering process. This is because the pressure across each of the control valves 530 and 532 is always at least generally equalized. If the chamber 544 or 546 is pressurized because of fluid passage through the check valve 534 or 536, a chamber 545 or 547 behind the valve body 554 is pressurized at the same pressure as chamber 544 or 546. The force tending to seat the check valve 578 is equal to the seat area multiplied by the pressure in chamber 544 or 546. The seat area is equal to the area of the bore through the cylinder 574 at the seat 580. The pressure in chamber 545 or 547 acts on the area of the cylinder 574 which is approximately equal to the area of the seat 580. Therefore, the fluid force tending to seat the valve from one end is offset by the equal and opposite fluid force tending to unseat it from the other end. The opening force is equal to the spring force of spring 584.

In use, the steering system 410 assumes the position illustrated in FIGS. 20A and 22A in the absence of the imposition of steering forces on the throttle grip 522. At this time, the throttle grip 522 assumes its center or neutral position, and both control valves 530 and 532 assume their closed position of FIG. 22A. Fluid flow between the chambers 442 and 444 in the cylinder 438 is blocked by the closed control valves 530 and 532, hence locking the piston cylinder 438 from moving. This locking prevents steering arm motion and assures that the tiller 426 and engine 420 retain their position despite the imposition of reaction or backlash forces on or by the engine 420.

Assuming now that the operator wishes to turn the boat in direction "A" of FIG. 21, he or she pivots the throttle grip 522, thereby causing the actuator block 502 to rock about point 512 and pull the inner core 494 of the cable 490 away from the valve unit 434 and open control valve 532 as seen in FIG. 22B. Additional throttle grip pivoting drives the tiller arm 480 and steering arm 428, hence pivoting the engine 420 about its support 422 and altering the steering angle of the rudder 424. This steering arm movement also drives the cylinder 438 in the direction of arrow A, forcing fluid from the chamber 442 of the cylinder 438. Fluid then flows through the passage 474 and into the port 470, through the control valve 532, and into the passage 550. The resulting fluid pressure in the passage 550 opens the check valve 534 and permits fluid to flow out of the port 472, through the passages 476, 478, and into the opposite chamber 444 of the cylinder 438.

If the operator releases the throttle grip 522 or even stops applying a steering force to the throttle grip 522, the throttle grip 522 and tiller actuator portion 436 will return to their neutral, center position of FIG. 20A under the force of the spring 514. The check valve 534 will then close under the force of the return spring 600. The check 578 of control valve 532 will likewise close under the closing force imposed by the return spring 582. Fluid flow through the valve assembly 432 is now blocked, preventing the cylinder 438 from moving and locking the engine 420 and its rudder 424 in that last-commanded steering angle.

When the operator wishes to steer the boat 412 in the opposite direction, the above operation occurs in the same way but in the opposite direction. Hence, the operator pivots the throttle grip 522 in the direction "B" in FIG. 21 to pivot the actuator block 502 clockwise about pivot point 510 to open the control valve 530 through the cable 492. Fluid then flows from the chamber 444 in the cylinder 438, through the port 472 of the valve unit 434, through the open control valve 530, and into passage 550, where it opens the valve 536. The fluid then flows through the valve 536, out of the port 470 of the valve unit 434, through the passage 474, and into the opposite chamber 442 of the cylinder 438.

Hence, regardless of the direction of throttle grip movement, one of the valves 530 or 532 is opened mechanically by an associated cable 492 or 494.

Tiller actuation may be resisted or assisted by reaction forces imposed on or by the engine 420. For instance, if motor torque tends to move cylinder 438 in direction B, a pressure is generated in chamber 444. When the operator imposes sufficient force to overcome the torque, the pressure in chamber 444 is reduced to zero. The throttle grip 522 is moved in direction A. Valve 532 is opened. Increased force by the operator then creates a pressure in chamber 442. This pressure opens check valve 534 and fluid flows from chamber 442 into chamber 444. The check valve 534 therefore prevents only back flow of fluid. However, if the operator decreases the actuating force to a point where the engine torque is greater than the applied steering force, the pressure in chamber 444 will overcome the pressure in the cross passage 550, closing the check valve 534 and blocking fluid flow out of the chamber 444. The tiller 426 and engine 420 are thereafter hydraulically locked from further motion unless the operator moves the tiller further.

Conversely, if the engine torque creates a pressure in chamber 444, and the operator wants to steer with the engine torque, he or she moves the throttle grip 522 with only enough force to pivot the actuator block 486 sufficiently to cause the cable 492 to open the, valve 530, at which time the engine torque will drive the cylinder 438 to the left and cause fluid to flow from the chamber 444, through the valve assembly 432 via the valves 530 and 536, into the opposite chamber 442. Again, as before, once the operator stops movement of grip 522, the engine torque will return the valve assembly 472 to its neutral position.

It has been discovered that the cable operated valve assembly 432 will also work on powered steering systems such as that discussed above in conjunction with FIG. 15. Specifically, because the opening load of the valves is constant, the "cable spring" effect discussed above is not a problem. The valve assembly therefore can be separated from the tiller and mounted on the cylinder, resulting in a simplified system. This modification would require removing the check valves 534 and 536. One would also have to block off passage 550 that leads to valve 530, remove or close the seat 592, and add a passage from the valve 530 back to a reservoir.

Figure 23:
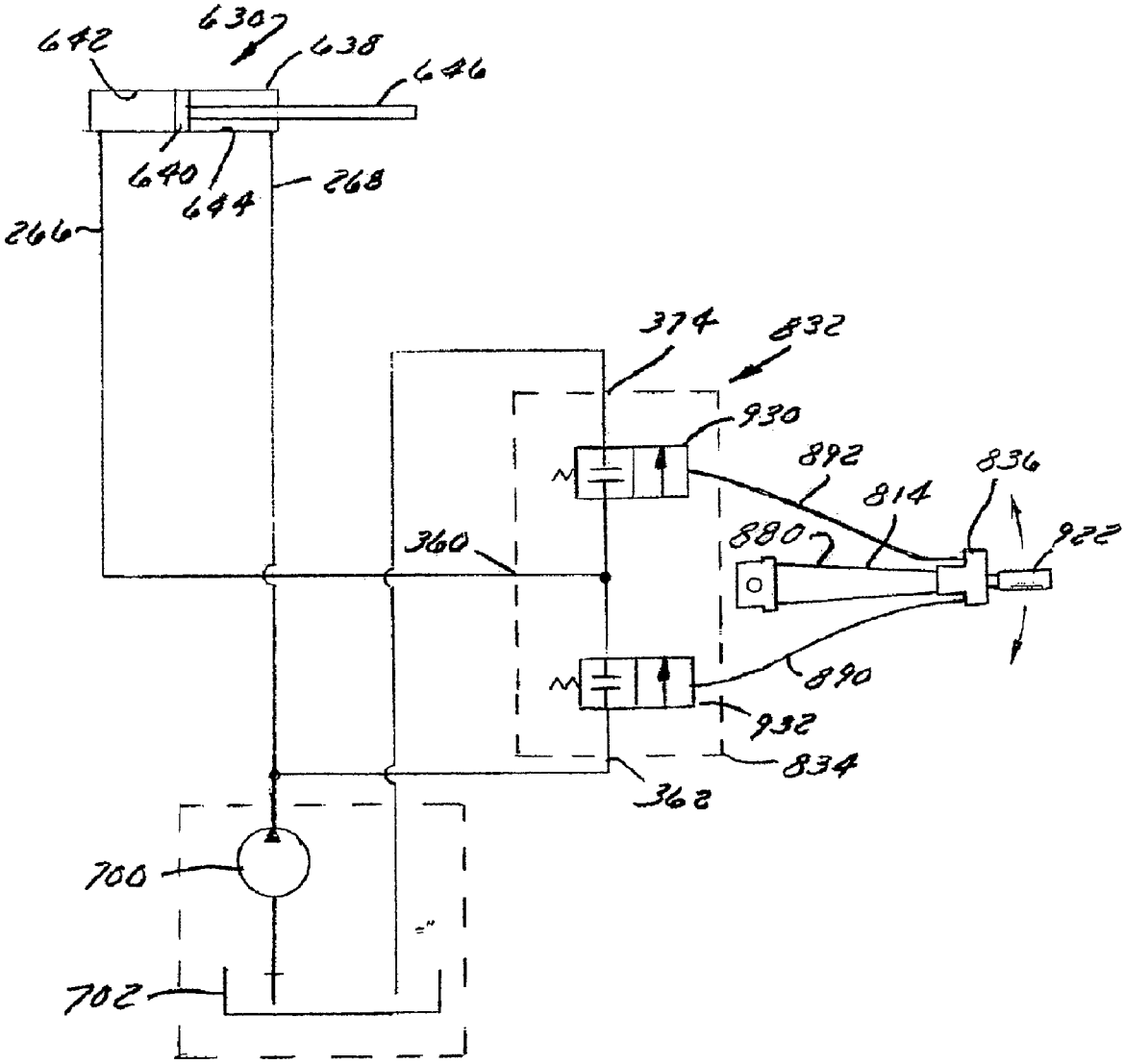
FIG. 23 is a circuit schematic illustrating the construction and operation of the components of a steering system constructed in accordance with yet another embodiment of the invention.

The resultant system is illustrated schematically in FIG. 23. It includes the same unbalanced cylinder 630, pump 700, and reservoir 702 discussed above in connection with FIG. 15. It also includes a valve assembly 832 that is functionally identical to the valve assembly 432 after being modified, as discussed in the immediately preceding paragraph. Valve assembly 432 therefore includes an inlet port 362 connected to the pump 700, either directly as shown or via the chamber 638 in the cylinder 630, an outlet port 374 connected to the reservoir 702, and an inlet/outlet port 360 connected to the chamber 642 in the cylinder 630 by the line 266. The valve assembly 832, like the valve assembly 432 described above, includes first and second cable actuated valves 930 and 932. Valves 930 and 932 are actuated by respective cables 892 and 890 upon the articulation of an actuator portion 836 of a tiller 814 under the manual actuation of a throttle grip 922 as described above in connection with the embodiment of FIGS. 16-22B. As with that embodiment, the valve assembly 832 may be provided in a unit 834 that is separated from the tiller 814 and possibly formed integrally with the cylinder 630 as a module. In this case, the line 266 will be wholly interior to the module, and the only exterior ports on the module would be the ports 362 and 374. The resulting system would respond to operator input in the same manner as that discussed above in connection with FIG. 15 and the one disclosed in U.S. Pat. No. 6,715,438.

5. Construction and Operation of Fourth Embodiment

Turning now to FIGS. 24-32, a self-locking tiller actuated steering system 1010 constructed in accordance with a fourth preferred embodiment of the invention is illustrated. The steering system 1010 differs from those of the prior embodiments in that it does not require modification to the existing tiller 1026 or the steering arm 1028 as do some of the other systems. Similar to steering system 410 (FIG. 16), in steering system 1010, the control valves are actuated remotely by cables, namely, cables 1090 and 1092, rather than directly.

The most notable difference between this and the prior embodiment is the manner in which actuator assembly 1036 of the steering system 1010 is connected to the existing tiller 1026 and steering arm 1028. Rather than modifying or altering the existing tiller steering components and linkages, the actuator assembly 1036 is located between the tiller 1026 and the steering arm 1028 of the engine 1020.

Figure 24:
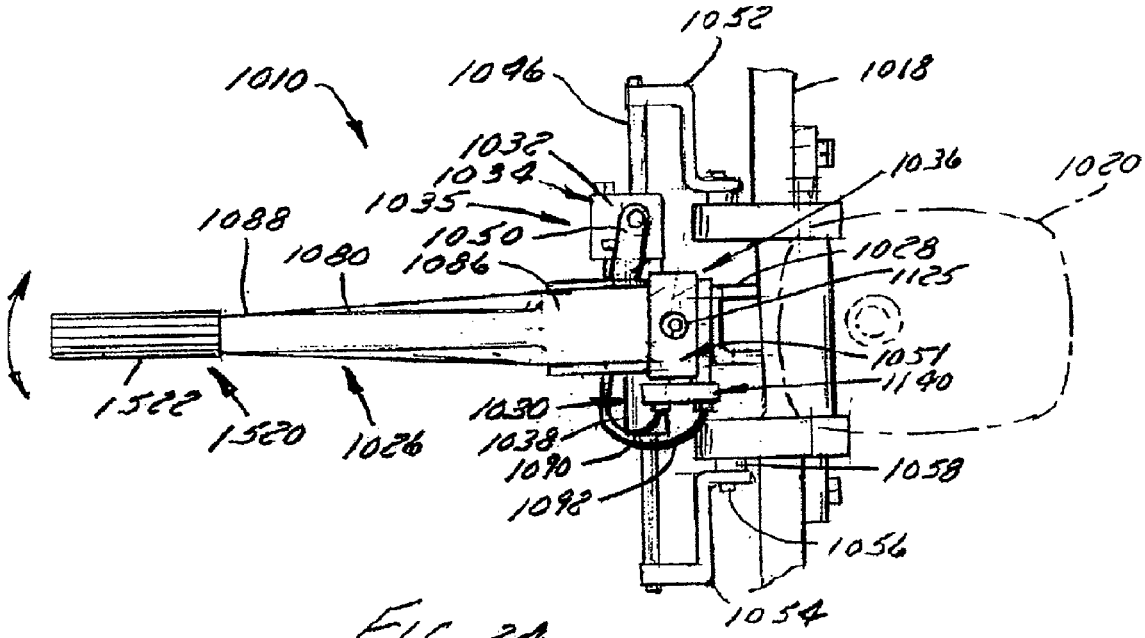
FIG. 24 is a schematic top plan view of a stern of a boat incorporating another self-locking tiller-operated steering system constructed in accordance with another preferred embodiment of the present invention.
Figure 25:
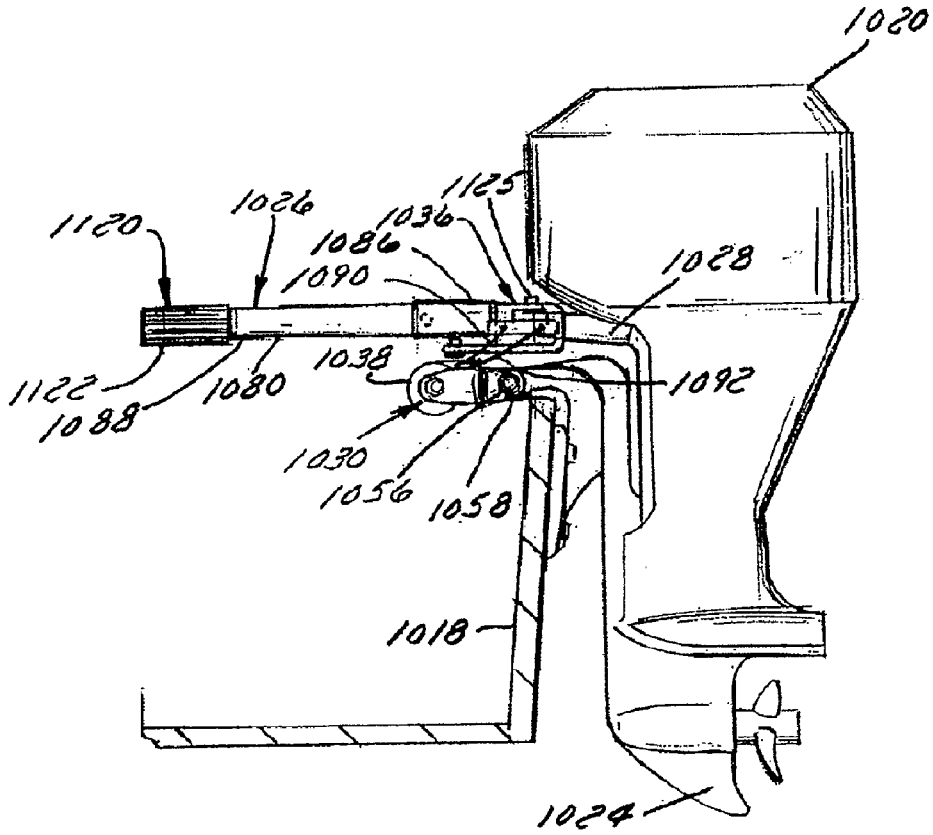
FIG. 25 is a side elevation view of the steering system of FIG. 24.
Figure 26:
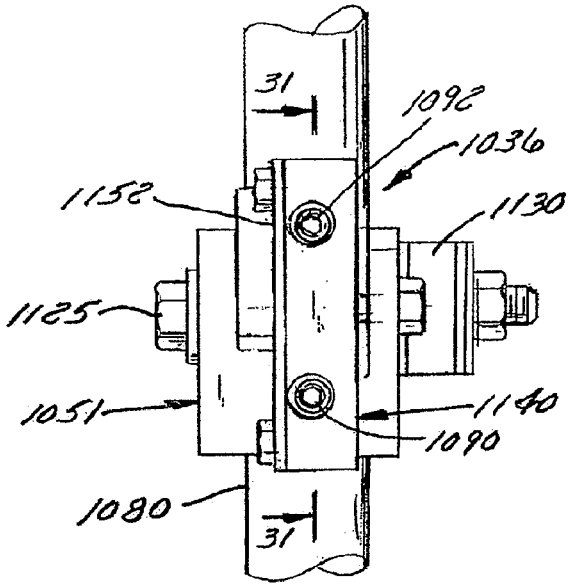
FIG. 26 is a side view of the steering system of FIGS. 24-25, rotated 90 degrees.
Figure 28:
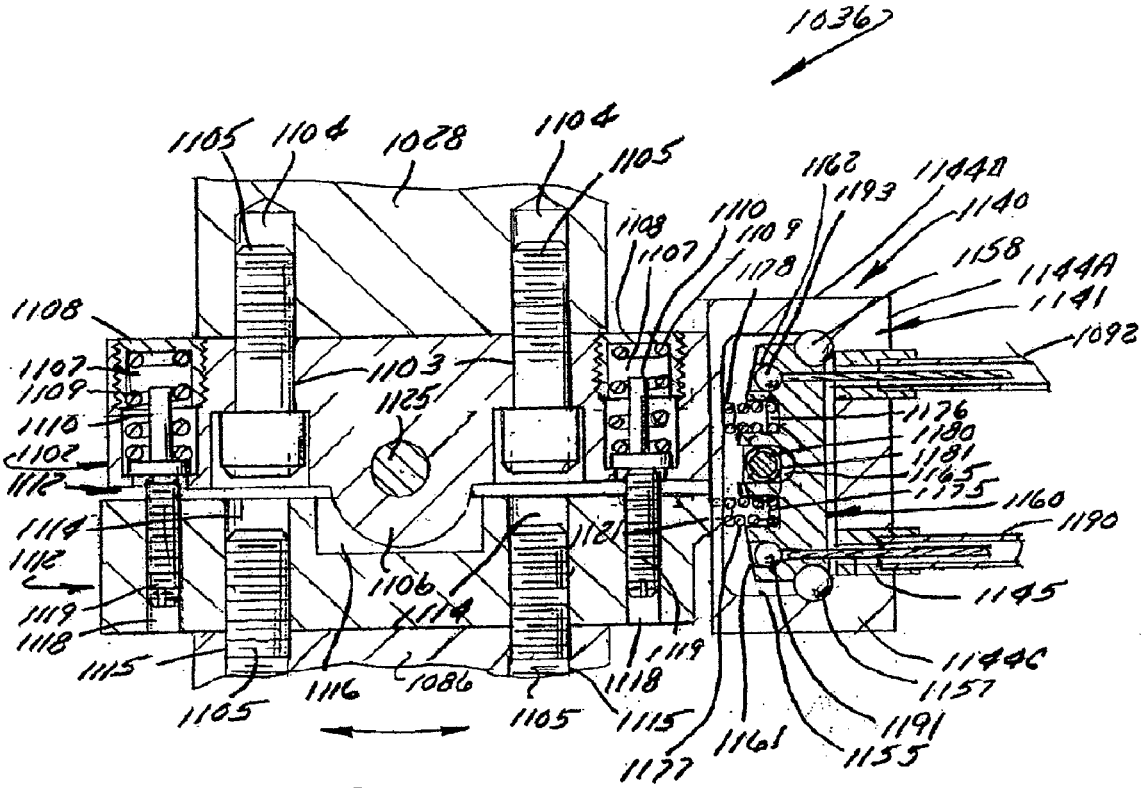
FIG. 28 is a sectional view of the system of FIGS. 24-27, taken at line 28-28 in FIG. 27.

Referring now to FIGS. 24, 25, and 28, the steering system 1010 of this embodiment includes a tiller 1026, a hydraulic lock in the form of a hydraulic cylinder assembly 1030, and a valve assembly 1032 that is housed in a valve unit 1034 mounted on or formed integrally with the cylinder assembly 1030 to produce a module 1035. The steering system 1010 further includes an actuator assembly 1036 which remotely and mechanically controls the module 1035 by transferring manually generated forces therethrough.

The various components of module 1035 may be identical to the corresponding components of module 435 of the third embodiment. The descriptions of module 435 therefore are equally applicable here with respect to module 1035. For example, cylinder assembly 1030 and valve assembly 1032 are essentially identical to cylinder assembly 430 and valve assembly 432, respectively. Likewise, the functionality of such components are substantially the same. Hence, valve assembly 1032 acts as an "engager" that is responsive to tiller operation to selectively engage and disengage the hydraulic lock by selectively permitting or preventing a movable portion of the cylinder assembly 1030, such as, e.g., cylinder 1038, from moving.

Referring now to FIG. 24, the hydraulic cylinder assembly 1030 is mounted concentrically around a rod 1046 that is affixed to a piston within the cylinder assembly 1030. The ends of rod 1046 extend through and out from both ends of the cylinder assembly 1030. Thus, one of the rod 1046 and the cylinder assembly 1030 is movable relative to the other and is connected to the steering arm 1028. The other one of the rod 1046 and the cylinder assembly 1030 is mounted on a fixed support such as the transom 1018 or on an intervening mounting assembly.

Referring to FIGS. 24 and 25, the cylinder assembly 1030 of this embodiment is coupled to the steering aim 1028, and the rod 1046 is mounted on the transom 1018. Specifically, the cylinder 1038 is coupled to the steering arm 1028 by a link 1050 so that the cylinder assembly 1030 moves axially back and forth with pivoting movement of steering arm 1028. A first end of rod 1046 is supported on a first mounting bracket 1052. The other, second, end of rod 1046 is supported on a second mounting bracket 1054. Each mounting bracket 1052, 1054 is connected to a respective end of a shaft or rod 1056 that extends through a tilt tube 1058 of the engine 1020 as best seen in FIG. 24.

Still referring to FIGS. 24 and 25, tiller 1026 includes an elongate tiller arm 1080 with a motor facing end 1086 and an opposing user facing front end 1088. The user facing end houses a throttle grip assembly 1520, including throttle grip 1522 rotatably mounted thereupon.

The complete assemblage of actuator assembly 1036 translates user-applied forces to tiller 1026 to generally axial movement of cables 1090, 1092. Cables 1090-1092 and all other cables referred to herein can be any of a variety of suitable (i) push type, (ii) pull type, (iii) combined push-pull type, (iv) and/or other cables as desired, based on their particular end use configuration and the configurations of the components with which they interact, so long as they provide the intended functionality. Referring now to FIGS. 24, 25, and 28, the actuator assembly 1036 includes a tiller joint assembly 1051 that is operably coupled to cable actuator assembly 1140. As seen best in FIG. 28, tiller joint assembly 1051 includes steering arm block 1102 and tiller arm block 1112. Steering arm block 1102 has a pair of throughbores 1103 that register with a corresponding pair of bores 1104 extending into the steering arm 1028. Fasteners 1105 extend through the throughbores 1103 and into bores 1104, threadedly holding the steering arm block 1102 against the steering arm 1028. Preferably, fasteners 1105 are cap-bolts having their end caps received in counterbores at the end of throughbores 1103 so that the fasteners 1105 do not extend outwardly beyond the outwardly facing surface of steering arm block 1102.

As best seen in cross-section of FIG. 28, a bolt boss 1106 extends from the outwardly facing surface of steering arm block 1102. The bolt boss 1106 has a throughbore that receives bolt 1125, which serves as part of a hinge-like pivot connection between the steering arm block 1102 and the tiller arm block 1112. Bores 1107 extend through the steering arm block 1102, generally parallel to throughbores 1103 and laterally outside of them. Endcaps 1108 are threaded into the bore 1107 such that the circular bottom walls of endcaps 1108 define a removable enclosure structure for the bore 1107. Each of the bores 1107 houses a compression spring 1109 concentrically therein. The bottom of each spring 1109 is retained by the circular bottom wall of endcap 1108. The springs 1109 resiliently hold plugs 1110 within the bores 1107.

Still referring to FIG. 28, tiller arm block 1112 has a pair of throughbores 1114 that registers with a corresponding pair of bores 1115 extending into the motor facing end 1086 of tiller arm 1080. Fasteners 1105 extend through the throughbores 1114 and into bores 1115, threadedly holding the tiller arm block 1112 against the tiller arm 1080.

Figure 27:
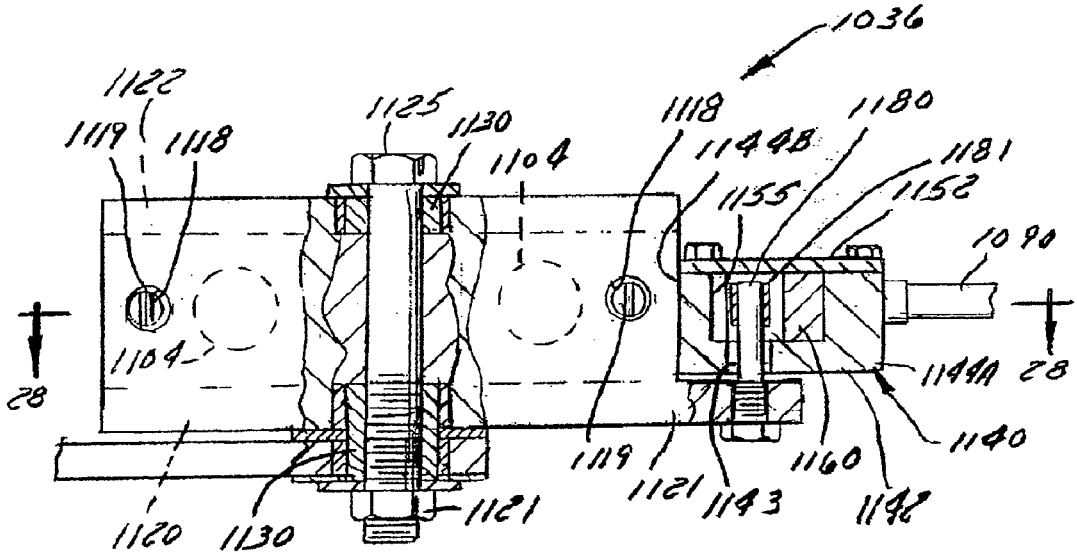

Referring now to FIG. 27 upper and lower flanges 1120 and 1122 extend parallel to each other from the side which faces steering arm block 1102. Thus, flanges 1120 and 1122 are extensions of the upper and lower surfaces of the tiller arm block 1112. In some implementations, such as the one seen in FIG. 27, the lower flange 1120 may include an elongate actuator arm 1121 extending actuator arm 1121, which holds actuator post 1180, explained in greater detail elsewhere herein. A recess 1116 extends into the outer surface of tiller arm block 1112 between the bores 1115. Recess 1116 receives bolt boss 1106 therein so that the bolt boss 1106 can freely pivot.

Laterally outside of bores 1115 are relatively narrower bores 1118. They extend through the tiller arm block 1112, generally parallel to throughbores 1114, and extend through the entire thickness of tiller arm block 1112. At least a portion of the inner circumferential surfaces of each of bores 1118 is threaded. Bores 1118 threadedly house setscrews 1119 therein. The setscrews 1119 can axially pass through the length of bores 1118 and extend therefrom.

Referring now to FIGS. 27 and 28, the bores 1118 and setscrews 1119 are coaxially aligned with the openings of bores 1107 of steering arm block 1102 so that the setscrews 1119 can compress springs 1109. Correspondingly, the restorative forces applied by springs 1109 urge the setscrews 1119 to axially withdraw from the bores 1107. However, an entire withdrawal of setscrews 1119 from bore 1107 can be prevented since steering arm block 1102 and the tiller arm block 1112 are pivotably joined to each other by bolt 1125.

Still referring to FIGS. 27 and 28, bolt 1125 extends generally vertically through cooperating portions of steering arm block 1102 and tiller arm block 1112. Specifically, bolt 1125 extends through upper flanges 1120, bolt boss 1106, and lower flange 1122, sequentially. Preferably, bolt 1125 interfaces with these structures by way of suitable bushing and/or bearing assemblies such as bearing assemblies 1130. Bearing assemblies 1130 provide relatively low friction rotatable relationships between the bolt 1125 and the structures through which it extends.

Upper and lower flanges 1120, 1122 lie above and below bolt boss 1106, respectively. The flanges 1120, 1122 can sandwich bolt boss 1106 in a double-shear configuration, with bolt 1125 extending through aligned holes in each. Accordingly, a longitudinal axis of bolt 1125 defines an axis of pivotation, permitting pivotal movement of the steering arm block 1102 and tiller arm block 1112 with respect to each other.

Referring now to FIG. 28, the amount of pivotal movement between steering arm block 1102 and tiller arm block 1112 is defined by the gap or clearance between the facing side surfaces of steering arm block 1102 and tiller arm block 1112. The thickness of the gap is set using the setscrews 1119.

Pivotal movements between the steering arm block 1102 and tiller arm block 1112 are translated into actuations of cables 1090, 1092 by cable actuator assembly 1140. Referring again to both of FIGS. 27 and 28, cable actuator assembly 1140 includes, e.g., housing 1141, cover 1152, actuator plate 1160, and actuator post 1180. The housing 1141 is attached to a sidewall of tiller arm block 1112 and encloses the actuator plate 1160. Optionally, it can be mounted to an outwardly extended portion of the arm block 1112 bottom wall. Regardless, in preferred implementations, housing 1141 is positional fixed with respect to the steering arm block 1102. The housing 1141 includes a bottom wall 1142 that has an elongate slot 1143 extending therethrough. Elongate slot 1143 slidingly house portions of tiller joint assembly 1051 therein.

Housing 1141 further includes sidewalls 1144A, 1144B and endwalls 1144C, 1144D extending upwardly from the bottom wall 1142. Sidewalls 1144A and 1144B generally define the housing 1141 length and are parallel to each other. Endwalls 1144C, 1144D are parallel to each other and extend between and connect the ends of sidewalls 1144A, 1144B. Cables 1090, 1092 extend through apertures 1145, 1146 and into a cavity 1155. Cavity 1155 is defined between the inwardly facing surfaces of sidewalls 1144A, 1144B and endwalls 1144C, 1144D. Cover 1152 sits atop and can be bolted or otherwise removably secured to the housing 1141, defining the upper or top boundary of cavity 1155. Two opposing corners of cavity 1155 house pivot posts 1157, 1158 therein. Pivot posts 1157, 1158 extend between the lower wall of the housing 1141 and cover 1152. In this configuration, cavity 1155 can house an actuator plate 1160 so that plate 1160 moves therein, dictated at least in part by the pivot posts 1157, 1158 and the input forces applied by the user to the steering system 1010.

Actuator plate 1160 pulls and/or pushes the cables 1090, 1092 in a manner that corresponds to movement of tiller arm block 1112. The actuator plate 1160 includes slot 1165 extending into its side facing the tiller joint assembly 1051. Cable recesses 1161, 1162 are formed into actuator plate 1160, open toward tiller joint assembly 1051, and lie on opposing sides of slot 1165. The cable recesses 1161, 1162 receive and hold cable end fasteners 1091, 1093, respectively, whereby movements of actuator plate 1160 are translated into movements of the axially movable, e.g., wire rope, portions of cables 1090, 1092. The actuator plate 1160 further includes spring pockets 1175, 1176 that lie between respective ones of the cable recesses 1161, 1162 and slot 1165. Spring pockets 1175, 1176 provide mounting structures for holding springs 1177, 1178 within the cavity 1155 in a suitable orientation with respect to actuator plate 1160.

The springs 1177, 1178 of the embodiment are compression springs which bias the actuator plate 1160 to urge to a resting, neutral state, seen in FIG. 28, when no user-applied force is inputted to the steering system 1010. Springs 1177, 1178 sit on opposing sides of an actuator post 1180 and roller 1181 that extend from the actuator arm 1121 attached to flange 1120 of tiller arm block 1112.

Actuator post 1180 extends upwardly from actuator arm 1121, through elongate slot 1143 in the bottom wall 1142 of cable actuator assembly 1140, and into the slot 1165 of the actuator plate 1160. A roller 1181 is concentrically mounted to and can rotate with respect to the top of actuator post 1180. The roller 1181 thus is positioned between the actuator post 1180 and the inwardly facing surface(s) of slot 1165, whereby the roller 1181 provides a relatively low-friction interface therebetween.

In light of the above, it is apparent that the valve assembly 1032 is responsive to tiller 1026 actuation to selectively engage and disengage the hydraulic lock. When the user applies an input force to tiller 1026, the hydraulic lock is disengaged and axial movement of the cylinder 1038 along the rod 1046 is permitted. This is done by selectively permitting or preventing a movable portion of the cylinder assembly 1030 from moving. More specifically, the valve assembly 1132 is actuated in response to movement of a first component of tiller joint assembly 1051 relative to another component of tiller joint assembly 1051. In so doing, e.g., when the user applies an input force to tiller 1026, movable components of actuator assembly 1036 move in response thereto. In particular, the user applies a force to tiller 1026, which is transferred through tiller arm block 1112, pivoting it about bolt 1125 and thus moving it with respect to steering arm block 1102.

Figure 29:
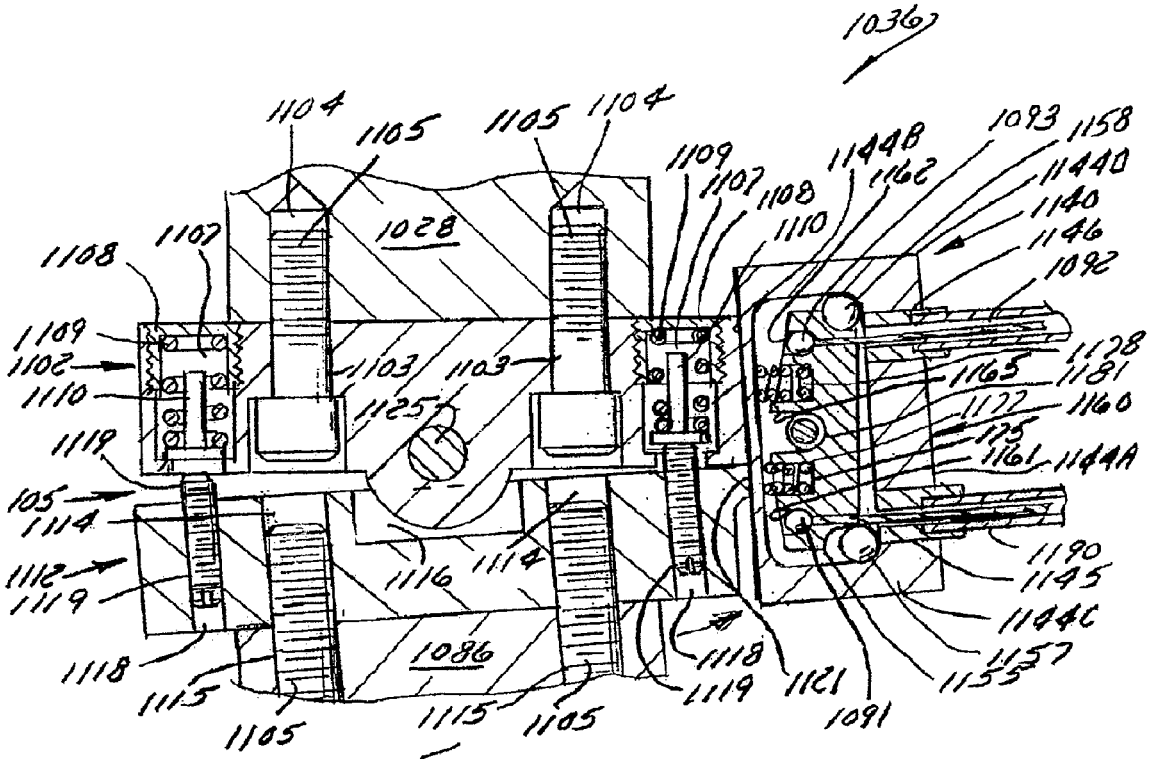
FIG. 29 corresponds to FIG. 28 but shows the actuator system in a first actuated position.
Figure 30:
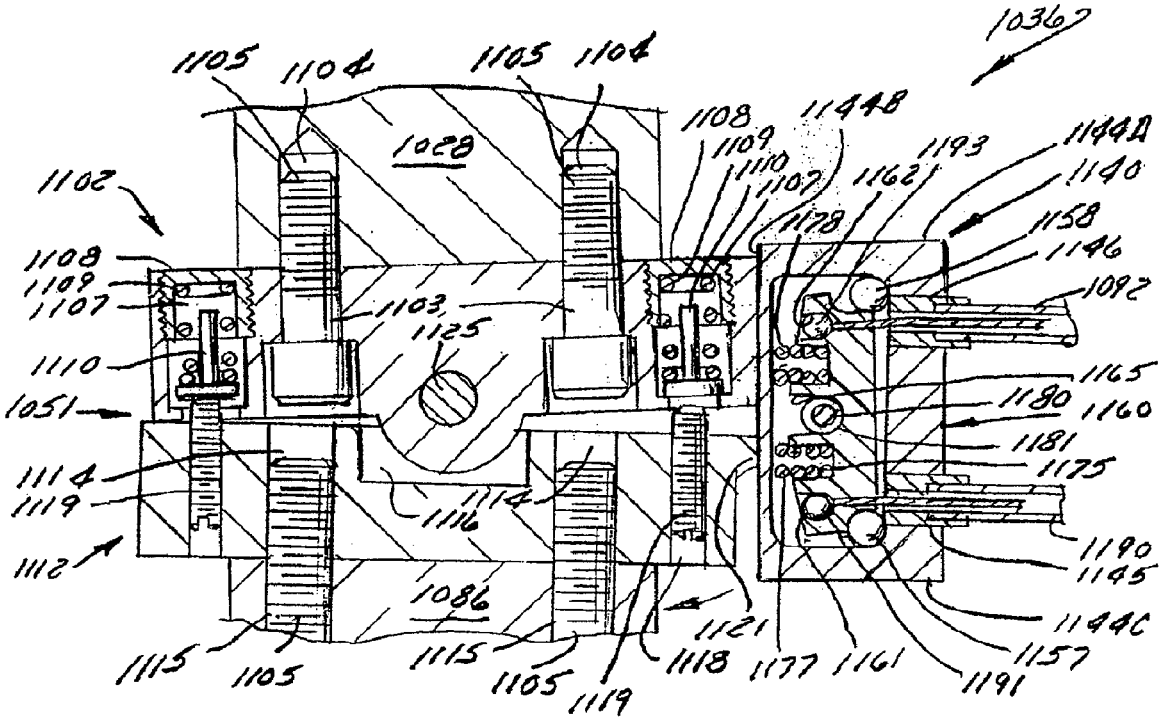
FIG. 30 corresponds to FIG. 28 but shows the actuator system in a second actuated position.

Referring now to FIGS. 29 and 30, the movement of tiller arm block 1112 with respect to steering arm block 1102 is translated into movement of actuator post 1180 within the cable actuator assembly 1140. In particular, moving the tiller arm 1080 moves the tiller arm block 1112 and thus also moves actuator arm 1121. As actuator arm 1121 moves, actuator post 1180 moves in unison therewith. The movement of actuator post 1180 is guided or at least partially dictated by the shape of elongate slot 1143, whereby actuator post 1180 traverses the slot 1143 and simultaneously pushes against a portion of the inwardly facing surface of slot 1165 in the actuator plate 1160. Such pushing forces urge the actuator plate 1160 in generally the same direction as arm 1121 travels.

Referring now to FIGS. 29-32, since pivot posts 1157, 1158 longitudinally contain the actuator plate 1160, as actuator post 1180 pushes actuator plate 1160, its movements are restricted to substantially pivotal movements about the respective one of pivot posts 1157, 1158. As the actuator plate 1160 pivots, slot 1165 angularly rotates and actuator post 1180, by way of roller 1181, rolls across the surface of slot 1165. All the while, the actuator post 1180 and roller 1181 continue to, e.g., push, actuate, and pivot the actuator plate 1160, until the user applies no more force or the maximum travel distance is achieved.

In this configuration, actuator plate 1160 pulls and/or pushes the cables 1090, 1092 as it pivots about pivot posts 1157, 1158, thus opening or otherwise actuating the valve assembly 1032 and correspondingly releasing the hydraulic lock and allowing tiller 1026 to turn engine 1020. The particular amount that actuator plate 1160 pivots and, correspondingly, the particular amount of cable 1090, 1092 actuation is a function of, e.g., the particular configurations and magnitudes of dimensions of the components within the steering system 1010.

For example, the particular position of actuator post 1180 relative to, e.g., bolt 1125, tiller arm 1080, and the pivot posts 1157, 1158, as well as the relative dimensions of actuator plate 1160, influences the magnitude of (i) tiller arm 1080 travel required to effectuate a desired travel distance of actuator post 1180, (ii) actuator post travel required to effectuate a desired travel distance of actuator plate 1160, and (iii) actuator plate 1160 travel required to effectuate a desired travel distance of cables 1090, 1092, in order to suitably manipulate or actuate the valve assembly 1032.

In preferred implementations, the cable actuator assembly 1140 functions as an overdrive or an actuation multiplier, whereby output movements of cable actuator assembly 1140, e.g., movements of cables 1090, 1092, are multiplied or amplified in magnitude as compared to input movements such as those of actuator post 1180 and roller 1182. Preferably the cable 1090, 1092 axially moves a distance having a magnitude about three times as great as the magnitude of the distance that actuator post 1180 and roller 1182 move. Accordingly, when actuator post 1180 and roller 1182 travel about 0.030 inch, the cables 1090 and 1092 correspondingly travel about 0.090 inch.

Figure 31:
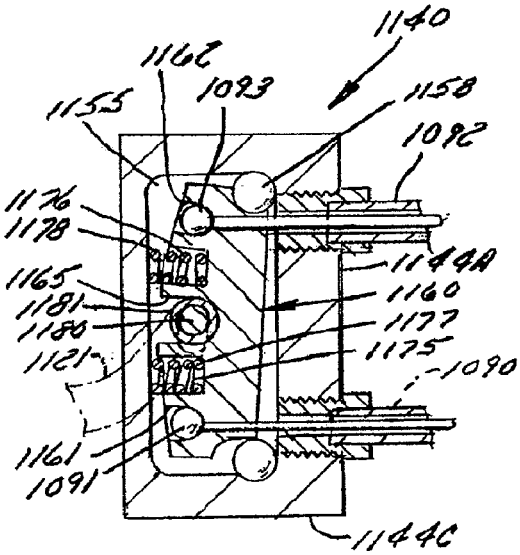
FIG. 31 is a sectional plan view of the cable actuator assembly of FIGS. 24-30, taken at line taken at line 31-31 in FIG. 26, the actuator plate in a first actuated position.

Accordingly, as seen in FIGS. 29 and 31, when the user applies force to tiller 1026 so as to rotate tiller arm 1080 in a counterclockwise direction, tiller arm block 1112 likewise rotates or pivots in a counterclockwise direction. Correspondingly, actuator arm 1121 and actuator post 1180 move arcuately in a counterclockwise direction. In other words, actuator post 1180 moves arcuately from a resting, neutral, state (FIG. 28) toward endwall 1144D. In so doing, the actuator post 1180, by way of roller 1181, rolls across and pushes the surface of slot 1065, urging the actuator plate 1160 against pivot post 1158. In response, the actuator plate 1160 pivots about pivot post 1158 in the opposite, clockwise, direction than that of tiller arm block 1112, pulling cable 1090 to actuate the valve assembly 1032.

Figure 32:
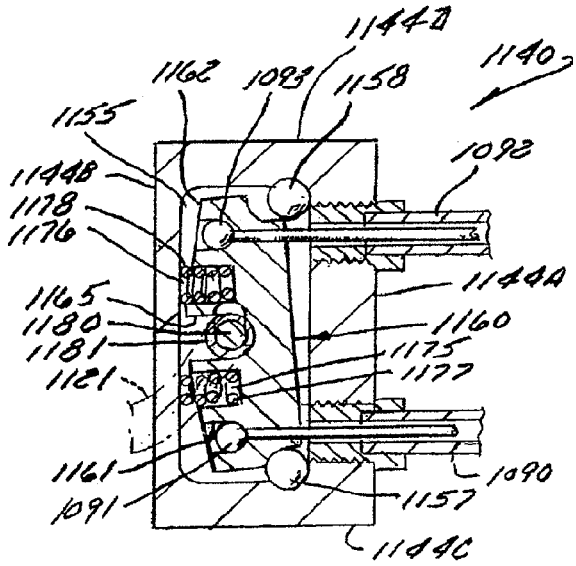
FIG. 32 corresponds to FIG. 31 but shows the actuator plate in a second actuated position.

Correspondingly, referring now to FIGS. 30 and 32, when the user applies force to tiller 1026 and rotates tiller arm 1080 in a clockwise direction, the tiller arm block 1112 likewise rotates or pivots in a clockwise direction. Then, actuator arm 1121 and actuator post 1180 move arcuately in a clockwise direction toward endwall 1144C. Simultaneously, the actuator post 1180, by way of roller 1181, rolls across and pushes the surface of slot 1065, urging the actuator plate 1160 against pivot pin 1146 and rotating the actuator plate 1160 in the opposite, counterclockwise, direction. As actuator plate 1160 rotates or pivots counterclockwise, it pulls cable 1092, drawing it nearer sidewall 1144B.

If the user applies a force to steering system 1010, then releases such manually generated force, the hydraulic lock is engaged to deactuate the valves of valve assembly 1032, preventing the flow of fluid therethrough. Axial movements of the cylinder 1038 along the rod 1046 are thus prevented.

The springs 1109, 1177, and 1178 provide biasing restorative forces at this time which return the tiller arm 1080 and actuator plate 1160, respectively, to neutral, resting state positions. More specifically, with no user applied or manually generated input force, the respective one of springs 1109 pushes against the plug 1110, which in turn pushes against the respective setscrew 1119, until the tiller joint assembly 1051 is at equilibrium with the springs 1109 and provide substantially the same biasing forces against the setscrews 1119 and the steering arm block 1102 and tiller arm block 1112 are substantially directly aligned with each other.

Likewise, the respective one of springs 1177 and 1178 return the actuator plate 1160 to its neutral, resting state position. Accordingly, with no user applied and thus no manually generated input force, the respective one of springs 1177 and 1178 pushes against the spring pocket 1175, 1176 until the actuator plate 1160 is at equilibrium with the springs 1177 and 1178 providing substantially the same biasing forces against the actuator plate, whereby the actuator plate is urged against both pivot posts 1157, 1158. Correspondingly, no pulling force is applied to either cable 1090, 1092, and the valve assembly 1032 is not actuated, its valves are closed. Hence, no fluid can pass through the valve assembly 1032, and the engine 1020 and tiller 1026 are locked in the last user-steered position. Accordingly, the steering system 1010 maintains the last commanded steering angle of the rudder 1028 and reaction forces imposed on or by the steered element are prevented from being transmitted to the tiller 1026.

Many changes and modifications could be made to the invention without departing from the spirit thereof. The scope of some of these changes can be appreciated by comparing the various embodiments as described above. The scope of the remaining changes will become apparent from the appended claims.

I claim:

1. A steering system for a watercraft, comprising:

A. a tiller having a tiller arm operatively coupled to a steered element of a watercraft so as to impose manually-generated steering forces on the steered element;

B. a hydraulic lock preventing reaction forces imposed on or by the steered element from being transmitted from the steered element to the tiller in the absence manually-generated steering forces; and C. a thermal compensator having, i) a reservoir in fluid communication with the hydraulic lock; and ii) a compensating valve assembly that is provided between the reservoir and the hydraulic lock and that opens in response to changes in hydraulic fluid pressures due to temperature changes in the hydraulic lock to selectively permit a volume of fluid to flow therethrough in a first direction and a second generally opposite direction, wherein the compensating valve assembly influences flow direction and volume of a fluid between the hydraulic lock and the reservoir in response to changes in fluid pressure within the hydraulic lock, wherein the compensating valve assembly includes a check valve and a relief valve, and wherein the relief valve is incorporated into the check valve.

2. The steering system as recited in claim 1, wherein a volume of fluid flows through the relief valve to accommodate temperature induced pressure increases of fluid within the hydraulic lock, and a volume of fluid flows through the check valve to accommodate temperature induced pressure decreases of the fluid within the hydraulic lock.

3. The steering system as recited in claim 1, wherein the reservoir is sealed from an ambient atmosphere and has a gas compartment defining a volume thereof that dynamically changes in response to pressure changes of the fluid with the hydraulic lock.

4. A steering system for a watercraft, comprising:

A. a tiller having a tiller arm operatively coupled to a steered element of a watercraft so as to impose manually-generated steering forces on the steered element;

B. a hydraulic lock preventing reaction forces imposed on or by the steered element from being transmitted from the steered element to the tiller in the absence manually-generated steering forces; and C. a thermal compensator having, i) a reservoir in fluid communication with the hydraulic lock; and ii) a compensating valve assembly that is provided between the reservoir and the hydraulic lock and that opens in response to changes in hydraulic fluid pressures due to temperature changes in the hydraulic lock to selectively permit a volume of fluid to flow therethrough in a first direction and a second generally opposite direction, wherein the reservoir is sealed from an ambient atmosphere and has a gas compartment defining a volume thereof that dynamically changes in response to temperature changes of the fluid within the hydraulic lock.

5. The steering system as recited in claim 4, further comprising a reservoir piston separating the gas compartment from the fluid within the reservoir.

6. A steering system for a watercraft, comprising:

A. a tiller having a tiller arm operatively coupled to a steered element of a watercraft so as to impose manually-generated steering forces on the steered element;

B. a hydraulic lock preventing reaction forces imposed on or by the steered element from being transmitted from the steered element to the tiller in the absence manually-generated steering forces; and C. a thermal compensator having, i) a reservoir in fluid communication with the hydraulic lock; and ii) a compensating valve assembly including a check valve having a check valve body, wherein the compensating valve assembly defines a first fluid flow path extending axially through the check valve body and a second fluid flow path extending around an outer surface of the check valve body.

7. The steering system as recited in claim 6, further comprising a relief valve communicating with the check valve.

8. The steering system as recited in claim 7, wherein the relief valve selectively permits or restricts a volume of fluid to traverse the first fluid flow path extending axially through the check valve body.

9. The steering system as recited in claim 6, wherein the first and second fluid flow paths define opposing directions of flow.

10. The steering system as recited in claim 9, wherein the relief valve seats to a closed position when the fluid is at a relatively low temperature induced pressure.

11. The steering system as recited in claim 9, wherein the relief valve unseats to an open position when the fluid is at a relatively high temperature induced pressure.

12. The steering system as recited in claim 9, wherein the check valve seats to a closed position when the fluid is at a relatively high temperature induced pressure.

13. The steering system as recited in claim 9, wherein the check valve unseats to an open position when the fluid is at a relatively low temperature induced pressure.

14. A steering system for a watercraft, comprising:

A. a steered element of the watercraft;

B. a tiller arm operatively communicating with the steered element, for imposing manually-generated steering forces to the steered element;

C. an actuator assembly coupling and permitting generally horizontal pivotal movement between the tiller arm and the steered element;

D. a hydraulic lock comprising a fixed portion and a movable portion that is movable relative to the fixed portion to permit fluid to flow to or from the hydraulic lock; and E. a valve assembly which is operatively coupled to the hydraulic lock for directing fluid flow within the hydraulic lock, wherein the pivotal movement of the tiller arm with respect to the steered element actuates the actuator assembly to cause the valve assembly to open within the hydraulic lock.

15. The steering system as recited in claim 14, wherein the actuator assembly includes a cable that is pushed or pulled corresponding to changes in relative position of the tiller arm with respect to the steered element.

16. The steering system as recited in claim 14, wherein the actuator assembly includes a cable actuator assembly that houses an end of the cable.

17. The steering system as recited in claim 16, further comprising a cable actuator housing that encloses an actuator pin moving in unison with the tiller arm.

18. The steering system as recited in claim 17, wherein, when the pin moves a first distance, the cable moves a second distance that is about three times greater in magnitude than the first distance.

19. The steering system as recited in claim 17, wherein the actuator pin cooperates with and urges an actuator plate into pivotal movement.

20. The steering system as recited in claim 19, wherein the actuator pin is slidingly housed into a slot extending into the actuator plate.

21. The steering system as recited in claim 19, wherein the actuator plate is pivotable about first and second axes.

22. The steering system as recited in claim 21, wherein pivoting of the actuator plate about first and second axes pulls a first cable and a second cable, respectively.

23. The steering system as recited in claim 16, wherein the actuator assembly includes a resilient member that urges the tiller into a neutral position when there is no user input force applied thereto.

24. The steering system as recited in claim 21, wherein the neutral position is one in which the steered element and the tiller arm are generally longitudinally aligned with each other.

* * * * *